US011669044B2

(12) United States Patent
Kimura et al.

(10) Patent No.: US 11,669,044 B2
(45) Date of Patent: Jun. 6, 2023

(54) CARTRIDGE HAVING A PORTION-TO-BE-POSITIONED AND A PRESSING PORTION CONFIGURED IN RELATION TO A CORRESPONDING APPARATUS

(71) Applicant: CANON KABUSHIKI KAISHA, Tokyo (JP)

(72) Inventors: Takashi Kimura, Tokyo (JP); Isao Koishi, Yokohama (JP); Daisuke Yamamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/574,690

(22) Filed: Jan. 13, 2022

(65) Prior Publication Data

US 2022/0137551 A1 May 5, 2022

Related U.S. Application Data

(63) Continuation of application No. 17/325,329, filed on May 20, 2021, now Pat. No. 11,256,209, which is a (Continued)

(30) Foreign Application Priority Data

Dec. 28, 2018 (JP) ..... JP2018-246942
Dec. 28, 2018 (JP) ..... JP2018-246952

(51) Int. Cl.
*G03G 21/00* (2006.01)
*G03G 21/18* (2006.01)

(52) U.S. Cl.
CPC ..... *G03G 21/1842* (2013.01); *G03G 21/1853* (2013.01); *G03G 21/1896* (2013.01); *G03G 2221/1884* (2013.01)

(58) Field of Classification Search
CPC ..... G03G 21/1842; G03G 21/1853; G03G 21/1896; G03G 2221/1884
(Continued)

(56) References Cited

U.S. PATENT DOCUMENTS 5,508,785 A 4/1996 Takahashi et al.
6,301,456 B1 10/2001 Horrall et al.
(Continued)

FOREIGN PATENT DOCUMENTS

CN 1350210 A 5/2002
CN 106814575 A 6/2017
(Continued)

OTHER PUBLICATIONS

Sep. 22, 2020 Search Report in European Patent Application No. 19 21 8952.
(Continued)

*Primary Examiner* — Robert B Beatty
(74) *Attorney, Agent, or Firm* — Venable LLP

(57) ABSTRACT

An apparatus body of an image forming apparatus has a first guide portion having an inlet shape corresponding to an outer shape of an engagement portion provided in a cartridge when seen in an attachment direction of the cartridge to the apparatus body and guiding the engagement portion, a second guide portion for guiding a positioning target portion which is provided on the cartridge for positioning an attachment completion position of the cartridge with respect to the apparatus body, and a movable member being at a regulation position at which a guiding path of the positioning target portion by the second guide portion is blocked is immovable from the regulation position unless being pressed by the engagement portion.

9 Claims, 35 Drawing Sheets

Related U.S. Application Data continuation of application No. 16/728,191, filed on Dec. 27, 2019, now Pat. No. 11,048,207.

(58) Field of Classification Search
USPC ..... 399/111, 112
See application file for complete search history.

(56) References Cited

U.S. PATENT DOCUMENTS

| | | | |
|---|---|---|---|
| 7,912,404 | B2 | 3/2011 | Hoshi et al. |
| 9,141,030 | B2 | 9/2015 | Shimizu et al. |
| 2002/0081125 | A1 | 6/2002 | Karakama et al. |
| 2012/0093523 | A1 | 4/2012 | Kamoshida et al. |
| 2013/0330101 | A1 | 12/2013 | Gonzalez et al. |
| 2014/0086627 | A1 | 3/2014 | Tanabe et al. |
| 2014/0086628 | A1 | 3/2014 | Toriyama et al. |
| 2014/0161489 | A1 | 6/2014 | Niikawa et al. |
| 2015/0205254 | A1 | 7/2015 | Fujii et al. |
| 2016/0103418 | A1 | 4/2016 | Yada et al. |
| 2017/0102669 | A1 | 4/2017 | Makiguchi et al. |
| 2018/0348697 | A1 | 12/2018 | Hanayama et al. |
| 2020/0272095 | A1 | 8/2020 | Kamoshida et al. |

FOREIGN PATENT DOCUMENTS

| | | | |
|---|---|---|---|
| JP | H08-095467 | A | 4/1996 |
| JP | 2012-088395 | A | 5/2012 |
| JP | 2014-066794 | A | 4/2014 |
| JP | 2014-066797 | A | 4/2014 |
| JP | 2015-184482 | A | 10/2015 |
| JP | 2016-081034 | A | 5/2016 |
| JP | 2016-136219 | A | 7/2016 |
| JP | 2017-151484 | A | 8/2017 |

OTHER PUBLICATIONS

Oct. 4, 2022 Office Action in Japanese Patent Application No. 2018-246952.

Sep. 28, 2022 Office Action in Chinese Patent Application No. 201911372112.9 (with English translation).

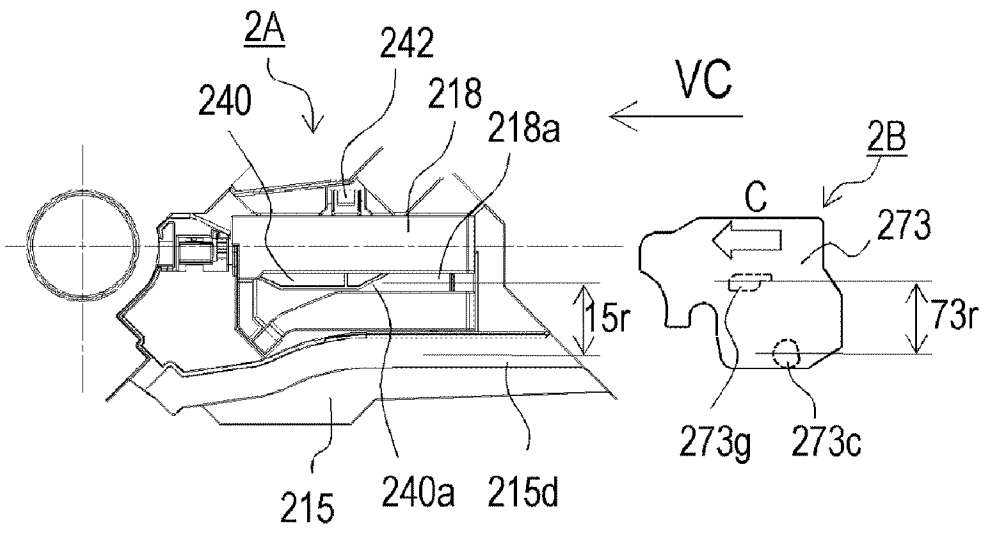
FIG.24A
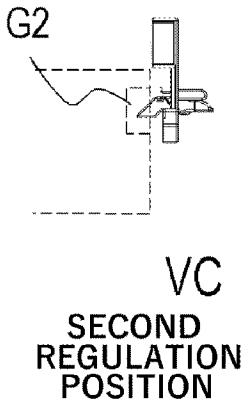
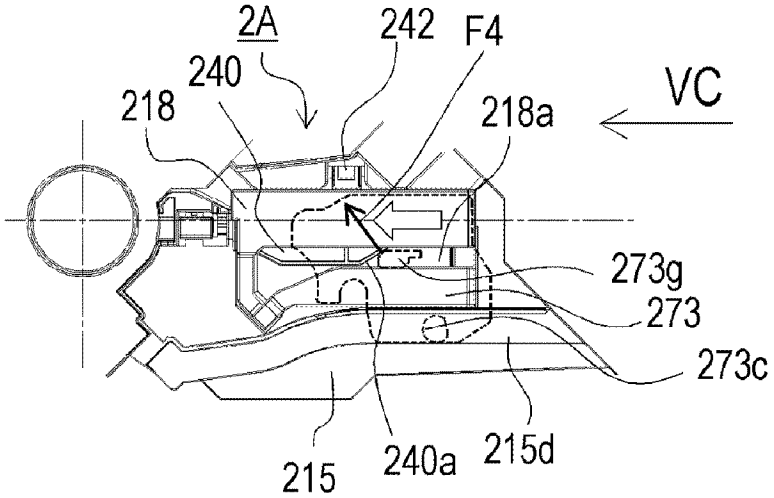
FIG.24B
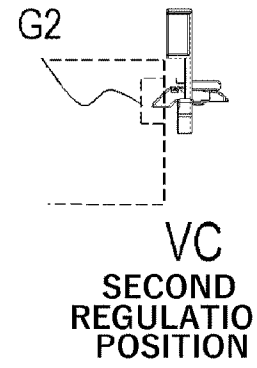

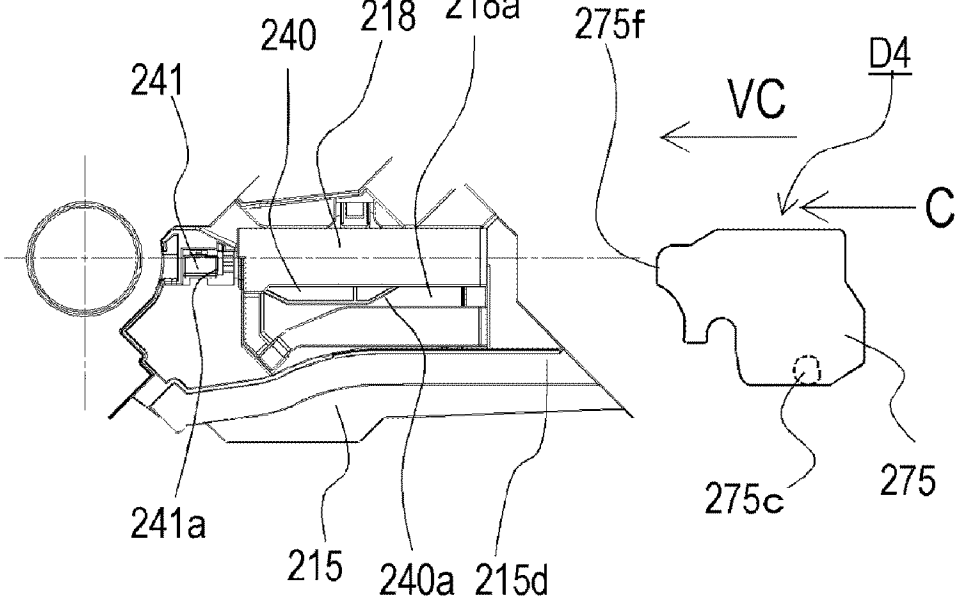
FIG.27A
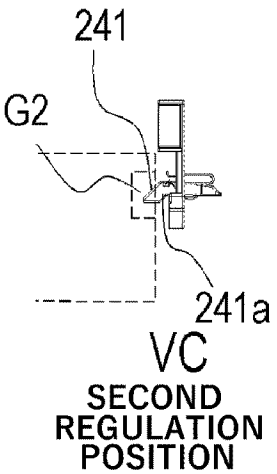
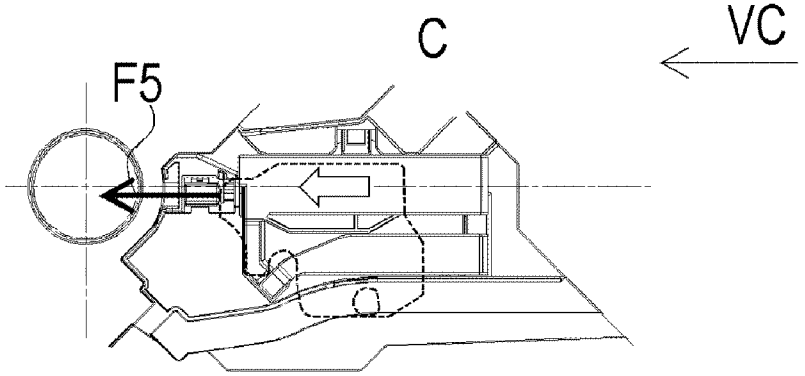
FIG.27B
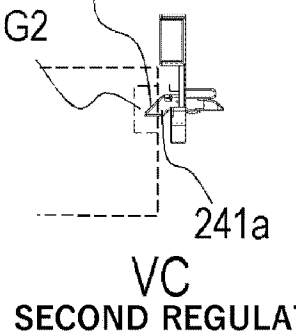

CARTRIDGE HAVING A PORTION-TO-BE-POSITIONED AND A PRESSING PORTION CONFIGURED IN RELATION TO A CORRESPONDING APPARATUS

BACKGROUND OF THE INVENTION

Field of the Invention

The present invention relates to a cleaning apparatus that cleans an image bearing member that bears a developer, a cartridge having the cleaning apparatus and used in an electrophotographic image forming apparatus, and an electrophotographic image forming apparatus.

An electrophotographic image forming apparatus forms an image on a recording medium using an electrophotographic image forming system, and examples thereof include an electrophotographic copying machine, an electrophotographic printer (an LED printer, a laser beam printer, and the like), a facsimile apparatus, and a word processor.

Description of the Related Art

In a so-called process cartridge-system image forming apparatus, a cartridge that is allowed or authorized to be attached to an apparatus body of an image forming apparatus may be attached to the apparatus body, and a cartridge that is not allowed or not authorized to be attached to the apparatus body may be attached to a cartridge attachment portion of the apparatus body of the image forming apparatus. This is an attachment error (insertion error) of a cartridge. A cartridge that is allowed to be attached to an apparatus body of an image forming apparatus is a cartridge of which the product model matches that of the image forming apparatus. Hereinafter, a cartridge that is allowed to be attached to the body of the image forming apparatus will be referred to as an allowed cartridge, and a cartridge that is not allowed to be attached to the body of the image forming apparatus will be referred to as an unallowed cartridge.

Japanese Patent Application Publication No. 2014-66794 proposes a method for preventing an attachment error of the unallowed cartridge. In this method, when an unallowed cartridge is inserted into an apparatus body of an image forming apparatus, a movable base provided near an opening of the apparatus body of the image forming apparatus cannot engage with a boss provided in the unallowed cartridge whereby an attachment error is prevented. That is, in the above-described configuration, an engagement portion is provided in the movable base so that the boss of an allowed cartridge engages with the movable base whereas the boss of an unallowed cartridge interferes with the movable base to prevent further insertion.

Japanese Patent Application Publication No. 2014-66797 proposes a method for identifying whether the cartridge is allowed one or not. In this method, when a cartridge is inserted into an apparatus body, after a first abutting portion of the cartridge passes through a protruding direction of a movable member of the apparatus body, when a second abutting portion abuts on an abutting target portion of the movable member, the first abutting portion and a rotary member of the apparatus body are separated from each other. Moreover, when the second abutting portion is separated from the movable member, the first abutting portion can pass through a protruding direction of the rotary member and the cartridge can be inserted into the apparatus body.

SUMMARY OF THE INVENTION

An object of the present invention further is to improve the conventional example and provide a technology capable of determining whether a cartridge is allowed to be attached to an image forming apparatus more reliably with a simple configuration.

In order to attain the object, an image forming apparatus according to the present invention includes:

an apparatus body and a cartridge detachably attachable to the apparatus body and which forms an image on a recording material, wherein the cartridge includes:

a positioning target portion for positioning an attachment completion position of the cartridge with respect to the apparatus body; and an engagement portion, the apparatus body includes:

a positioning portion that abuts on the positioning target portion when the cartridge is at the attachment completion position;

a first guide portion that guides the engagement portion and has an inlet shape corresponding to an outer shape of the engagement portion when seen in an attachment direction of the cartridge to the apparatus body;

a second guide portion that guides the positioning target portion; and a movable member configured to be pressed by the engagement portion with movement of the cartridge toward the attachment completion position whereby the movable member moves from a regulation position at which a guiding path of the positioning target portion by the second guide portion is blocked to a non-regulation position at which the guiding path is not blocked, wherein the movable member at the regulation position is configured to be immovable from the regulation position unless being pressed by the engagement portion.

In order to attain the object, an apparatus body of an image forming apparatus according to the present invention, the image forming apparatus forming an image on a recording material, the apparatus body being configured such that a cartridge is detachably attachable thereto, includes:

a positioning portion that abuts on a positioning target portion provided in the cartridge when the cartridge is at an attachment completion position;

a first guide portion that guides the engagement portion and has an inlet shape corresponding to an outer shape of an engagement portion provided in the cartridge when seen in an attachment direction of the cartridge to the apparatus body;

a second guide portion that guides the positioning target portion; and a movable member configured to be pressed by the engagement portion with movement of the cartridge toward the attachment completion position whereby the movable member moves from a regulation position at which a guiding path of the positioning target portion by the second guide portion is blocked to a non-regulation position at which the guiding path is not blocked, wherein the movable member at the regulation position is immovable from the regulation position unless being pressed by the engagement portion.

In order to attain the object, an image forming apparatus according to the present invention includes:

an apparatus body and a cartridge detachably attached to the apparatus body and which forms an image on a recording material, wherein as a first attachment error prevention mechanism for allowing attachment of only the cartridge to the apparatus body, the cartridge includes:

a first identification target portion and a third identification target portion provided on one end side in a first direction orthogonal to an attachment direction of the cartridge, the apparatus body includes:

a first identifying portion provided on one end side to guide attachment and detachment of the cartridge; and a first movable portion provided on one end side, the first movable portion being pressed by the first identification target portion whereby the first movable portion moves from a first regulation position at which a guiding path of the third identification target portion is blocked to a first allowable position at which the guiding path of the third identification target portion is not blocked, as a second attachment error prevention mechanism for allowing attachment of only the cartridge to the apparatus body, the cartridge includes:

a second identification target portion and a fourth identification target portion provided on the other end side in the first direction, the apparatus body includes:

a second identifying portion provided on the other end side to guide attachment and detachment of the cartridge; and a second movable portion provided on the other end side, the second movable portion being pressed by the second identification target portion whereby the second movable portion moves from a second regulation position at which a guiding path of the fourth identification target portion is blocked to a second allowable position at which the guiding path of the fourth identification target portion is not blocked.

According to the present invention, it is possible to determine whether a cartridge is allowed to be attached to an image forming apparatus more reliably with a simple configuration.

Further features of the present invention will become apparent from the following description of exemplary embodiments with reference to the attached drawings.

BRIEF DESCRIPTION OF THE DRAWINGS

FIGS. 24A and 24B are diagrams for describing a second attachment error prevention mechanism during insertion of a cartridge according to Embodiment 2;

FIGS. 27A and 27B are diagrams for describing a second attachment error prevention mechanism during insertion of a cartridge according to Embodiment 2.

DESCRIPTION OF THE EMBODIMENTS

Figure 1A:
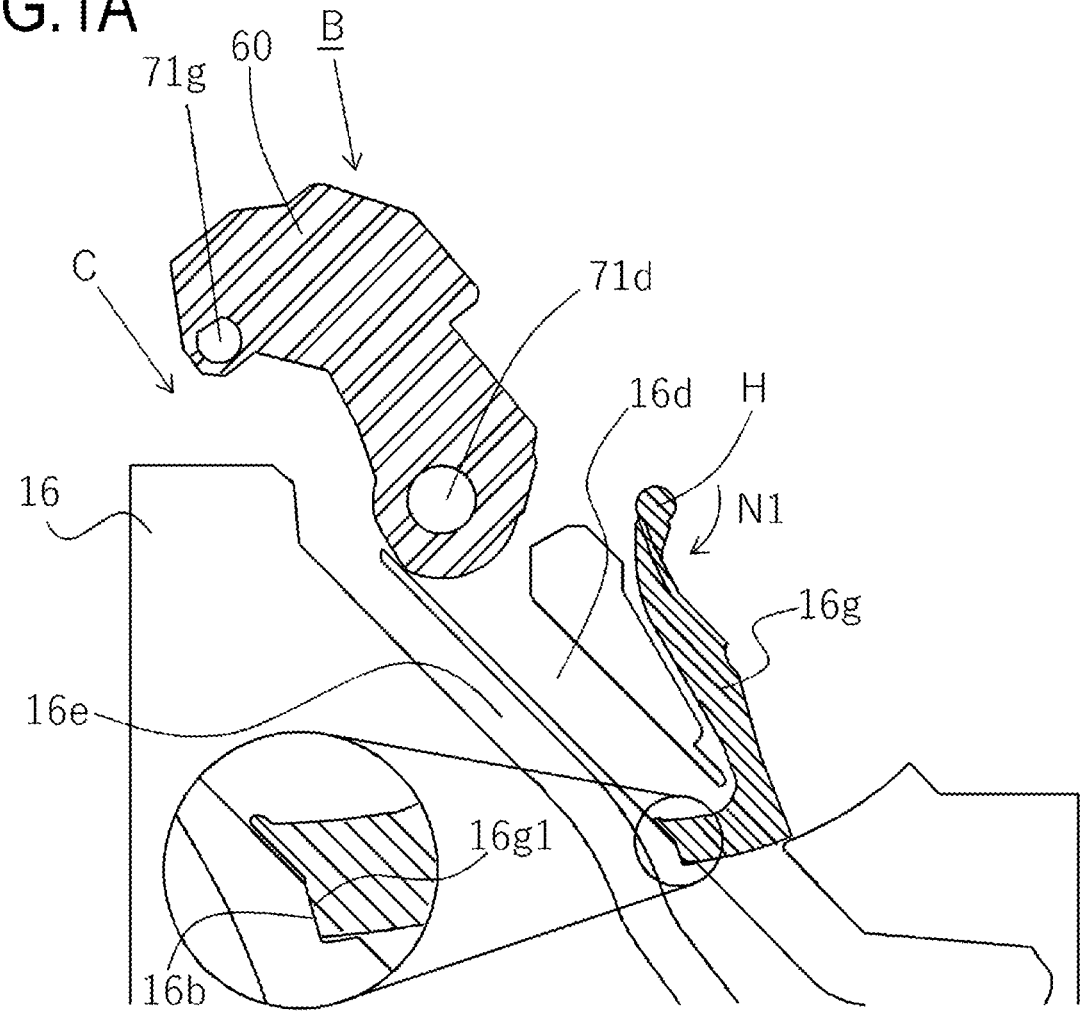
FIG. 1A is a diagram for describing an operation of an attachment error prevention mechanism during insertion of a cartridge according to Embodiment 1.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

A cartridge and an image forming apparatus according to embodiments of the present invention will be described with reference to the drawings. Hereinafter, a laser beam printer will be described as an example of an image forming apparatus, and a cartridge used in a laser beam printer will be described as an example of a cartridge.

In the following description, it is assumed that a longitudinal direction of a cartridge matches a rotation axis direction of a photosensitive drum which is an image bearing member.

Moreover, reference numerals in the following description are used for reference to the drawings and do not limited the configuration.

The components integrated as a cartridge are designed appropriately depending on an apparatus configuration or the like and are not limited to those components of the cartridge illustrated herein.

Embodiment 1

Overall Configuration of Image Forming Apparatus

Figure 2:
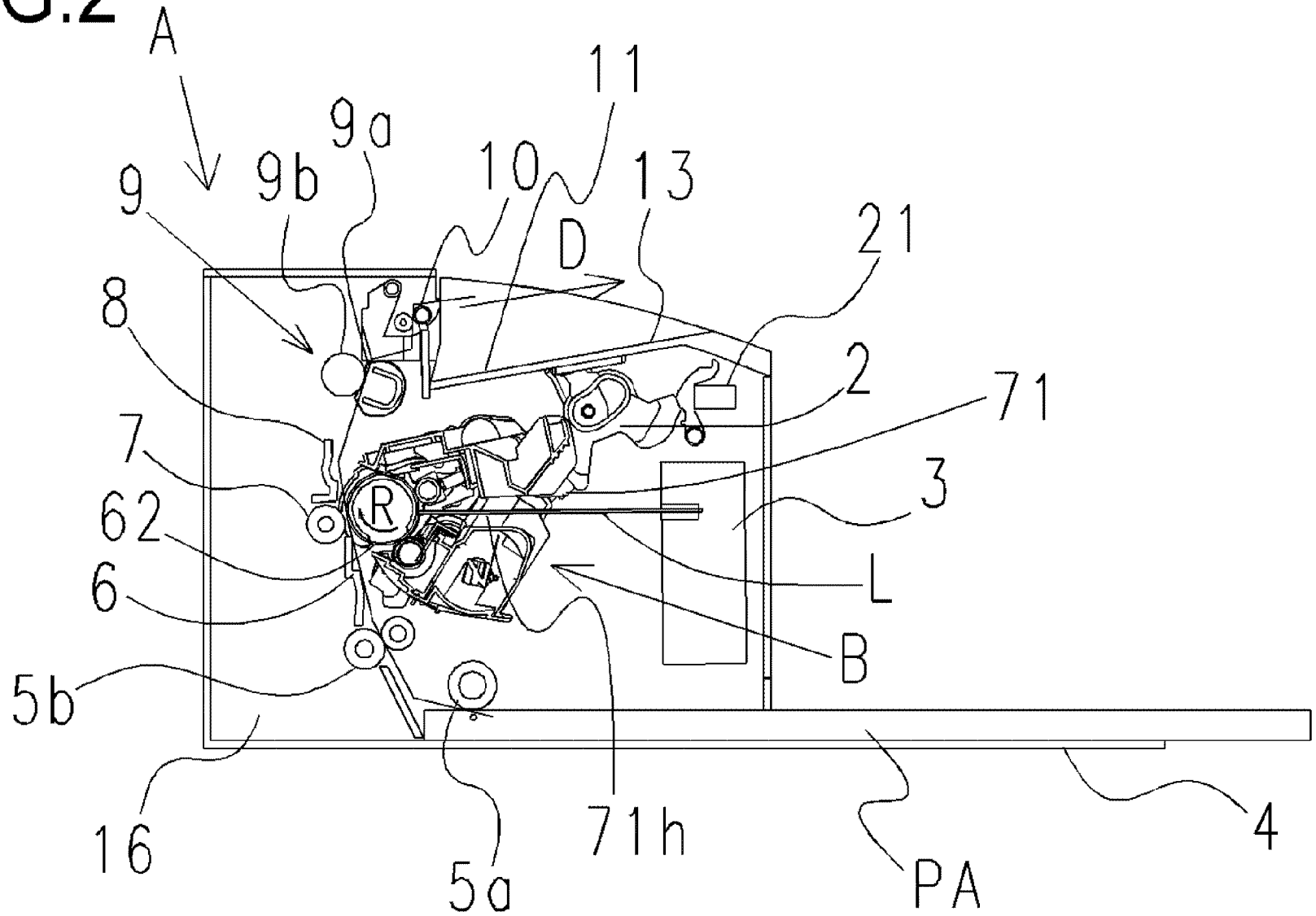
FIG. 2 is a schematic cross-sectional view of an image forming apparatus according to Embodiment 1.
Figure 3:
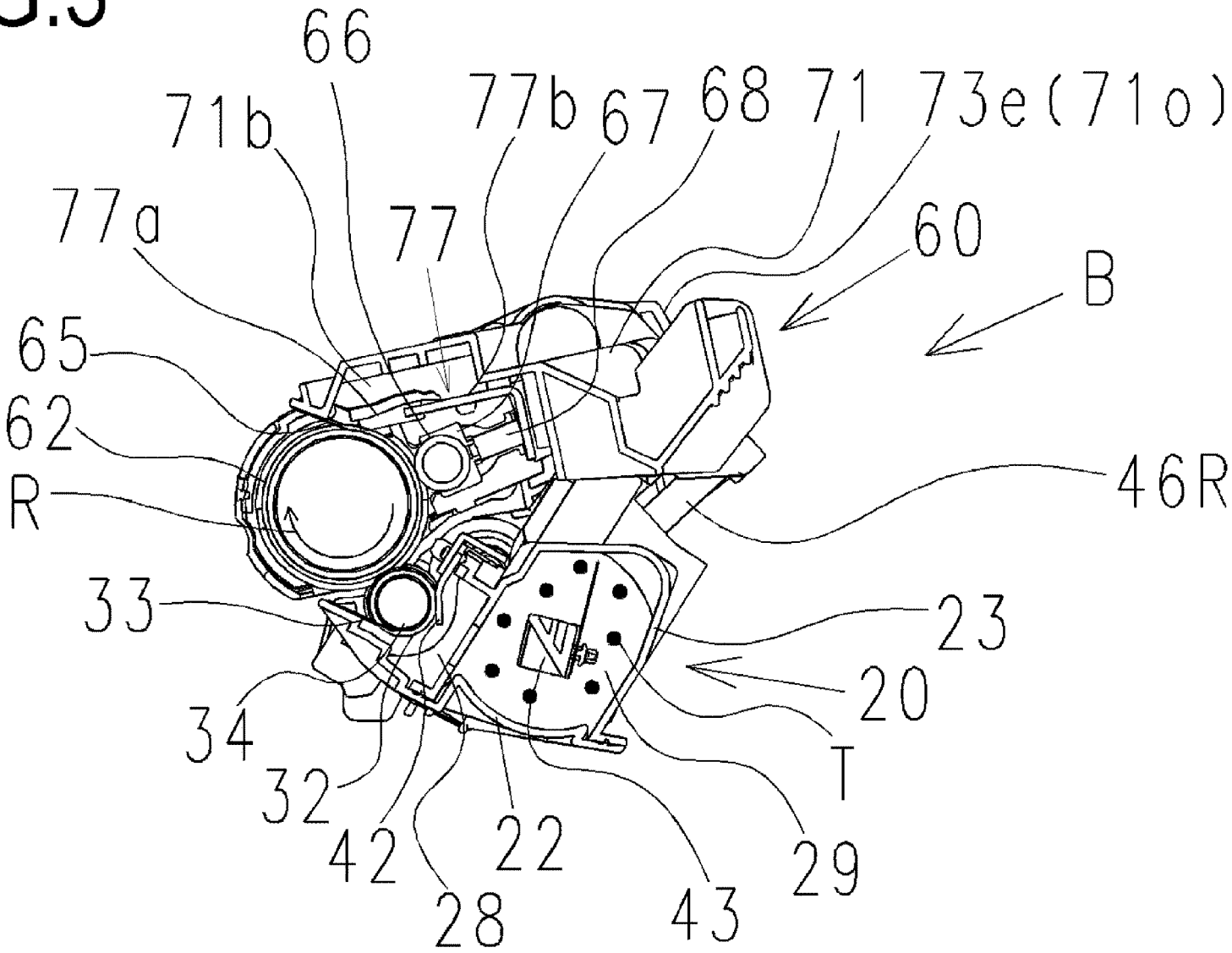
FIG. 3 is a schematic cross-sectional view of a cartridge according to Embodiment 1.

FIG. 2 is a cross-sectional view of an image forming apparatus body A (hereinafter referred to as an "apparatus body A") of an electrophotographic image forming apparatus (hereinafter referred to as an image forming apparatus) according to Embodiment 1 of the present invention and a cartridge B as a first cartridge. FIG. 3 is a cross-sectional view of the cartridge B.

Here, the apparatus body A is a portion of a configuration of the image forming apparatus excluding the cartridge B.

The image forming apparatus illustrated in FIG. 2 is a laser beam printer which uses an electrophotographic technology and in which the cartridge B can be detachably attachable to the apparatus body A.

A sheet tray 4 that stacks a recording medium (a recording material) (hereinafter referred to as a "sheet PA") serving as an image forming target is disposed under the cartridge B.

Furthermore, a pickup roller 5*a*, a feed roller pair 5*b*, a transfer guide 6, a transfer roller 7, a conveying guide 8, a fixing apparatus 9, a discharge roller pair 10, a discharge tray 11, and the like are disposed in the apparatus body A sequentially along a conveying direction D of the sheet PA. The fixing apparatus 9 includes a heating roller 9*a* and a pressure roller 9*b*.

Image Forming Process

Next, an overview of an image forming process will be described. An electrophotographic photosensitive drum (hereinafter referred to as a photosensitive drum 62 or simply as a drum 62) is rotated on the basis of a print start signal at a predetermined peripheral velocity (a process speed) in a direction indicated by arrow R in FIGS. 2 and 3.

A charging roller (a charging member) 66 to which a bias voltage is applied comes into contact with an outer circumference of the drum 62 to uniformly charge the outer circumference of the drum 62.

An exposure apparatus 3 outputs a laser beam L corresponding to image information. The laser beam L passes through a laser opening 71*h* provided in a cleaning frame body 71 of the cartridge B to scan and expose the outer circumference of the drum 62. In this way, an electrostatic latent image corresponding to the image information is formed on the outer circumference of the drum 62.

On the other hand, as illustrated in FIG. 3, in a developing unit 20 as a developing apparatus, toner T in a toner chamber 29 is stirred and conveyed by rotation of a conveying member (a stirring member) 43 and is delivered to a toner supply chamber 28.

The toner T is borne on the surface of a developing roller (a developing sleeve) 32 by the magnetic force of a magnet roller (a stationary magnet) 34. The developing roller 32 is a developer bearing member that bears a developer (toner T) on the surface thereof in order to develop the latent image formed on the drum 62.

The thickness of the toner T on a circumferential surface of a developing roller 32 as a developer bearing member is regulated while being triboelectrically charged by a developing blade 42.

The toner T is supplied to the drum 62 according to the electrostatic latent image to develop the latent image. In this way, the latent image becomes visible as a toner image (a developer image). The drum 62 is an image bearing member that bears the latent image or an image (a toner image or a developer image) formed by toner on the surface thereof. As illustrated in FIG. 2, a sheet material PA stored in a lower part of the apparatus body A is delivered from the sheet tray 4 with the aid of the pickup roller 5*a* and the feed roller pair 5*b* in synchronization with an output timing of the laser beam L. The sheet material PA passes through the transfer guide 6 and is conveyed to a transfer position between the drum 62 and the transfer roller 7. At this transfer position, the toner images are sequentially transferred from the drum 62 to the sheet material PA.

The sheet material PA to which the toner image is transferred is separated from the drum 62 and is conveyed to the fixing apparatus 9 along the conveying guide 8. The sheet material PA passes through a nip portion between the heating roller 9*a* and the pressure roller 9*b* that form the fixing apparatus 9. At this nip portion, a pressurizing and heating process is performed and the toner image is fixed to the sheet material PA. The sheet material PA to which the toner image is fixed is conveyed up to the discharge roller pair 10 and is discharged to the discharge tray 11.

On the other hand, as illustrated in FIG. 3, a residual toner on the outer circumference of the drum 62 after a transfer operation is performed is removed by the cleaning blade 77 and is used again for an image forming process. The toner removed from the drum 62 is stored in a waste toner chamber 71*b* of the cleaning unit 60. The cleaning unit 60 is a unit having the photosensitive drum 62.

The charging roller 66, the developing roller 32, the transfer roller 7, and the cleaning blade 77 are process means acting on the drum 62.

Entire Configuration of Cartridge

Figure 4:
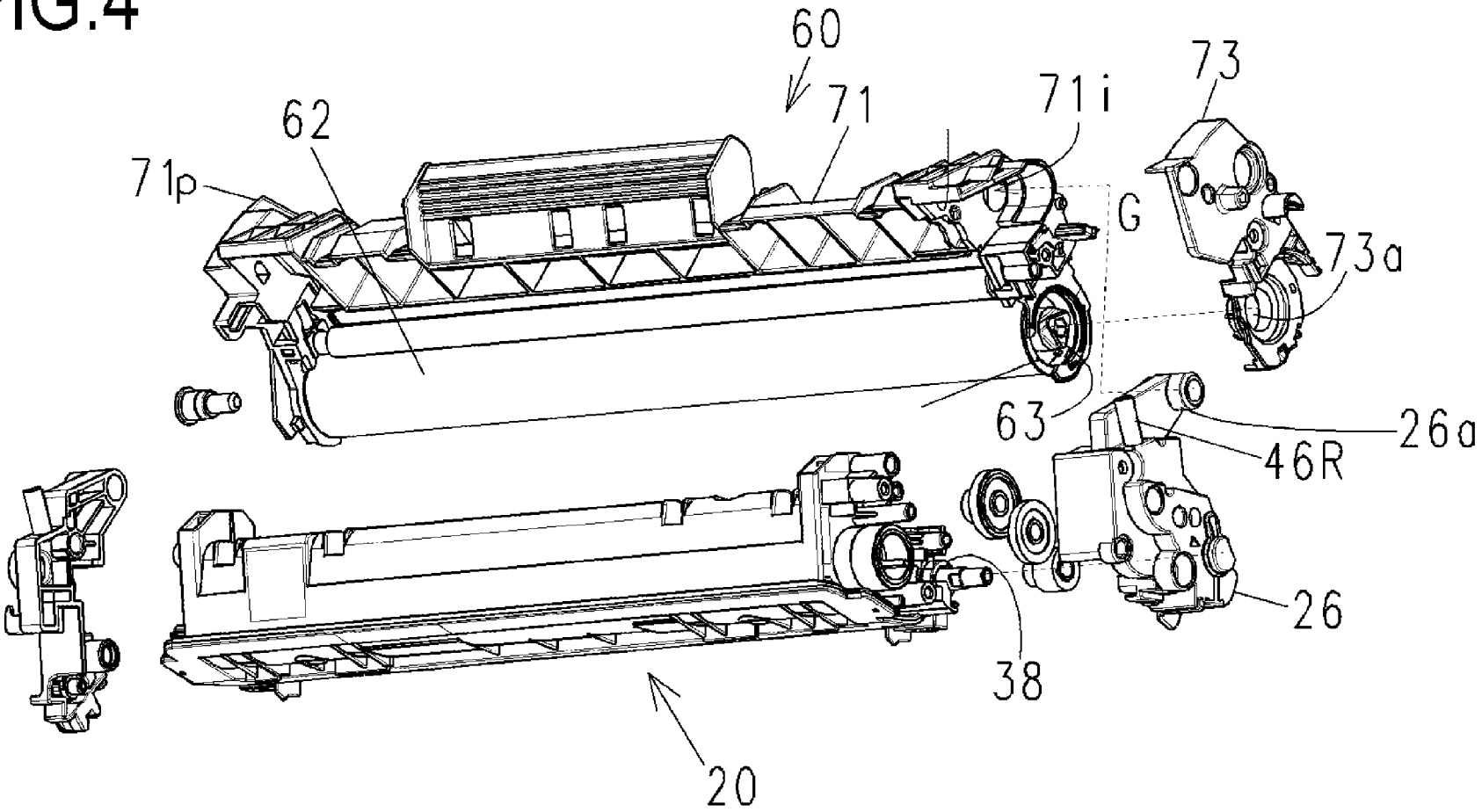
FIG. 4 is an exploded view of a cartridge according to Embodiment 1.
Figure 5:
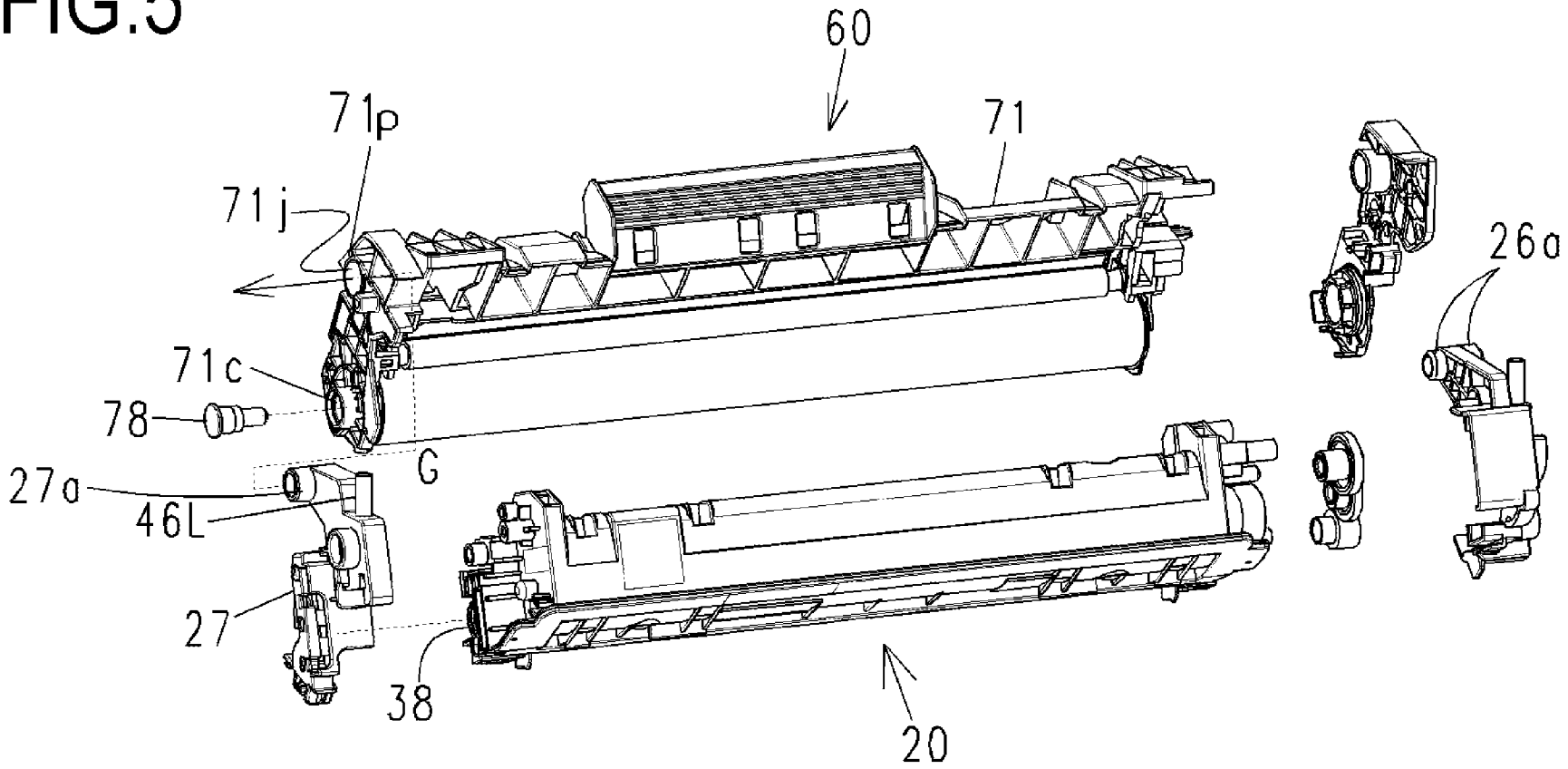
FIG. 5 is an exploded view of a cartridge according to Embodiment 1.

Next, an entire configuration of the cartridge B will be described with reference to FIGS. 3, 4, and 5. FIG. 3 is a schematic cross-sectional view of the cartridge B, and FIGS. 4 and 5 are exploded perspective views for describing the configuration of the cartridge B. In the present embodiment, description of screws used for combining respective components will be omitted.

The cartridge B includes a cleaning unit (a photosensitive member holding unit, a drum holding unit, an image bearing member holding unit, or a first unit) 60, a developing unit (a developer bearing member holding unit or a second unit) 20.

In general, a process cartridge is a member in which an electrophotographic photosensitive member and at least one of the process means acting on the photosensitive member are integrated as a cartridge so as to be detachably attachable to a body (an apparatus body) of an electrophotographic image forming apparatus. Examples of process means include charging means, developing means, and cleaning means.

As illustrated in FIG. 3, the cleaning unit 60 includes the drum 62, the charging roller 66, the cleaning member 77, and the cleaning frame body 71 supporting these members.

As illustrated in FIG. 4, on a driving side, the drum 62 is configured such that a driving-side drum flange 63 provided at a driving-side end of the drum 62 is rotatably supported by a hole 73*a* of a drum bearing 73. In a broad sense, the drum bearing 73 and the cleaning frame body 71 can be also collectively referred to as a cleaning frame body.

As illustrated in FIG. 5, on a non-driving side, the drum 62 is configured such that a drum shaft 78 press-fitted to a hole 71*c* formed in the cleaning frame body 71 is rotatably supported by a hole (not illustrated) of a non-driving-side drum shaft.

The drum flanges are bearing target portions that are rotatably supported by bearing portions.

In the cleaning unit 60, the charging roller 66 and the cleaning member 77 are disposed in contact with the outer circumference of the drum 62.

The cleaning member 77 includes a rubber blade 77*a* which is a blade-shaped elastic member formed from rubber as an elastic member and a supporting member 77*b* supporting the rubber blade. The rubber blade 77*a* abuts on the drum 62 in a counter direction in relation to a rotation direction of the drum 62. That is, the rubber blade 77*a* abuts on the drum 62 so that a distal end thereof faces the upstream side in the rotation direction of the drum 62.

As illustrated in FIG. 3, the waste toner removed from the surface of the drum 62 by the cleaning member 77 is stored in a waste toner chamber 71*b* formed by the cleaning frame body 71 and the cleaning member 77.

Moreover, as illustrated in FIG. 3, a scooping sheet 65 for preventing the waste toner from leaking from the cleaning frame body 71 is provided at an edge of the cleaning frame body 71 so as to abut on the drum 62.

The charging roller 66 is rotatably attached to the cleaning unit 60 with a charging roller bearing 67 at both ends in the longitudinal direction of the cleaning frame body 71.

The longitudinal direction (the longitudinal direction of the cartridge B) of the cleaning frame body 71 is approximately parallel to an extension direction (an axial direction) of a rotation axis of the drum 62. Therefore, hereinafter, a longitudinal direction or an axial direction means an axial direction of the drum 62 unless particularly stated.

The charging roller 66 is in pressure-contact with the drum 62 in such a way that a charging roller bearing 67 is pressed toward the drum 62 by a biasing member 68. The charging roller 66 rotates following rotation of the drum 62.

As illustrated in FIG. 3, the developing unit 20 includes the developing roller 32, a developing container 23 that supports the developing roller 32, the developing blade 42, and the like. The developing roller 32 is attached to the developing container 23 so as to be rotatably by bearing members 26 (FIG. 4) and 27 (FIG. 5) provided at both ends of the developing roller 32.

Moreover, a magnet roller 34 is provided in the developing roller 32. A developing blade 42 for regulating the toner layer on the developing roller 32 is disposed in the developing unit 20. As illustrated in FIGS. 4 and 5, an interval holding member 38 is attached to both ends of the developing roller 32, and the interval holding member 38 and the drum 62 abut on each other whereby the developing roller 32 is held with a very small gap formed between the drum 62 and the developing roller 32.

Moreover, as illustrated in FIG. 3, a blowoff prevention sheet 33 for preventing toner from leaking from the developing unit 20 is provided at an edge of a bottom member 22 so as to abut on the developing roller 32. Furthermore, the conveying member 43 is provided in the toner chamber 29 formed by the developing container 23 and the bottom member 22. The conveying member 43 stirs the toner stored in the toner chamber 29 and conveys the toner toward the toner supply chamber 28.

As illustrated in FIGS. 4 and 5, the cartridge B is formed by combining the cleaning unit 60 and the developing unit 20.

When the developing unit and the cleaning unit are combined, first, the center of a first developing supporting boss 26*a* of the bearing member 26 with respect to a first driving-side suspension hole 71*i* of the cleaning frame body 71 is aligned to match the center of a second developing supporting boss 27*a* of the bearing member 27 with respect to a second non-driving-side suspension hole 71*j*. Specifically, the developing unit 20 is moved in a direction indicated by arrow G so that the first developing supporting boss 26*a* and the second developing supporting boss 27*a* are fitted to the first suspension hole 71*i* and the second suspension hole 71*j*, respectively. In this way, the developing unit 20 is connected so as to be movable in relation to the cleaning unit 60. More specifically, the developing unit 20 is rotatably (turnably) connected to the cleaning unit 60. That is, the developing roller 32 is connected so as to move toward and away from the drum 62. After that, the drum bearing 73 is assembled with the cleaning unit 60 to form the cartridge B.

In the present embodiment, a non-driving-side biasing member 46L (FIG. 5) and a non-driving-side biasing member 46R (FIG. 4) are formed of a compression spring. By the biasing force of these springs, the driving-side biasing member 46L and the non-driving-side biasing member 46R biases the developing unit 20 toward the cleaning unit 60 whereby the developing roller 32 is reliably pressed toward the drum 62. Furthermore, the interval holding member 38 is attached to both ends of the developing roller 32. That is, the drum 62 and the developing roller 32 come into contact with each other with a predetermined contact pressure with the interval holding member 38 disposed therebetween whereby the developing roller 32 is held at a predetermined interval from the drum 62 and the relative positions thereof are determined.

Here, in order for the electrostatic latent image on the drum 62 to be stably developed with the toner T borne on the circumferential surface of the developing roller 32, it is desirable that the interval between the drum 62 and the developing roller 32 is maintained constantly with high accuracy. In other words, it is required that a contact pressure when the drum 62 and the developing roller 32 come into contact with each other with the interval holding member 38 disposed therebetween is maintained stably.

Attachment of Cartridge

Figure 6B:
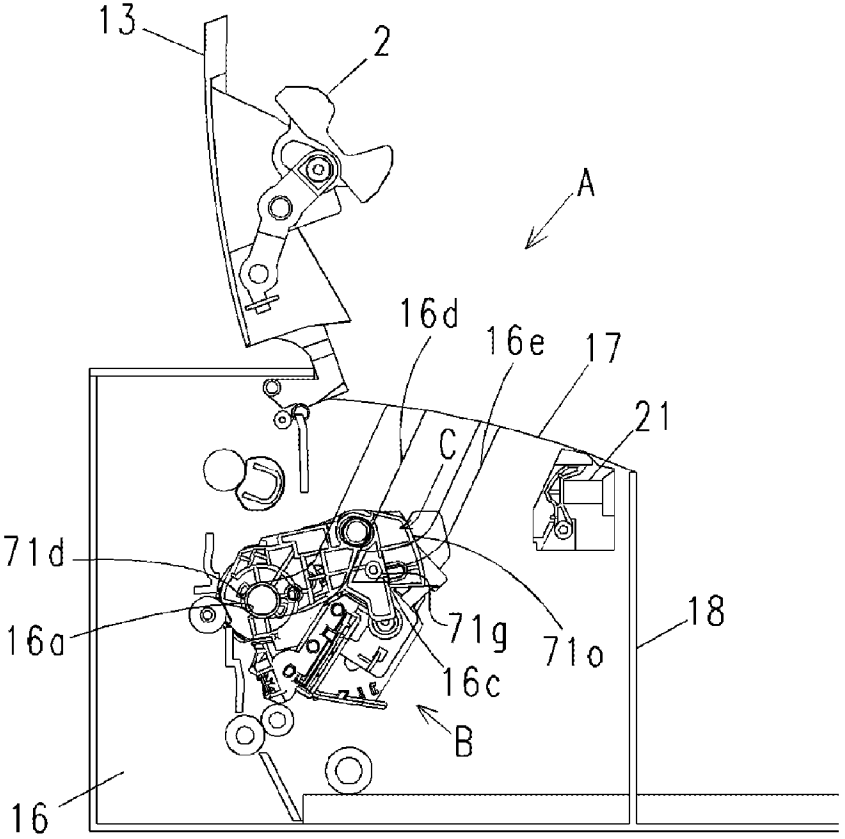
FIGS. 6A and 6B are schematic cross-sectional views of an image forming apparatus according to Embodiment 1.
Figure 6A:
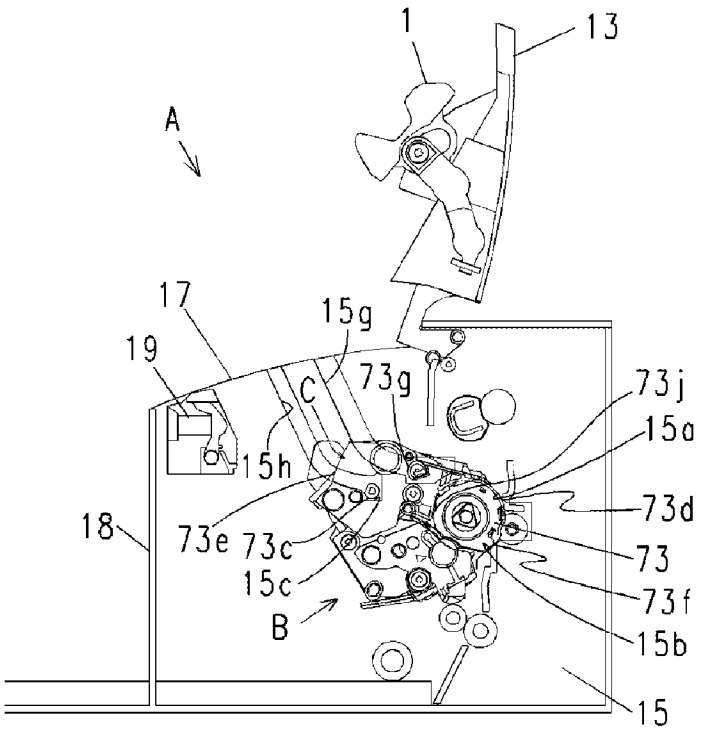
Figure 7B:
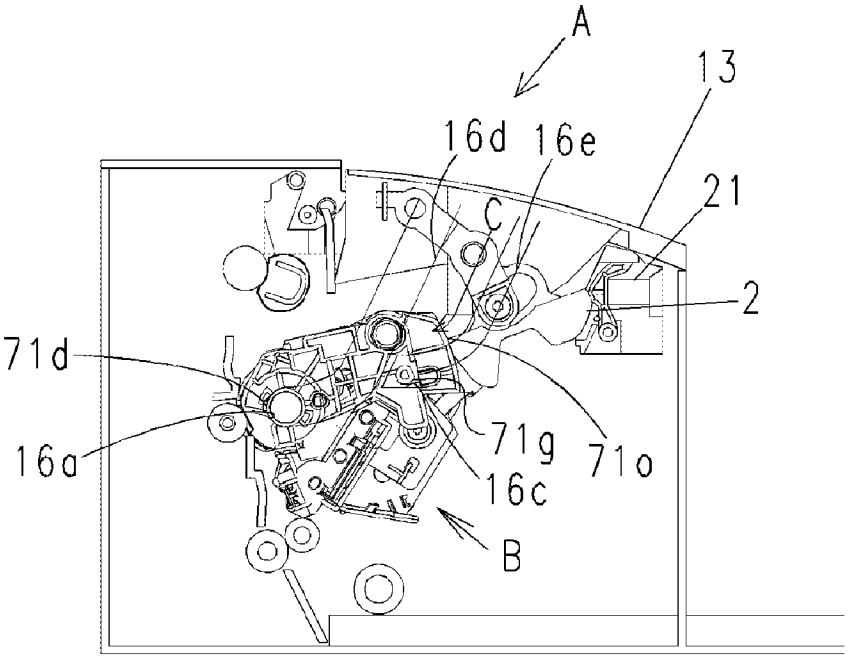
FIGS. 7A and 7B are schematic cross-sectional views of an image forming apparatus according to Embodiment 1.
Figure 7A:
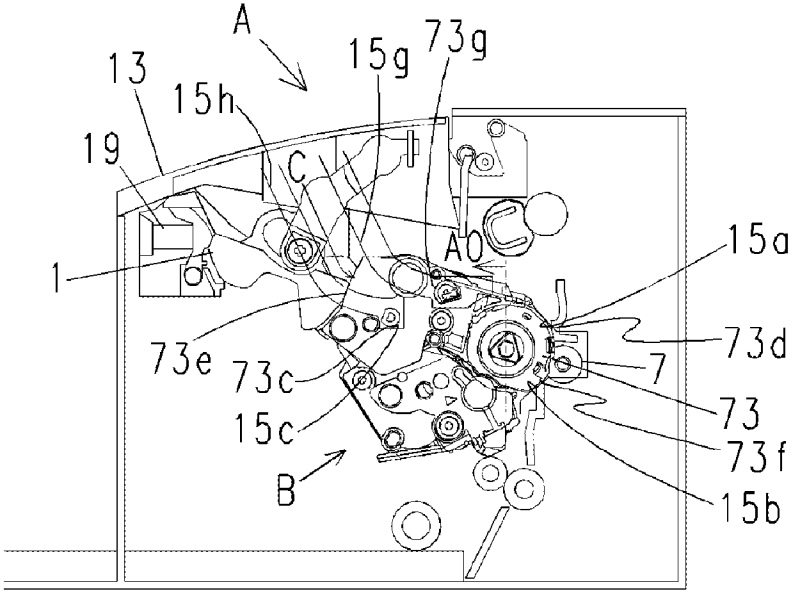
Figure 8A:
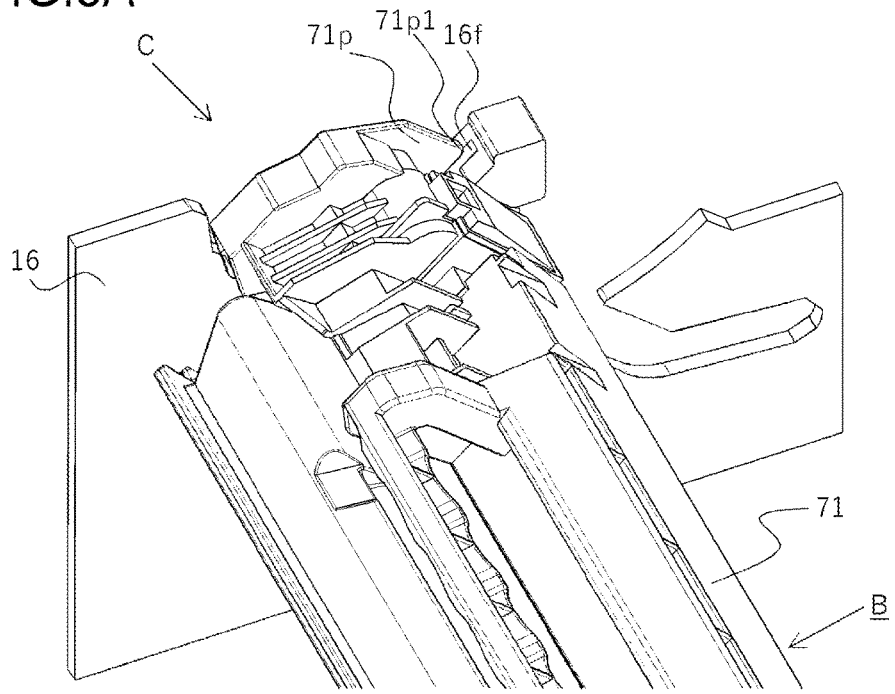
FIGS. 8A to 8C are diagrams illustrating how a cartridge is attached to an image forming apparatus according to Embodiment 1.
Figure 8B:
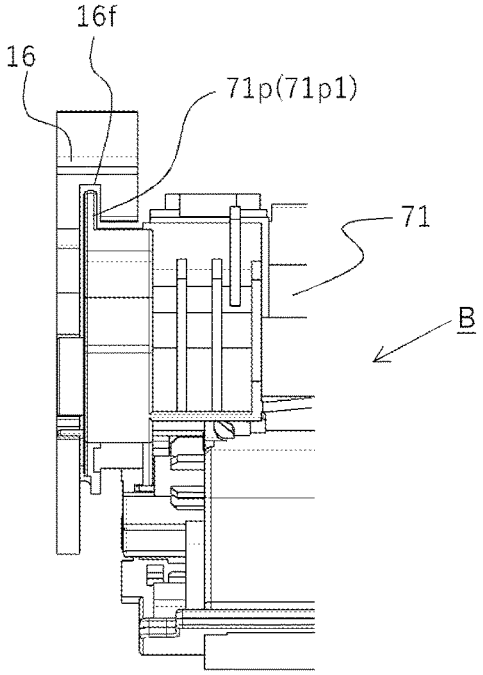

Subsequently, attachment of the cartridge B will be described in detail with reference to FIGS. 6A, 6B, 7A, 7B, 8A, and 8B. FIG. 6A is a schematic cross-sectional view of a driving-side guide portion of the image forming apparatus A for describing attachment of the cartridge B, and FIG. 6B is a schematic cross-sectional view of a non-driving-side guide portion of the image forming apparatus A for describing attachment of the cartridge B. FIG. 7A is a schematic cross-sectional view on the driving side of the image forming apparatus A for describing positioning of the cartridge B. FIG. 7B is a schematic cross-sectional view on the non-driving side of the image forming apparatus A for describing positioning of the cartridge B. FIG. 8A is a schematic cross-sectional view of the driving-side guide portion of the image forming apparatus A for describing attachment of the cartridge B, and FIG. 8B is a schematic cross-sectional view of the non-driving-side guide portion of the image forming apparatus A for describing attachment of the cartridge B.

Attachment of the cartridge B will be described. As illustrated in FIGS. 6A and 6B, a first driving-side plate 15 has an upper guide rail 15*g* and a guide rail 15*h* as a guide, and a driving-side plate 16 has a guide rail 16*d* and a guide rail 16*e*. Moreover, a drum bearing 73 provided on the driving side of the cartridge B has a rotation-stopping target portion 73*c*.

An attachment direction of the cartridge B is a direction (see arrow C) substantially orthogonal to an axial line of the drum 62.

Moreover, the cleaning frame body 71 has a positioning target portion 71*d* and a rotation-stopping target portion 71*g* on the non-driving side in the longitudinal direction. When the cartridge B is attached from a cartridge insertion opening 17 of the apparatus body A, a boss 73*g* and a rotation-stopping target portion 73*c* of the cartridge B are guided to an upper guide rail 15*g* and a guide rail 15*h* of the apparatus body A on the driving side of the cartridge B. On the non-driving side of the cartridge B, a positioning target portion 71*d* and a rotation-stopping target portion 71*g* of the cartridge B are guided to a guide rail 16*d* and a guide rail 16*e* of the apparatus body A, respectively. In this way, the cartridge B is attached to the apparatus body A.

Next, a state in which a door 13 is closed will be described. As illustrated in FIGS. 6A, 6B, 7A, and 7B, the first driving-side plate 15 has an upper positioning portion 15*a*, a lower positioning portion 15*b*, an upper rotation-stopping portion 15*c*1, and a lower rotation-stopping portion 15*c*2 as a positioning portion. Moreover, the non-driving-side plate 16 has a positioning portion 16*a*, an upper rotation-stopping portion 16*c*1, and a lower rotation-stopping portion 16*c*2. The drum bearing 73 has an upper positioning target portion (a first positioning target portion, a first projection, or a first bulging portion) 73*d* and a lower positioning target portion (a second positioning target portion, a second projection, or a second bulging portion) 73*f*

Moreover, cartridge pressing members 1 and 2 are rotatably attached to both ends in the axial direction of the door 13. Cartridge pressing springs 19 and 21 are attached to both ends in the longitudinal direction of a front plate provided in the image forming apparatus A. The drum bearing 73 has a pressing target portion 73*e* as a biasing force receiving portion, and the cleaning frame body 71 has a pressing target portion 71*o* on the non-driving side (see FIGS. 3 and 6A to 7B). When the door 13 is closed, the pressing target portions 73*e* and 71*o* of the cartridge B are pressed by the cartridge pressing members 1 and 2 biased by the cartridge pressing springs 19 and 21 of the apparatus body A (see FIGS. 7A and 7B).

In this way, on the driving side, the upper positioning target portion 73*d*, the lower positioning target portion 73*f*, and the rotation-stopping target portion 73*c* of the cartridge B abut on the upper positioning portion 15*a*, the lower positioning portion 15*b*, and the rotation-stopping portion 15*c* of the apparatus body A, respectively. As a result, the cartridge B and the drum 62 are positioned on the driving side. Moreover, on the non-driving side, the positioning target portion 71*d* and the rotation-stopping target portion 71*g* of the cartridge B abut on the positioning portion 16*a* and the rotation-stopping portion 16*c* of the apparatus body A, respectively. In this way, the cartridge B and the drum 62 are positioned on the non-driving side.

While the above-described configuration has been described as an example of a configuration that determines the position of the cartridge B in relation to the apparatus body A, the configuration of the positioning means is not limited thereto. The positioning means may act directly on the upper positioning target portion 73*d* and the lower positioning target portion 73*f* on the driving side of the cartridge B and the positioning target portion 71*d* and the rotation-stopping target portion 71*g* on the non-driving side to fix the respective positioning portions.

Attachment Error Prevention Mechanism of Cartridge

A cartridge attachment error prevention mechanism (an attachment error prevention system) will be described by way of examples of the cartridge B as a first cartridge (an allowed or authorized cartridge) that is allowed or authorized to be attached to the apparatus body A and cartridges E1 and E2 as a second cartridge (an unallowed or unauthorized cartridge) that is not allowed or not authorized to be attached to the apparatus body A.

Case of Cartridge B

An operation of an attachment error prevention mechanism for the cartridge B will be described with reference to FIGS. 1A to 1E and 8A to 8C.

FIGS. 1A to 1E are lateral cross-sectional views illustrating a process of attaching the cartridge B to the apparatus body A. For the sake of convenience, only the non-driving-side plate 16 and the cleaning unit 60 are illustrated. Moreover, although only the cleaning unit 60 and a lever 16*g* are hatched in FIG. 1A so that the shapes of components are identified, the cleaning unit 60 and the lever 16*g* are not hatched in FIGS. 1B to 1E for the sake of convenience.

Figure 8C:
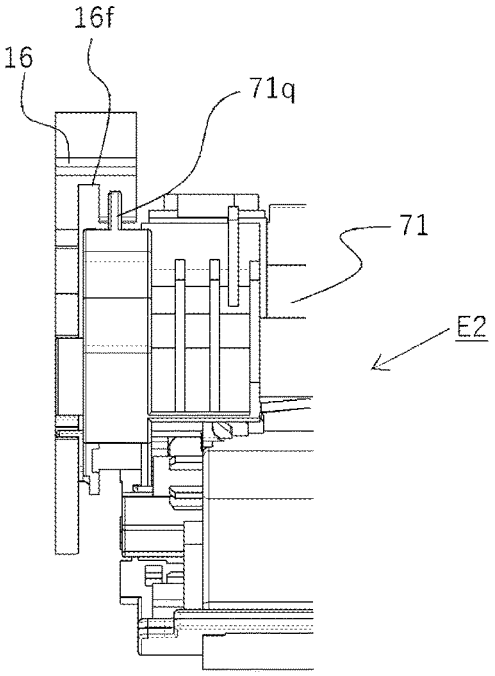

FIG. 8A is a perspective view illustrating a state in which the cartridge B is attached to the apparatus body A, and FIGS. 8B and 8C are detailed partial views illustrating a state in which the cartridge B is attached to the apparatus body A. In this example, for the sake of convenience, only the non-driving-side plate 16 is illustrated for the apparatus body A.

As illustrated in FIGS. 8A and 8B, a rib 71*p* extending in a direction orthogonal to the longitudinal direction is provided at a non-driving-side end of the cleaning frame body 71. A first engagement portion 71*p*1 is provided on the downstream side in a cartridge insertion direction (a direction indicated by arrow C) of the rib 71*p*.

Moreover, a guide rail 16*f* as a first guide portion is provided in the non-driving-side plate 16. The guide rail 16*f* does not interfere with the rib 71*p* in the course of insertion of the cartridge B. However, as illustrated in FIG. 8C, when a cartridge E2 (a first unallowed cartridge) having a rib 71*q* (as an unallowed or unauthorized engagement portion) at a different position in the longitudinal direction from the rib 71*p* of the cartridge B is inserted, the rib 71*q* cannot pass through the guide rail 16*f*. That is, the guide rail 16*f* regulates insertion (arrival at an attachment completion position) of the cartridge E2.

That is, the guide rail 16*f* has an inlet shape corresponding to an outer shape of the rib 71*p* (a first engagement portion 71*p*1) when seen in a direction of attaching the cartridge to the apparatus body A, and a regulating wall abutting on the rib 1*q* is formed around the inlet. The guide rail 16*f* and the surrounding structure thereof form a first guide portion of the present invention. The first guide portion and the engagement portion (the rib 71*p* and the rib 71*q*) provided in the cartridge B and E2 form a first identifying portion for identifying whether a cartridge to be attached to the apparatus body A is allowed one or not.

As illustrated in FIG. 1A, a lever 16*g* as a movable member is provided in the non-driving-side plate 16. The lever 16*g* is configured to be able to swing about a shaft center H. The lever 16*g* is biased in a direction indicated by arrow N1 by the biasing force applied from a biasing member (not illustrated), and a regulating target surface 16*g*1 of the lever 16*g* comes into contact with a regulating surface 16*b* provided in the non-driving-side plate 16 whereby the position of the lever 16*g* is determined. In this case, a state in which the lever 16*g* blocks a guiding path of the positioning target portion 71*d* of the guide rail 16*d* (a second guide portion) is created (this is a first position or a regulation position). In this way, an engagement target portion 16*g*2 provided in the lever 16*g* is configured to regulate a positioning target portion 71*d*2 of the cartridge E1 from advancing through the guide rail 16*d* in an attachment direction (a direction indicated by arrow C) as will be described later. As will be described in detail later, a movable member (the engagement target portion 16*g*2 of the lever 16*g*) at a regulation position and the positioning target portions 71*d* and 71*d*2 of a cartridge form a second identifying portion for identifying whether the cartridge that is to be attached to the apparatus body A is allowed one or not.

Figure 1B:
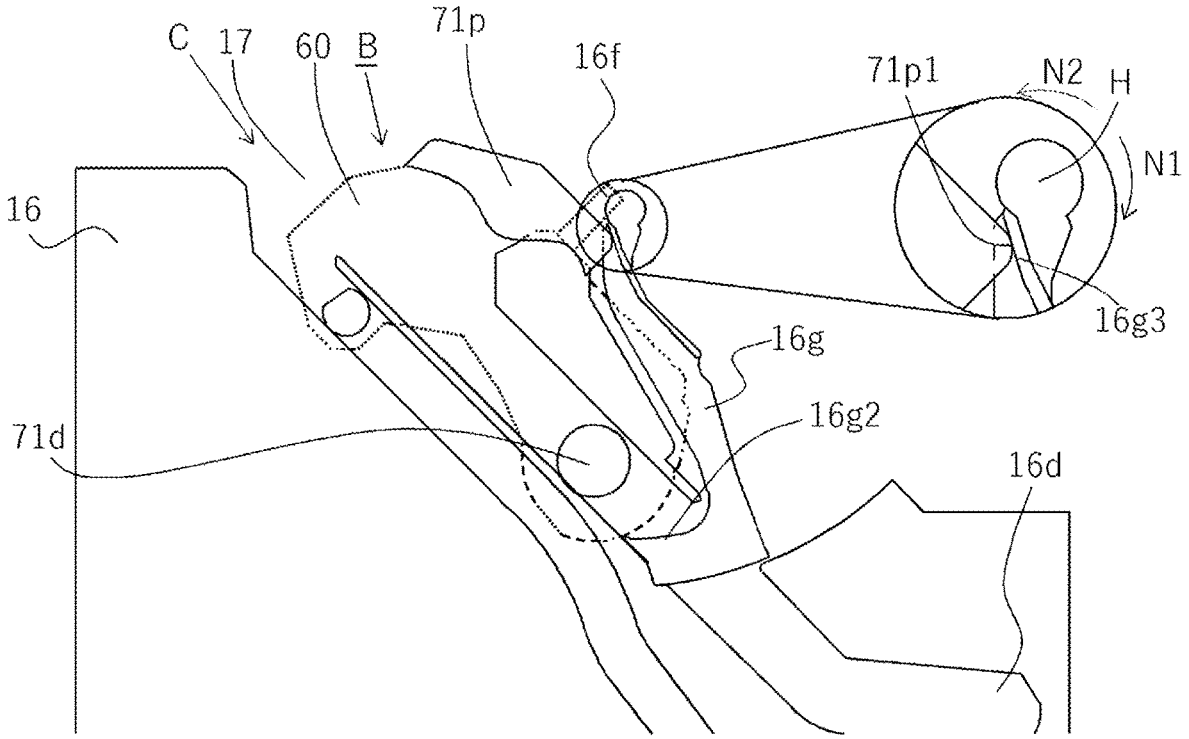
FIG. 1B is a diagram for describing an operation of an attachment error prevention mechanism during insertion of a cartridge according to Embodiment 1.

As illustrated in FIG. 1B, a surface 16*g*3 as an engagement target portion with which the first engagement portion 71*p*1 engages is provided in the lever 16*g*. The engagement target portion 16*g*2 and the surface 16*g*3 are provided closer to the downstream side in the cartridge insertion direction than the guide rail 16*f*.

When insertion of the cartridge B in the direction indicated by arrow C progresses, the first engagement portion 71*p*1 comes into contact with the surface 16*g*3 after passing through the guide rail 16*f*. In this case, the positioning target portion 71*d* is closer to the upstream side in the insertion direction (the direction indicated by arrow C) than the engagement target portion 16*g*2 of the lever 16*g*.

Figure 1C:
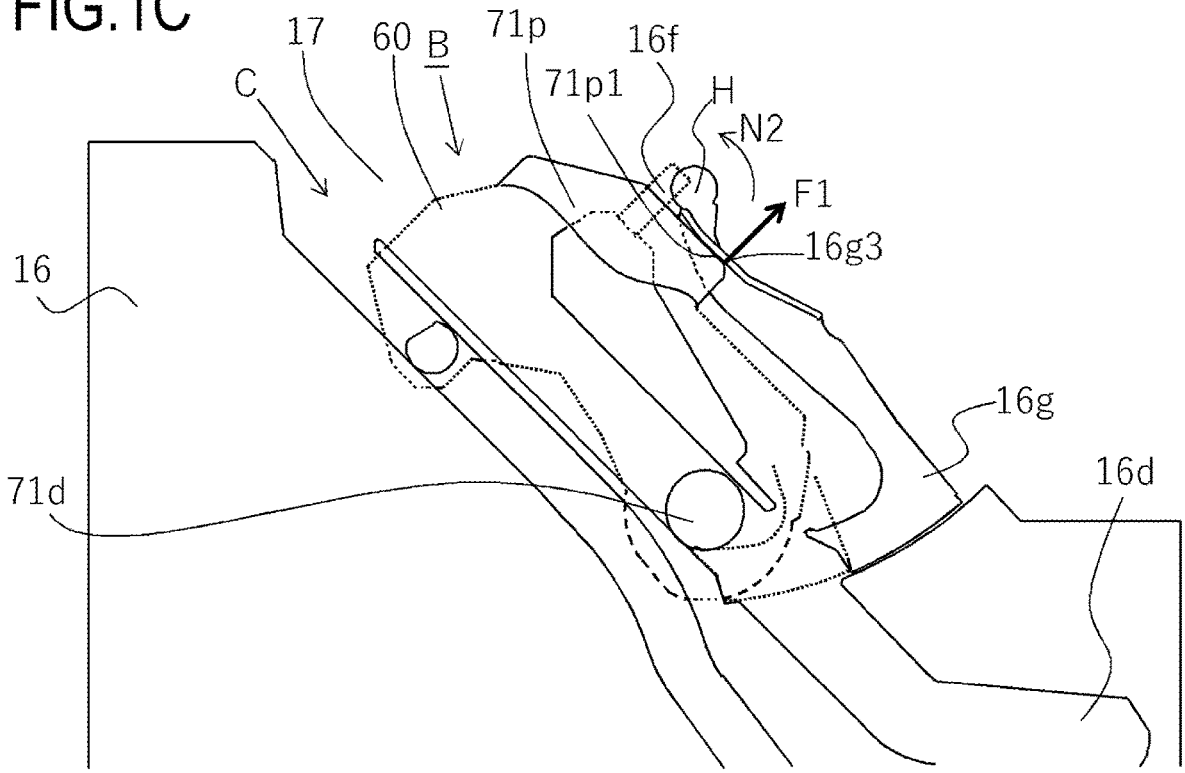
FIG. 1C is a diagram for describing an operation of an attachment error prevention mechanism during insertion of a cartridge according to Embodiment 1.

As illustrated in FIG. 1C, when insertion of the cartridge B in the direction indicated by arrow C progresses, the engagement target portion 16*g*3 receives force F1 from the first engagement portion 71*p*1 provided in the cartridge B by the insertion force of the cartridge B. In this way, the lever 16*g* moves in a direction indicated by arrow N2 about the shaft center H while resisting the biasing force from a biasing member (not illustrated). In this way, a state in which the lever 16*g* is completely released without blocking the guiding path of the positioning target portion 71*d* of the guide rail 16*d* is created (this is a second position or a non-regulation position). That is, a state in which the positioning target portion 71*d* of the cartridge B is allowed to proceed toward the guide rail 16*d*. In this case, the positioning target portion 71*d* is disposed closer to the upstream side in the insertion direction (the direction indicated by arrow C) than a place where the lever 16*g* was at the first position.

Figure 1D:
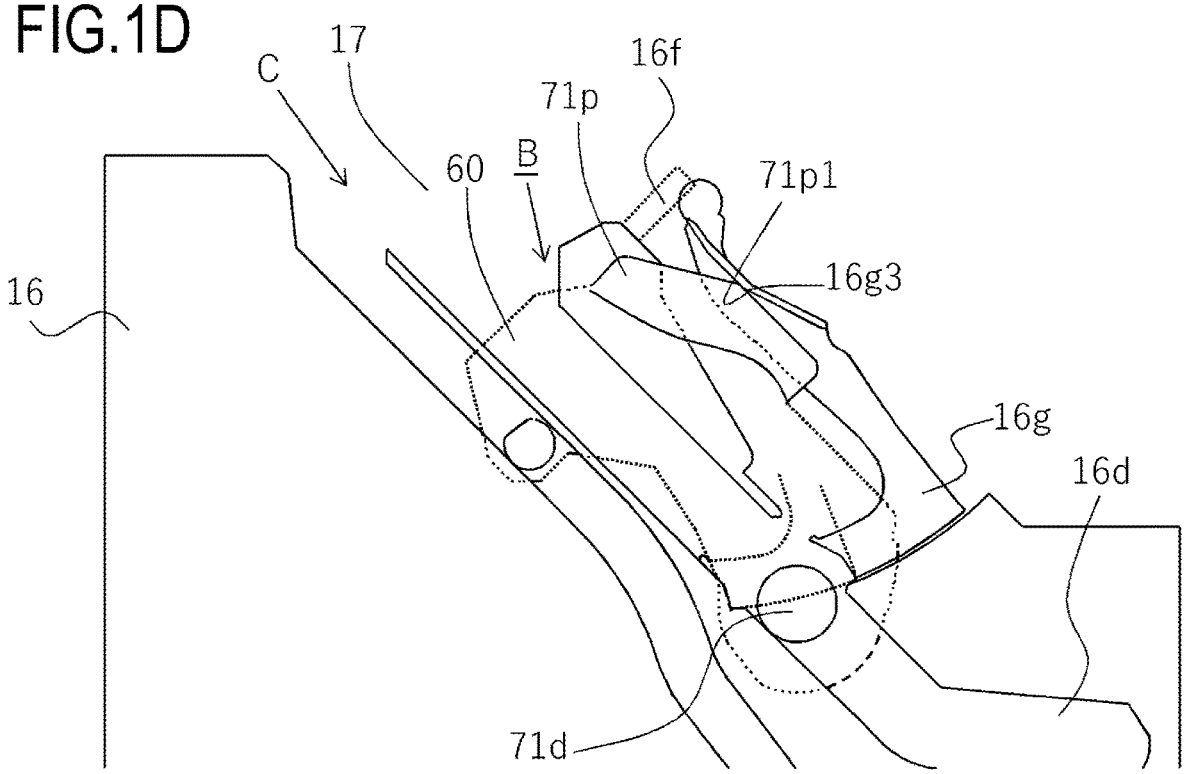
FIG. 1D is a diagram for describing an operation of an attachment error prevention mechanism during insertion of a cartridge according to Embodiment 1.

As illustrated in FIG. 1D, after insertion of the cartridge B progresses and the positioning target portion 71*d* passes through a place where the lever 16*g* is at the first position, the rib 71*p* having the first engagement portion 71*p*1 and the engagement target portion 16*g*3 maintain a contact state.

Figure 1E:
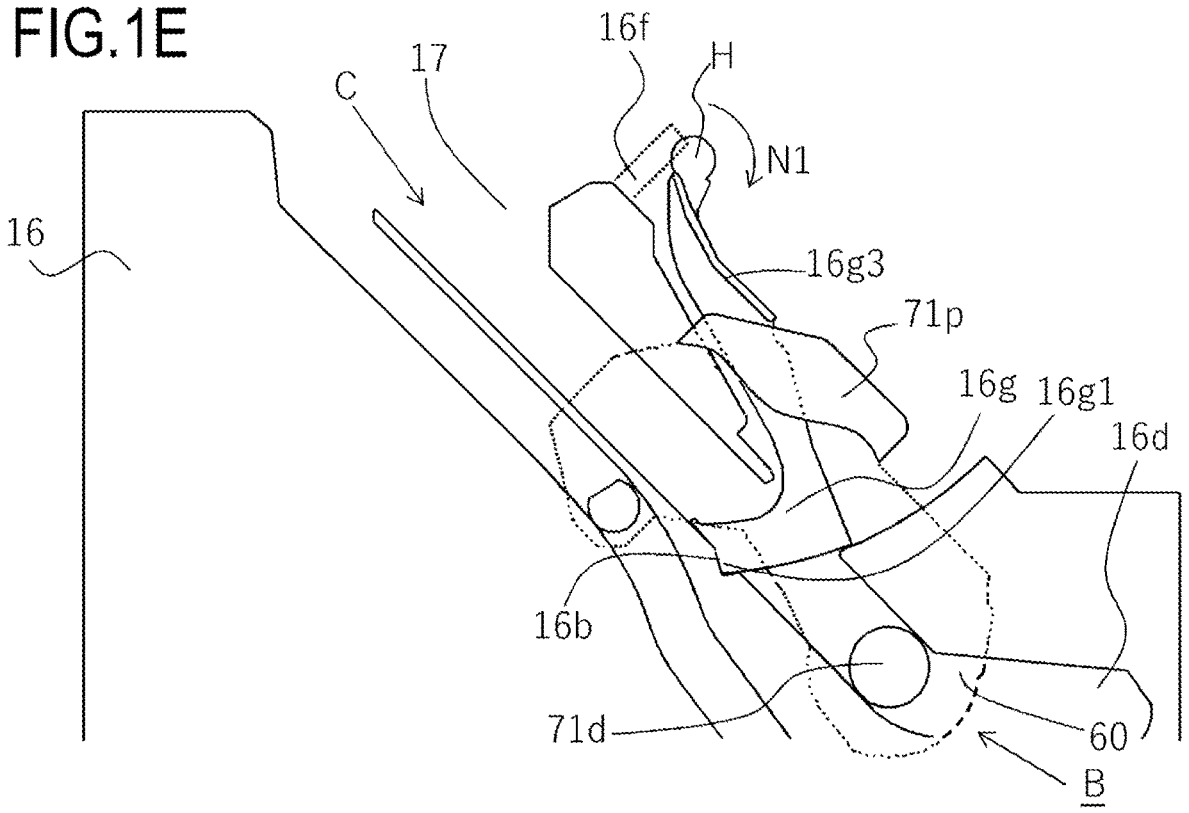
FIG. 1E is a diagram for describing an operation of an attachment error prevention mechanism during insertion of a cartridge according to Embodiment 1.

As illustrated in FIG. 1E, when insertion of the cartridge B progresses, the contact state between the rib 71*p* and the engagement target portion 16*g*3 disappears. In this way, the lever 16*g* receives force in a direction indicated by arrow N1 by the biasing force from a biasing member (not illustrated) to move up to the first position.

As described above, the lever 16*g* moves between the first position (the regulation position) and the second position (the non-regulation position) without making contact with the positioning target portion 71*d* in the course of inserting the cartridge B.

Case of Cartridge E1

Figure 9:
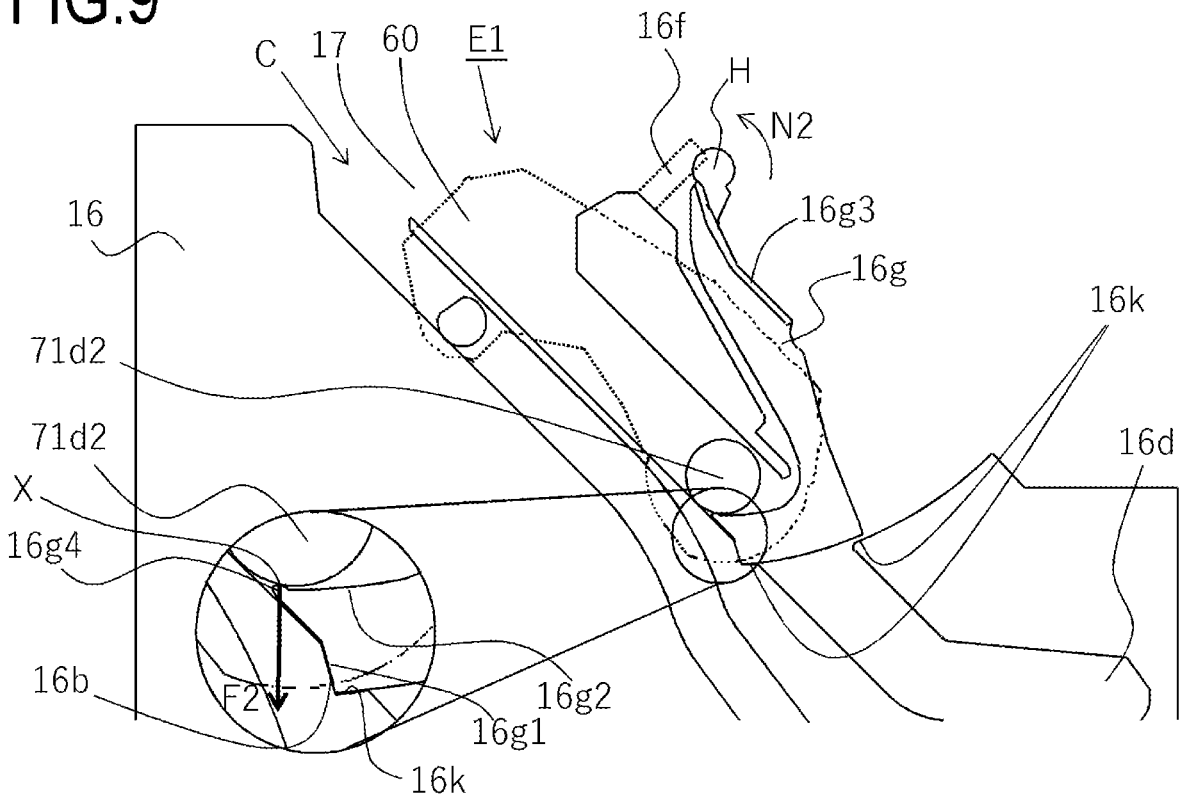
FIG. 9 is a diagram for describing an operation of an attachment error prevention mechanism during insertion of a cartridge according to Embodiment 1.

An operation of the attachment error prevention mechanism for the cartridge E1 (the second unallowed cartridge) will be with reference to FIG. 9.

FIG. 9 is a lateral cross-sectional view illustrating a state in which the cartridge E1 is inserted into the apparatus body A. Similarly to FIGS. 1A to 1E, only the non-driving-side plate 16 and the cleaning unit 60 are illustrated in FIG. 9.

A difference between the cartridge E1 and the cartridge B is that the cartridge E1 does not have a shape corresponding to the first engagement portion 71*p*1. Due to this, when the cartridge E1 is inserted into the image forming apparatus, the cartridge E1 can proceed in the direction indicated by arrow C without interfering with the guide rail 16*f*. However, the cartridge E1 does not have a shape corresponding to the first engagement portion 71*p*1. Due to this, even when insertion of the cartridge E1 progresses, the cartridge E1 does not come into contact with the surface 16*g*3 of the lever 16*g* and a force that moves the lever 16*g* up to the second position (the non-regulation position) is not applied. Therefore, the lever 16*g* remains blocking the guide rail 16*d* (this is, the second position). Due to this, when insertion of the cartridge E1 progresses, the positioning target portion 71*d*2 of the cartridge E1 as the second identifying portion comes into contact with the projection 16*g*4 provided in the engagement target portion 16*g*2 of the lever 16*g*. In this case, a force F2 from the positioning target portion 71*d*2 is applied to the projection 16*g*4 by the attachment force of the cartridge E1.

The projection 16*g*4 is configured to abut on the positioning target portion 71*d*2 so that a force acting in a direction of resisting the biasing force acting on the lever 16*g* is not generated from the force F2 received from the positioning target portion 71*d*2 of the cartridge E1 (so that the force F2 does not include such a component force). At least the force F2 that the projection 16*g*4 receives from the positioning target portion 71*d*2 may act in the direction orthogonal to the movable direction of the engagement target portion 16*g*2 of the lever 16*g*. Preferably, the projection 16*g*4 may be pressed from the positioning target portion 71*d*2 at such an angle that a force acting in a direction (a direction opposite to the direction toward the non-regulation position) along the turning direction of the lever 16*g* due to the biasing force is generated.

Here, a regulating surface 16*k* as a supporting portion that supports the lever 16*g* is provided in the non-driving-side plate 16 on a side (the downstream side in the insertion direction (the direction indicated by arrow C)) of the lever 16*g* opposite the engagement target portion 16*g*2 pressed from the positioning target portion 71*d*2. In this way, for example, even when the cartridge E1 is forcibly inserted, the lever 16*g* receives the force F2 from the positioning target portion 71*d*, and the lever 16*g* is deformed, deformation of the lever 16*g* in the direction of the force F2 can be regulated by the regulating surface 16*k*. Due to this, it is possible to prevent deformation and destruction of the lever 16*g* and to regulate insertion (arrival at an attachment completion position) of an unallowed cartridge reliably.

In the present embodiment, although the positioning target portions 71*d* and 71*d*2 on the non-driving side of the cartridge are used as the second identifying portion in order to save the space, the present invention is not limited to the configuration, but another configuration portion may be used and another configuration dedicated for the identifying portion may be provided.

Removal of Cartridge

Figure 10:
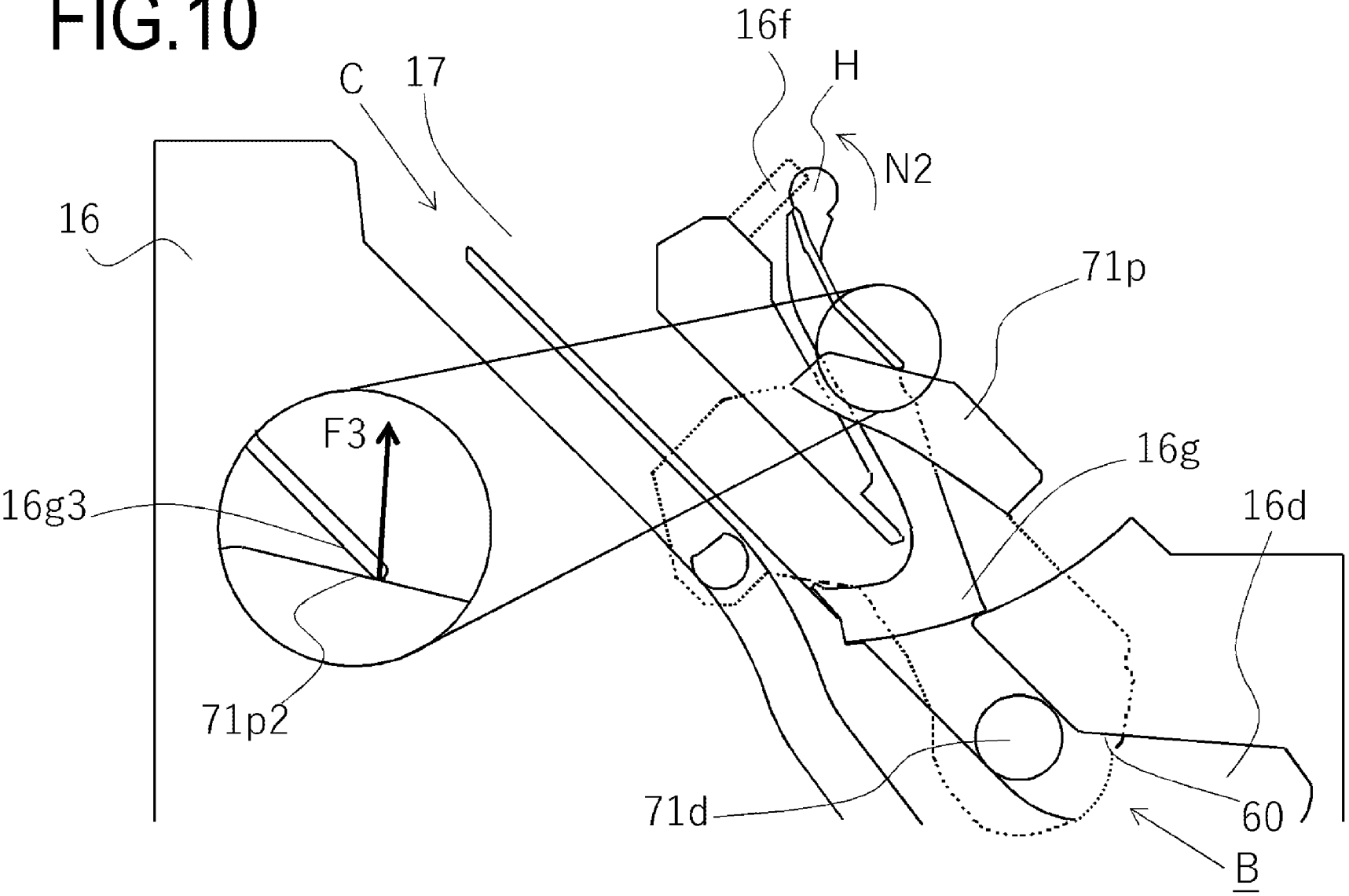
FIG. 10 is a diagram for describing an operation of an attachment error prevention mechanism during insertion of a cartridge according to Embodiment 1.

Next, an operation of removing the cartridge B will be described with reference to FIG. 10.

As described above, when the cartridge B is in an attachment completion state, the lever 16*g* is at the first position.

A second engagement portion 71*p*2 is provided on the upstream side in the insertion direction (the direction indicated by arrow C) of the rib 71*p* of the cartridge B. When the cartridge B is moved in a direction opposite to the direction indicated by arrow C, the second engagement portion 71*p*2 comes into contact with the surface 16*g*3 before the positioning target portion 71*d* comes into contact with the lever 16*g*. A force F3 is applied to the lever 16*g* with the second engagement portion 71*p*2 disposed therebetween by a removal force of the cartridge B. In this way, the lever 16*g* rotates about the shaft center H in the direction N2 and moves from the first position to the second position. A subsequent removal opening is reverse to the above-described attachment operation of the cartridge B, and the description thereof will be omitted.

As described above, according to the present embodiment, it is possible to determine whether a cartridge is allowed to be attached to an image forming apparatus reliably with a simple configuration without any adverse influence on an attachment/detachment operation of an allowed cartridge.

Embodiment 2

A cartridge and an image forming apparatus according to Embodiment 2 of the present invention will be described with reference to the drawings.

In the following description, the components of Embodiment 2 the same as those of Embodiment 1 will be denoted by the same reference numerals. Moreover, it is assumed that a longitudinal direction Y as a first direction matches a rotation axis direction of a photosensitive drum which is an image bearing member. Moreover, in the longitudinal direction Y, a side to which a driving force is transmitted from an apparatus body of the image forming apparatus to the photosensitive drum will be referred to as a driving side, and the opposite side will be referred to as a non-driving side.

Overall Configuration of Image Forming Apparatus

Figure 12:
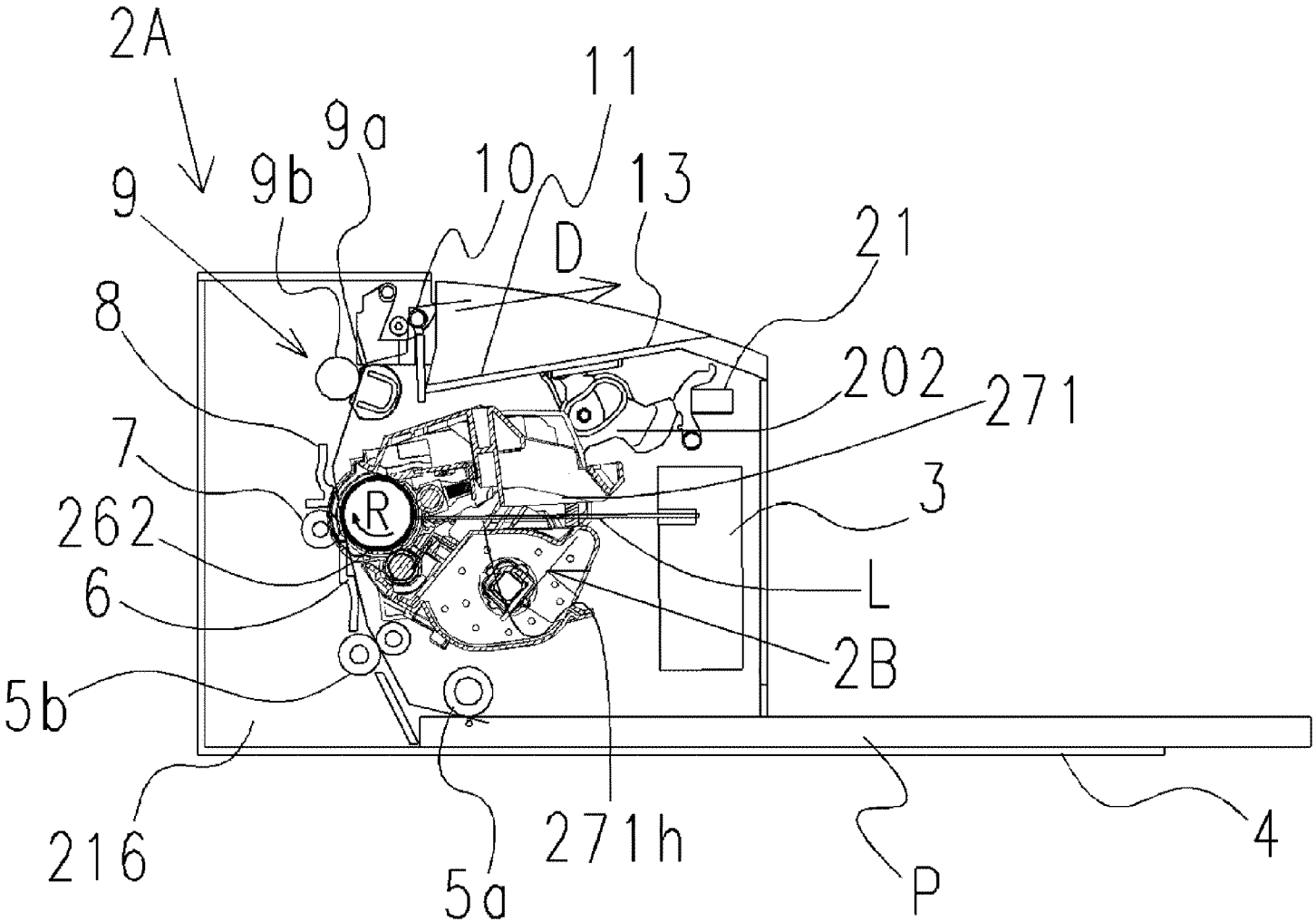
FIG. 12 is a schematic cross-sectional view of an image forming apparatus according to Embodiment 2.
Figure 13:
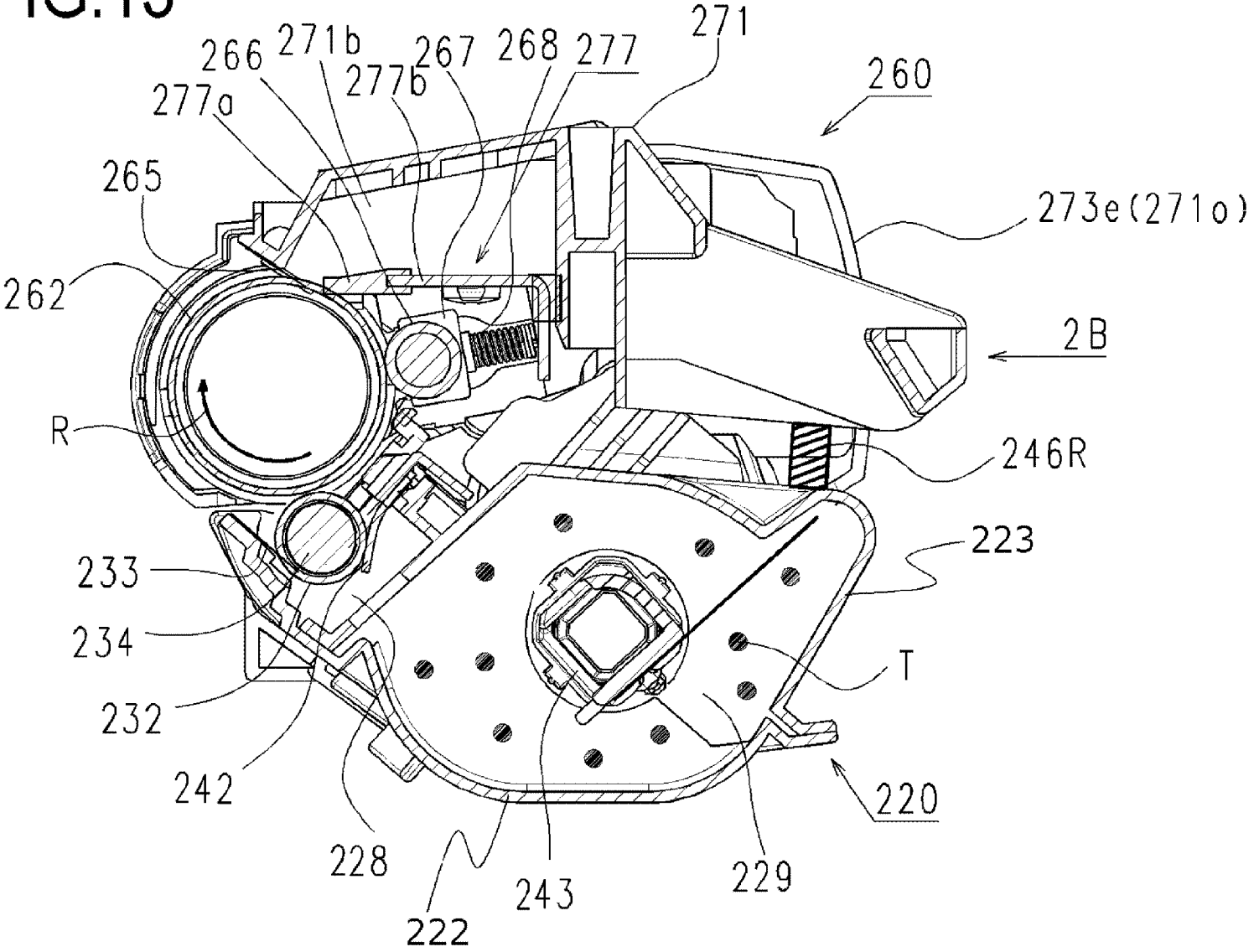
FIG. 13 is a schematic cross-sectional view of a cartridge according to Embodiment 2.

FIG. 12 is a cross-sectional view of an image forming apparatus body 2A (hereinafter referred to as an "apparatus body 2A") of an electrophotographic image forming apparatus (hereinafter referred to as an image forming apparatus) according to Embodiment 2 of the present invention and a cartridge 2B as a first cartridge. FIG. 13 is a cross-sectional view of the cartridge 2B.

Here, the apparatus body 2A is a portion of a configuration of the image forming apparatus excluding the cartridge 2B.

The image forming apparatus illustrated in FIG. 12 is a laser beam printer which uses an electrophotographic technology and in which the cartridge 2B can be detachably attachable to the apparatus body 2A.

A sheet tray 4 that stacks a recording medium (a recording material) (hereinafter referred to as a "sheet P") serving as an image forming target is disposed under the cartridge 2B.

Furthermore, a pickup roller 5*a*, a feed roller pair 5*b*, a transfer guide 6, a transfer roller 7, a conveying guide 8, a fixing apparatus 9, a discharge roller pair 10, a discharge tray 11, and the like are disposed in the apparatus body 2A sequentially along a conveying direction D of the sheet P. The fixing apparatus 9 includes a heating roller 9*a* and a pressure roller 9*b*.

Image Forming Process

Next, an overview of an image forming process will be described. An electrophotographic photosensitive drum (hereinafter referred to as a photosensitive drum 262 or simply as a drum 262) is rotated on the basis of a print start signal at a predetermined peripheral velocity (a process speed) in a direction indicated by arrow R in FIGS. 12 and 13.

A charging roller (a charging member) 266 to which a bias voltage is applied comes into contact with an outer circumference of the drum 262 to uniformly charge the outer circumference of the drum 262.

An exposure apparatus 3 outputs a laser beam L corresponding to image information. The laser beam L passes through a laser opening 271*h* provided in a cleaning frame body 271 of the cartridge 2B to scan and expose the outer circumference of the drum 262. In this way, an electrostatic latent image corresponding to the image information is formed on the outer circumference of the drum 262.

On the other hand, as illustrated in FIG. 13, in a developing unit 220 as a developing apparatus, toner T in a toner chamber 229 is stirred and conveyed by rotation of a conveying member (a stirring member) 243 and is delivered to a toner supply chamber 228.

The toner T is borne on the surface of a developing roller (a developing sleeve) 232 by the magnetic force of a magnet roller (a stationary magnet) 234. The developing roller 232 is a developer bearing member that bears a developer (toner T) on the surface thereof in order to develop the latent image formed on the drum 262.

The thickness of the toner T on a circumferential surface of a developing roller 232 as a developer bearing member is regulated while being triboelectrically charged by a developing blade 242.

The toner T is supplied to the drum 262 according to the electrostatic latent image to develop the latent image. In this way, the latent image becomes visible as a toner image (a developer image). The drum 262 is an image bearing member that bears the latent image or an image (a toner image or a developer image) formed by toner on the surface thereof. As illustrated in FIG. 12, a sheet material P stored in a lower part of the apparatus body 2A is delivered from the sheet tray 4 with the aid of the pickup roller 5*a* and the feed roller pair 5*b* in synchronization with an output timing of the laser beam L. The sheet material P passes through the transfer guide 6 and is conveyed to a transfer position between the drum 262 and the transfer roller 7. At this transfer position, the toner images are sequentially transferred from the drum 262 to the sheet material P.

The sheet material P to which the toner image is transferred is separated from the drum 262 and is conveyed to the fixing apparatus 9 along the conveying guide 8. The sheet material P passes through a nip portion between the heating roller 9*a* and the pressure roller 9*b* that form the fixing apparatus 9. At this nip portion, a pressurizing and heating process is performed and the toner image is fixed to the sheet material P. The sheet material P to which the toner image is fixed is conveyed up to the discharge roller pair 10 and is discharged to the discharge tray 11.

On the other hand, as illustrated in FIG. 13, a residual toner on the outer circumference of the drum 262 after a transfer operation is performed is removed by the cleaning blade 277 and is used again for an image forming process. The toner removed from the drum 262 is stored in a waste toner chamber 271*b* of the cleaning unit 260. The cleaning unit 260 is a unit having the photosensitive drum 262.

The charging roller 266, the developing roller 232, the transfer roller 7, and the cleaning blade 277 are process means acting on the drum 262.

Entire Configuration of Cartridge

Figure 14:
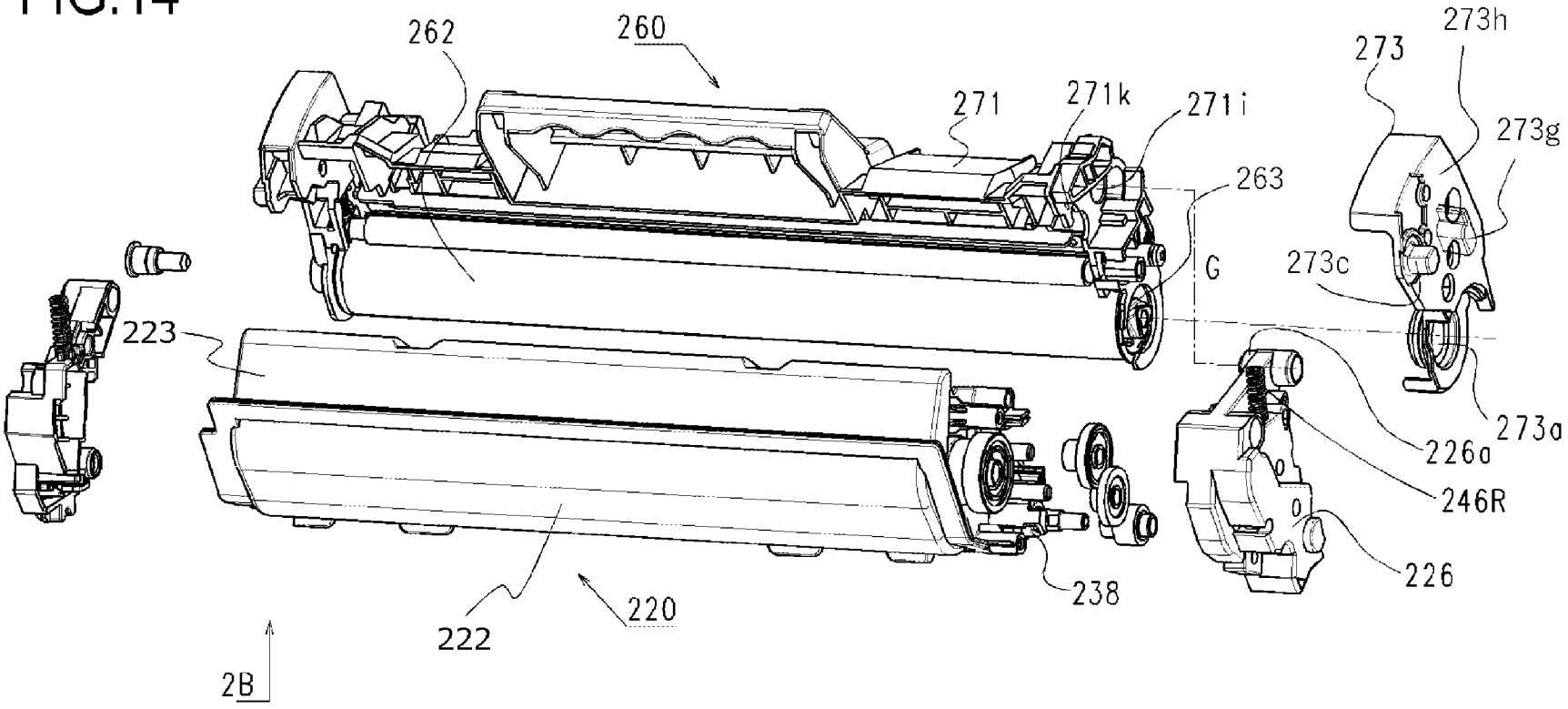
FIG. 14 is an exploded view of a cartridge according to Embodiment 2.
Figure 15:
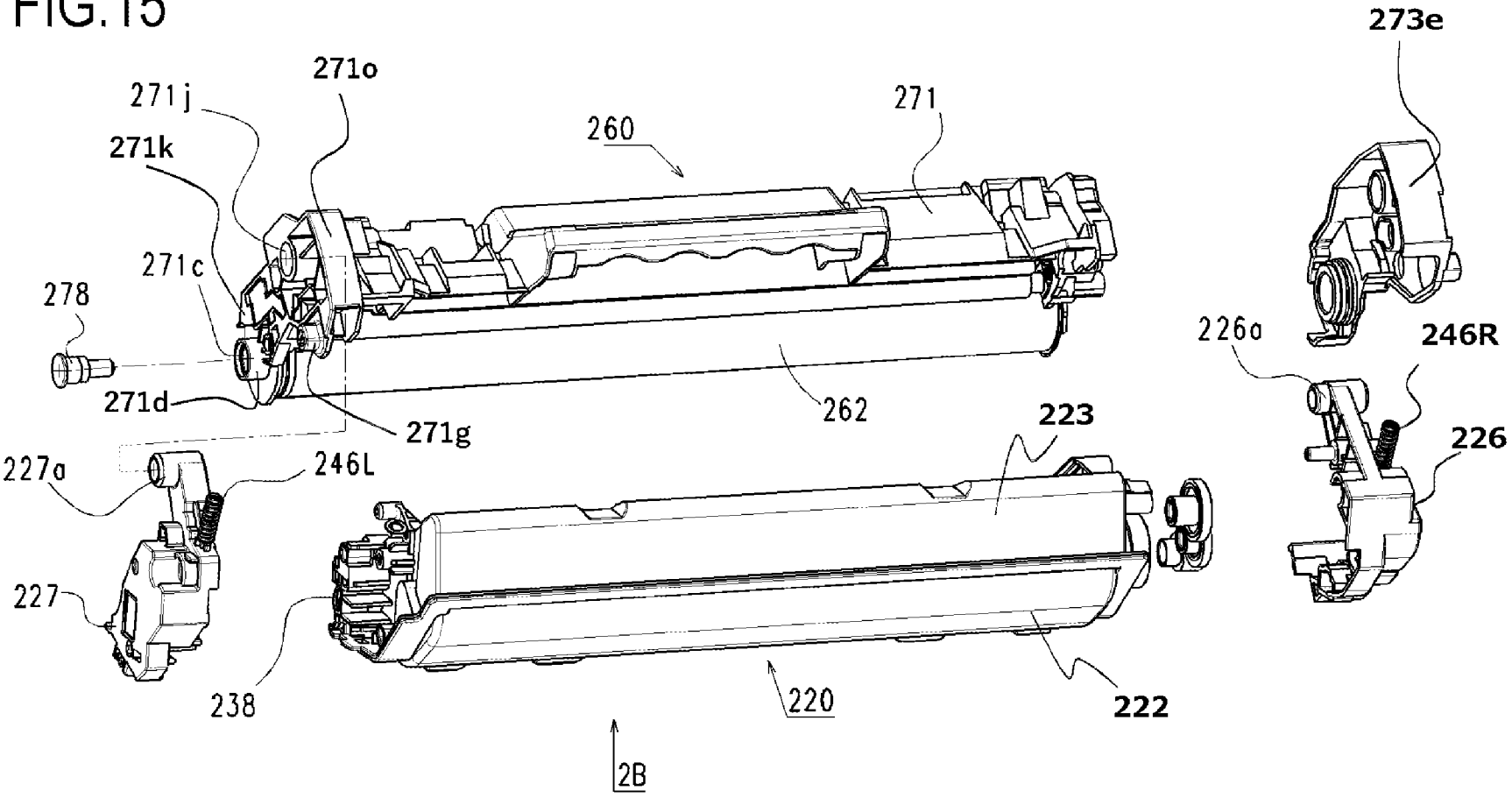
FIG. 15 is an exploded view of a cartridge according to Embodiment 2.

Next, an entire configuration of the cartridge 2B will be described with reference to FIGS. 13, 14, and 15. FIG. 13 is a schematic cross-sectional view of the cartridge 2B, and FIGS. 14 and 15 are exploded perspective views for describing the configuration of the cartridge 2B. In the present embodiment, description of screws used for combining respective components will be omitted.

The cartridge 2B includes a cleaning unit (a photosensitive member holding unit, a drum holding unit, an image bearing member holding unit, or a first unit) 260, a developing unit (a developer bearing member holding unit or a second unit) 220.

In general, a process cartridge is a member in which an electrophotographic photosensitive member and at least one of the process means acting on the photosensitive member are integrated as a cartridge so as to be detachably attachable to a body (an apparatus body) of an electrophotographic image forming apparatus. Examples of process means include charging means, developing means, and cleaning means.

As illustrated in FIG. 13, the cleaning unit 260 includes the drum 262, the charging roller 266, the cleaning member 277, and the cleaning frame body 271 supporting these members.

As illustrated in FIG. 14, on a driving side as the other end side, the drum 262 is configured such that a driving-side drum flange 263 provided at a driving-side end of the drum 262 is rotatably supported by a hole 273*a* of a drum bearing 273. In a broad sense, the drum bearing 273 and the cleaning frame body 271 can be also collectively referred to as a cleaning frame body.

As illustrated in FIG. 15, on a non-driving side as one end side, the drum 262 is configured such that a drum shaft 278 press-fitted to a hole 271*c* formed in the cleaning frame body 271 is rotatably supported by a hole (not illustrated) of a non-driving-side drum shaft.

The drum flanges are bearing target portions that are rotatably supported by bearing portions.

In the cleaning unit 260, the charging roller 266 and the cleaning member 277 are disposed in contact with the outer circumference of the drum 262.

The cleaning member 277 includes a rubber blade 277*a* which is a blade-shaped elastic member formed from rubber as an elastic member and a supporting member 277*b* supporting the rubber blade. The rubber blade 277*a* abuts on the drum 262 in a counter direction in relation to a rotation direction of the drum 262. That is, the rubber blade 277*a* abuts on the drum 262 so that a distal end thereof faces the upstream side in the rotation direction of the drum 262.

As illustrated in FIG. 13, the waste toner removed from the surface of the drum 262 by the cleaning member 277 is stored in a waste toner chamber 271*b* formed by the cleaning frame body 271 and the cleaning member 277.

Moreover, as illustrated in FIG. 13, a scooping sheet 265 for preventing the waste toner from leaking from the cleaning frame body 271 is provided at an edge of the cleaning frame body 271 so as to abut on the drum 262.

The charging roller 266 is rotatably attached to the cleaning unit 260 with a charging roller bearing 267 at both ends in the longitudinal direction of the cleaning frame body 271.

The charging roller 266 is in pressure-contact with the drum 262 in such a way that a charging roller bearing 267 is pressed toward the drum 262 by a biasing member 268. The charging roller 266 rotates following rotation of the drum 262.

As illustrated in FIG. 13, the developing unit 220 includes the developing roller 232, a developing container 223 that supports the developing roller 232, the developing blade 242, and the like. The developing roller 232 is attached to the developing container 223 so as to be rotatably by bearing members 226 (FIG. 14) and 227 (FIG. 15) provided at both ends of the developing roller 232.

Moreover, a magnet roller 234 is provided in the developing roller 232. A developing blade 242 for regulating the toner layer on the developing roller 232 is disposed in the developing unit 220. As illustrated in FIGS. 14 and 15, an interval holding member 238 is attached to both ends of the developing roller 232, and the interval holding member 238 and the drum 262 abut on each other whereby the developing roller 232 is held with a very small gap formed between the drum 262 and the developing roller 232.

Moreover, as illustrated in FIG. 13, a developing sheet member 233 for preventing toner from leaking from the developing unit 220 is provided at an edge of a bottom member 222 so as to abut on the developing roller 232. Furthermore, the conveying member 243 is provided in the toner chamber 229 formed by the developing container 223 and the bottom member 222. The conveying member 243 stirs the toner stored in the toner chamber 229 and conveys the toner toward the toner supply chamber 228.

As illustrated in FIGS. 14 and 15, the cartridge 2B is formed by combining the cleaning unit 260 and the developing unit 220.

When the developing unit and the cleaning unit are combined, first, the center of a first developing supporting boss 226*a* of the bearing member 226 with respect to a first driving-side suspension hole 271*i* of the cleaning frame body 271 is aligned to match the center of a second developing supporting boss 227*a* of the bearing member 227 with respect to a second non-driving-side suspension hole 271*j*. Specifically, the developing unit 220 is moved in a direction indicated by arrow G so that the first developing supporting boss 226*a* and the second developing supporting boss 227*a* are fitted to the first suspension hole 271*i* and the second suspension hole 271*j*, respectively. In this way, the developing unit 220 is connected so as to be movable in relation to the cleaning unit 260. More specifically, the developing unit 220 is rotatably (turnably) connected to the cleaning unit 260. That is, the developing roller 232 is connected so as to move toward and away from the drum 262. After that, the drum bearing 273 is assembled with the cleaning unit 260 to form the cartridge 2B.

In the present embodiment, a non-driving-side biasing member 246L (FIG. 15) and a non-driving-side biasing member 246R (FIG. 14) are formed of a compression spring. By the biasing force of these springs, the driving-side biasing member 246L and the non-driving-side biasing member 246R biases the developing unit 220 toward the cleaning unit 260 whereby the developing roller 232 is reliably pressed toward the drum 262. Furthermore, the interval holding member 238 is attached to both ends of the developing roller 232. That is, the drum 262 and the developing roller 232 come into contact with each other with a predetermined contact pressure with the interval holding member 238 disposed therebetween whereby the developing roller 232 is held at a predetermined interval from the drum 262 and the relative positions thereof are determined.

Here, in order for the electrostatic latent image on the drum 262 to be stably developed with the toner T borne on the circumferential surface of the developing roller 232, it is desirable that the interval between the drum 262 and the developing roller 232 is maintained constantly with high accuracy. In other words, it is required that a contact pressure when the drum 262 and the developing roller 232 come into contact with each other with the interval holding member 238 disposed therebetween is maintained stably.

Attachment of Cartridge

Next, attachment of the cartridge 2B to the apparatus body 2A will be described in detail with reference to FIGS. 16A, 16B, 17A, 17B, 11A, 11B, and 11C.

Figure 11A:
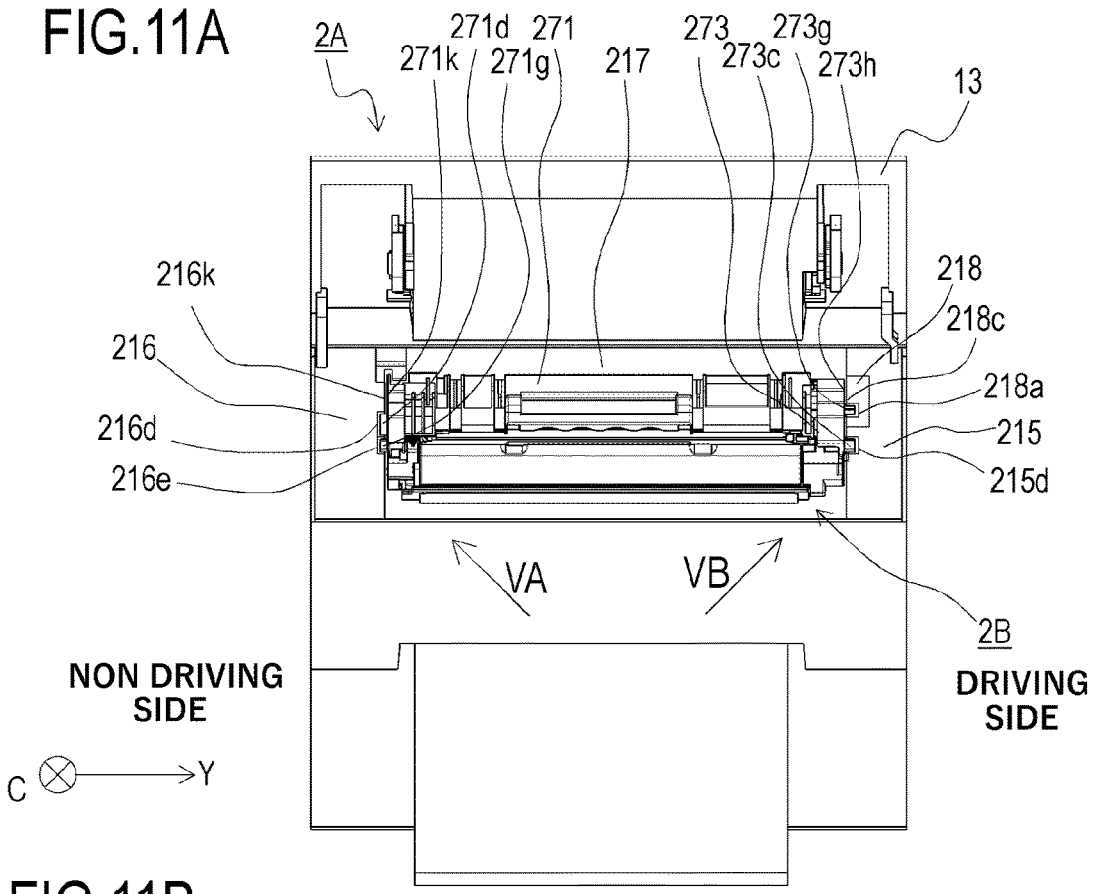
FIGS. 11A to 11C are diagrams for describing a configuration of a cartridge and an image forming apparatus according to Embodiment 2.
Figure 11B:
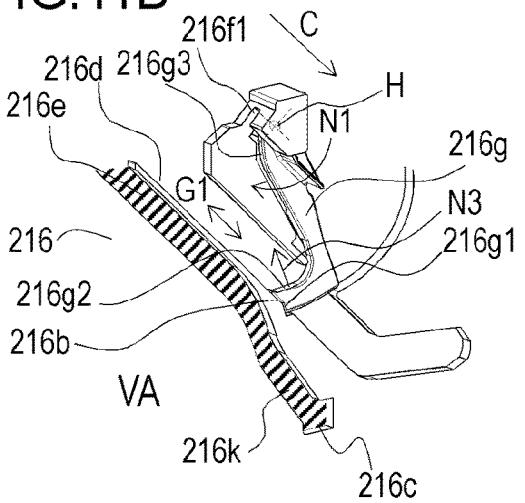
Figure 11C:
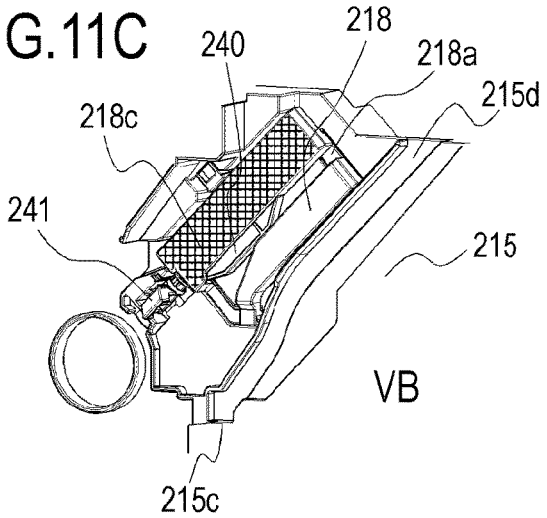
Figure 16A:
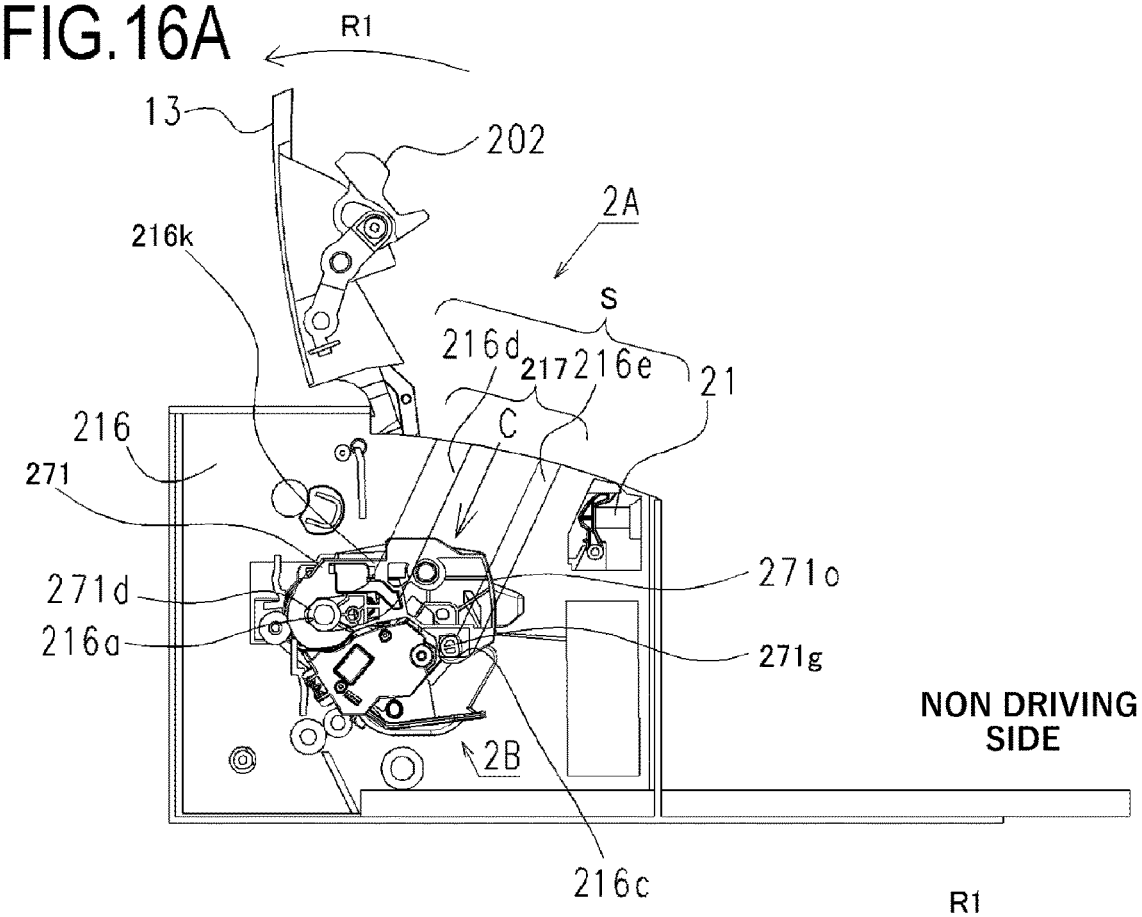
FIGS. 16A and 16B are schematic cross-sectional views of an image forming apparatus according to Embodiment 2.
Figure 16B:
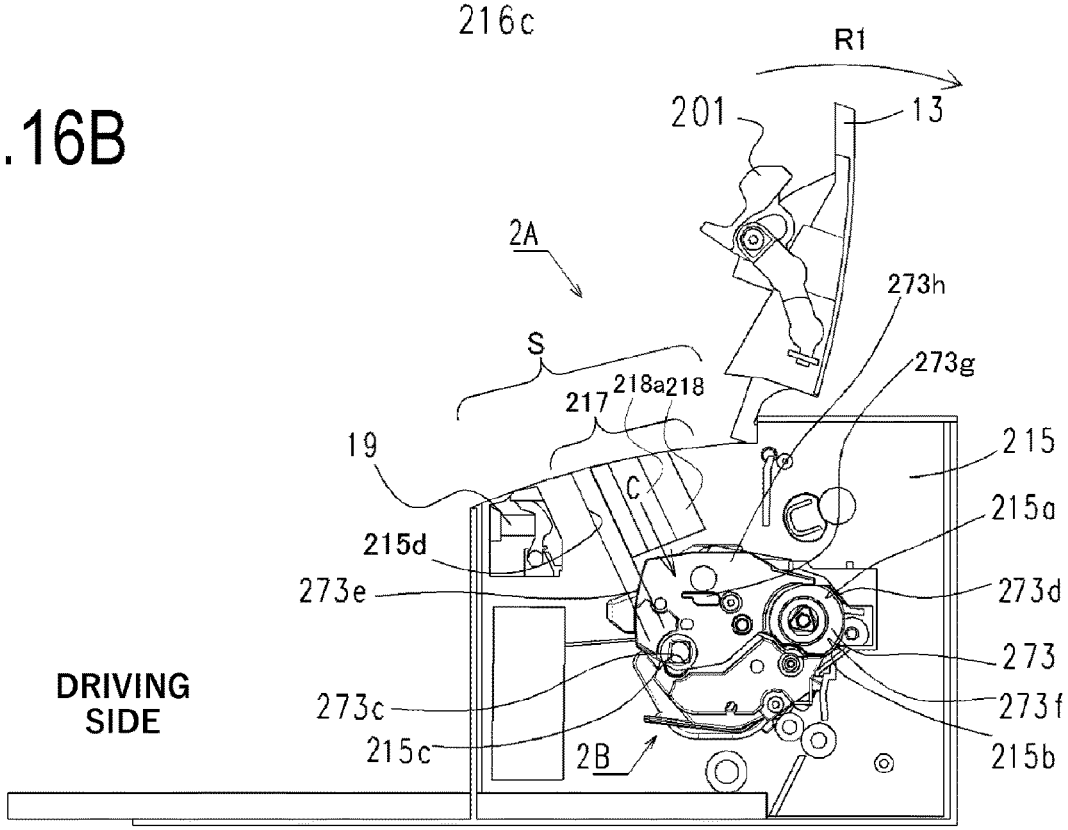
Figure 17A:
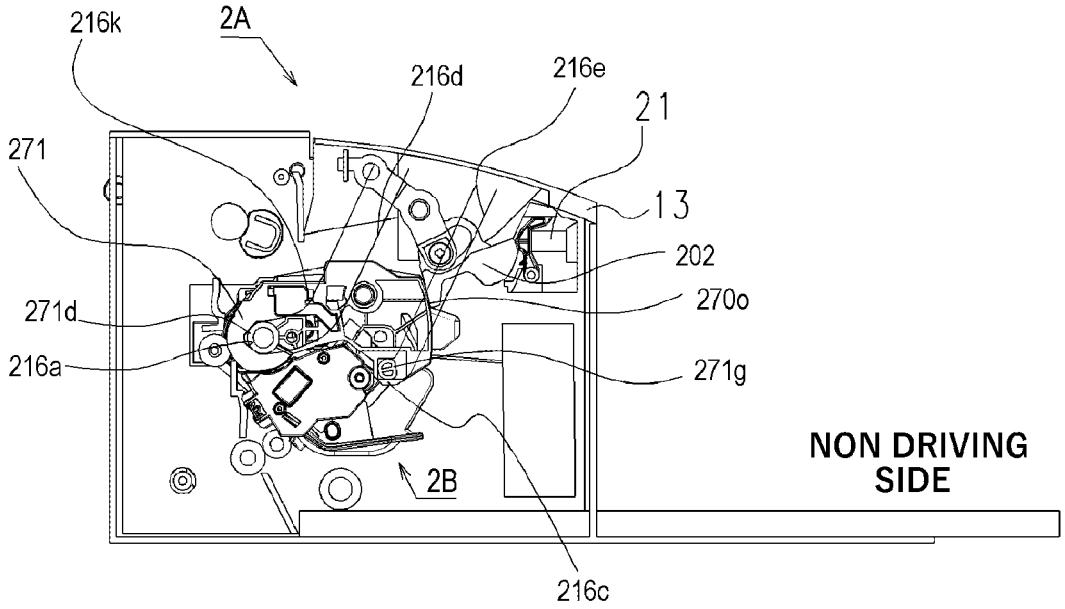
FIGS. 17A and 17B are schematic cross-sectional views of an image forming apparatus according to Embodiment 2.
Figure 17B:
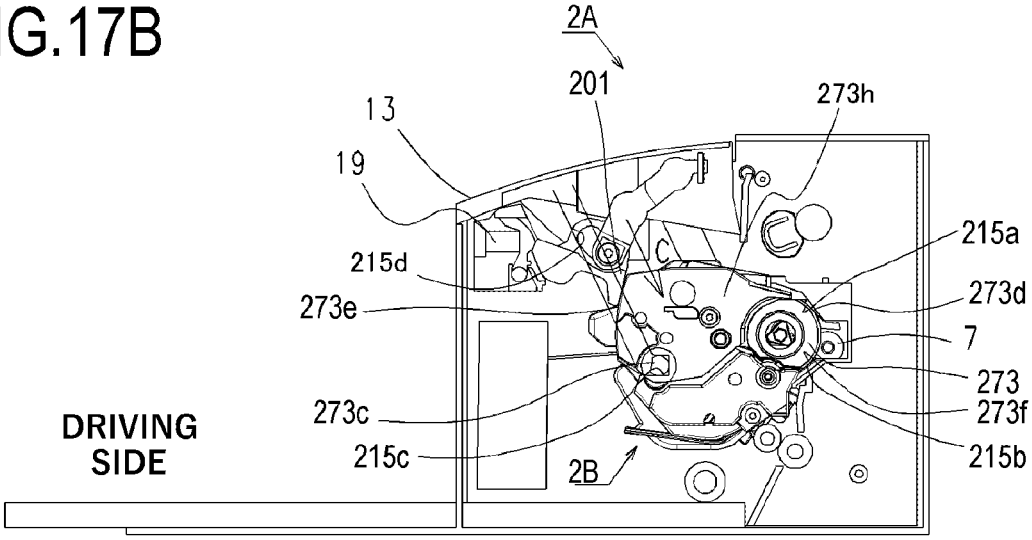

FIGS. 16A to 17B are explanatory diagrams (schematic cross-sectional views) illustrating an attachment portion of the apparatus body 2A to the cartridge 2B, in which FIGS. 16A and 17A illustrate a non-driving side and FIGS. 16B and 17B illustrate a driving side. FIGS. 11A to 11C are diagrams when the cartridge 2B is attached to the apparatus body 2A and are diagrams when seen from a side closer to a downstream side than the upstream side in the attachment direction C of the cartridge 2B.

As illustrated in FIGS. 16A and 16B, the door 13 for exposing and covering an attachment portion S of the cartridge 2B is provided in the apparatus body 2A. When the cartridge 2B is attached, the door 13 is turned in a direction indicated by arrow R1 so that the attachment portion S of the cartridge 2B and an insertion opening 217 which is formed in the attachment portion S and is an inlet used for attaching the cartridge 2B are exposed. In this way, a state in which the cartridge 2B can be attached to the apparatus body 2A in a direction (the attachment direction C) orthogonal to the longitudinal direction Y.

As illustrated in FIGS. 16A, 11A, and 11B, a non-driving-side guide 216 is provided on the non-driving side of the attachment portion S. The non-driving-side guide 216 has a non-driving-side upper guide 216*d* notched along the attachment direction C, a non-driving-side lower guide 216*e*, and a non-driving-side inner surface 216*k* opposing (facing) the attachment portion S.

On the other hand, as illustrated in FIGS. 16B, 11A, and 11C, a driving-side guide 215 and a second guide rail 218 (a second guide portion) as a second identifying portion are provided on the driving side of the attachment portion S. The driving-side guide 215 and the second guide rail 218 have a driving-side guide portion 215*d* and a second guide portion 218*a* notched along the attachment direction C, respectively. Moreover, the second guide rail 218 further has a driving-side inner surface 218*c* opposing (facing) the attachment portion S.

On the other hand, a guiding target portion along which attachment to the apparatus body 2A is guided is provided in the cartridge 2B.

As illustrated in FIGS. 11A to 11C and 15, on the non-driving side of the cartridge 2B, an end surface 271*k* orthogonal to the longitudinal direction Y, a positioning target portion 271*d* (a third projection) as a third identification target portion protruding toward the outer side in the longitudinal direction Y from the end surface 271*k*, and a rotation-stopping target portion 271*g* are provided in the cleaning frame body 271.

As illustrated in FIGS. 11A to 11C and 14, on the driving side of the cartridge 2B, an end surface 273*h* orthogonal to the longitudinal direction Y, a rotation-stopping target portion 273*c* (a first projection) protruding toward the outer side in the longitudinal direction Y from the end surface 273*h*, and an identification target boss 273*g* (a second projection) as a second identification target portion are provided in the drum bearing 273.

As illustrated in FIGS. 11A to 11C, when the cartridge 2B is attached from the cartridge insertion opening 217 of the apparatus body 2A, the non-driving-side end surface 271*k* and the driving-side end surface 273*h* of the cartridge 2B approach and face the non-driving-side inner surface 216*k* and the driving-side inner surface 218*c*, respectively. In this way, the position (trajectory) in the longitudinal direction Y during attachment of the cartridge 2B is determined.

Moreover, on the non-driving side of the cartridge 2B, the positioning target portion 271*d* is guided to the non-driving-side upper guide 216*d* and the rotation-stopping target portion 271*g* is guided to the non-driving-side lower guide 216*e*.

In contrast, on the driving side of the cartridge 2B, the identification target boss 273*g* is guided to the second guide portion 218*a* and the rotation-stopping target portion 273*c* is guided to the driving-side guide portion 215*d*.

In this way, the position (trajectory) in the direction (an up-down direction Z) orthogonal to the attachment direction C and the longitudinal direction Y of the cartridge 2B during attachment of the cartridge 2B is determined.

In this manner, the cartridge 2B is attached to the apparatus body 2A along the determined attachment trajectory (the attachment direction C).

Next, a state in which a door 13 is closed will be described. As illustrated in FIGS. 16A, 16B, 17A, and 17B, the driving-side guide 215 has an upper positioning portion 215*a*, a lower positioning portion 215*b*, and a rotation-stopping portion 215*c* as a positioning portion. Moreover, the non-driving-side guide 216 has a positioning portion 216*a* and a rotation-stopping portion 216*c*. The drum bearing 273 has an upper positioning target portion 273*d* and a lower positioning target portion 273*f*.

Moreover, cartridge pressing members 201 and 202 are rotatably attached to both ends in the axial direction of the door 13. The cartridge pressing springs 19, 21 are attached to both ends in the longitudinal direction Y of a front plate provided in the apparatus body 2A. The drum bearing 273 has a pressing target portion 273*e* as a biasing force receiving portion and the cleaning frame body 271 has a pressing target portion 2710 on the non-driving side (see FIGS. 13, 15, 16A, 16B, 17A, and 17B). When the door 13 is closed, the pressing target portions 273*e* and 2710 of the cartridge 2B are pressed by the cartridge pressing members 201 and 202 biased by the cartridge pressing springs 19 and 21 of the apparatus body 2A (see FIGS. 17A and 17B).

In this way, on the driving side, the upper positioning target portion 273*d*, the lower positioning target portion 273*f*, and the rotation-stopping target portion 273*c* of the cartridge 2B abut on the upper positioning portion 215*a*, the lower positioning portion 215*b*, and the rotation-stopping portion 215*c* of the, respectively. As a result, the cartridge 2B and the drum 262 are positioned on the driving side. Moreover, on the non-driving side, the positioning target portion 271*d* and the rotation-stopping target portion 271*g* of the cartridge 2B abut on the positioning portion 216*a* and the rotation-stopping portion 216*c* of the apparatus body 2A, respectively. In this way, the cartridge 2B and the drum 262 are positioned on the non-driving side.

While the above-described configuration has been described as an example of a configuration that determines the position of the cartridge 2B in relation to the apparatus body 2A, the configuration of the positioning means is not limited thereto. The positioning means may act directly on the positioning target portion 271*d* and the rotation-stopping target portion 271*g* on the driving side of the cartridge 2B and the positioning target portion 273*d* and the rotation-stopping target portion 273*f* on the non-driving side to fix the respective positioning portions.

Attachment Error Prevention Mechanism of Cartridge

A cartridge attachment error prevention system according to the present embodiment will be described with reference to FIGS. 11A to 11C and 18A to 21.

An overview of a cartridge attachment error prevention system will be described with reference to FIGS. 11A to 11C. As illustrated in FIGS. 11A to 11C, the cartridge attachment error prevention system includes a first attachment error prevention mechanism provided on one end side (the non-driving side) in the longitudinal direction Y and a second attachment error prevention mechanism provided on the other end side (the driving side). The first attachment error prevention mechanism and the second attachment error prevention mechanism function independently, and a cartridge being allowed by both mechanisms can be attached to the apparatus body 2A (the details will be described later).

First Attachment Error Prevention Mechanism for Cartridge

Figure 18A:
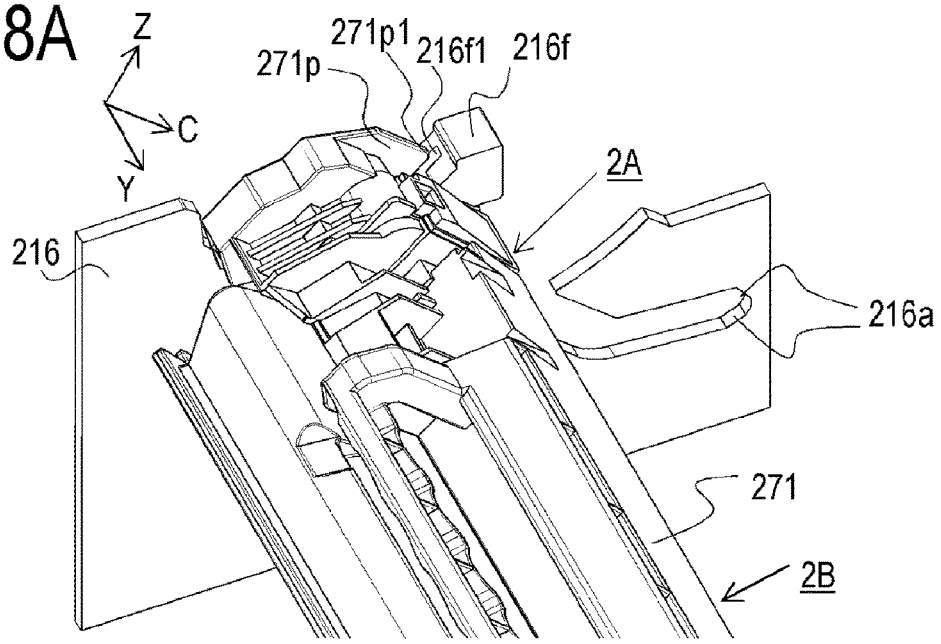
FIGS. 18A to 18C are diagrams illustrating how a cartridge is attached to an image forming apparatus according to Embodiment 2.
Figure 18B:
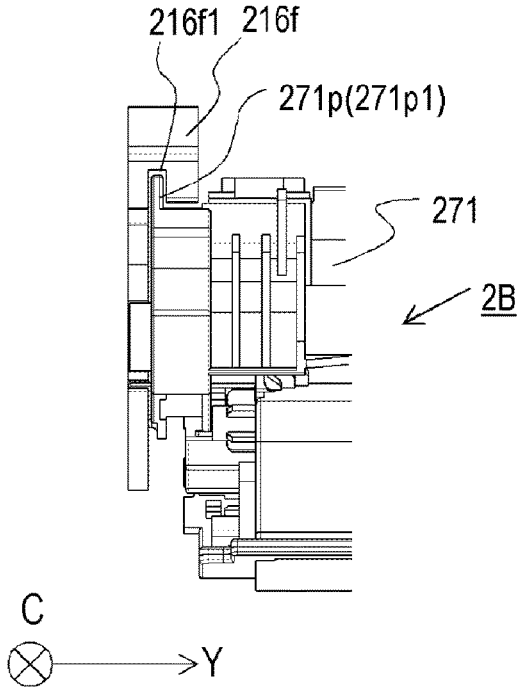
Figure 18C:
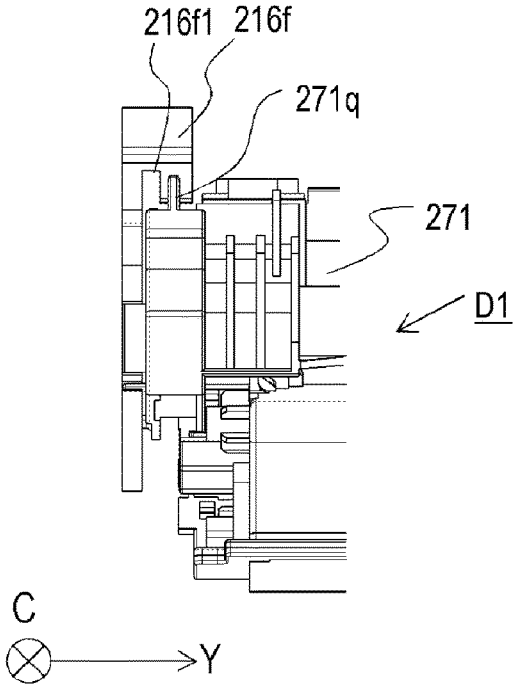

A configuration of the first cartridge attachment error prevention mechanism will be described with reference to FIGS. 18A to 18C. FIG. 18A is an explanatory diagram of the apparatus body 2A and the cartridge 2B related to the first attachment error prevention mechanism, and FIG. 18B is an explanatory diagram of the apparatus body 2A and the cartridge 2B.

As illustrated in FIG. 18A, a rib 271*p* as a first identification target portion, extending in a direction (the up-down direction Z) orthogonal to both the longitudinal direction Y and the attachment direction C is provided at a non-driving-side end of the cleaning frame body 271. A first abutting portion 271*p*1 is provided on the upstream side in the cartridge attachment direction C of the rib 271*p*. Meanwhile, as illustrated in FIG. 18B, a non-driving-side identification rail 216*f* as a first identifying portion is provided in the apparatus body 2A. A notch 216*f*1 (a first guide portion) is provided in the non-driving-side identification rail 216*f* at a position matching the rib 271*p* in the longitudinal direction Y of the cartridge 2B.

Moreover, as illustrated in FIG. 11B, a movable lever 216*g* as a first movable member is provided in the non-driving-side guide 216. The movable lever 216*g* is configured to be swingable about the shaft center H and is biased in the direction indicated by arrow N1 by a biasing member (not illustrated). The position of the movable lever 216*g* is determined in such a way that the regulating target surface 216*g*1 of the movable lever 216*g* comes into contact with the regulating surface 216*b* provided on the non-driving-side plate 216 (this is the first regulation position). In this case, a state in which the movable lever 216*g* blocks an attachment path (a guiding path) G1 of the positioning target portion 271*d* of the cartridge 2B by the non-driving-side upper guide 216*d* (a third guide portion) is created. Moreover, an abutting surface 216*g*3 is provided in the movable lever 216*g* on a side closer to the downstream side in the attachment direction C of the cartridge 2B than the notch 216*f*1. At the first regulation position, the abutting surface 216*g*3 is a surface that crosses the attachment direction C and the direction (a tangential direction of a circle about the shaft center H) indicated by arrow N1 of the cartridge 2B and faces the direction indicated by arrow N1. Furthermore, a lever regulating portion 216*g*2 as a first movable portion is provided in the vicinity of the regulating target surface 216*g*1 of the movable lever 216*g*. At the first regulation position, the lever regulating portion 216*g*2 is a surface that crosses the attachment direction C of the cartridge 2B and faces the direction indicated by arrow N3.

Process in Which Cartridge 2B is Attached to Apparatus Body 2A

A process in which the cartridge 2B that is allowed to be attached to the apparatus body 2A is attached to the first attachment error prevention mechanism on the non-driving side will be described with reference to FIGS. 19A to 19E. FIGS. 19A to 19E are lateral cross-sectional views illustrating a process in which the cartridge 2B is attached to the apparatus body 2A. For the sake of convenience, only the non-driving-side guide 216 and the cleaning unit 260 are illustrated. Moreover, although only the cleaning unit 260 and the movable lever 216*g* are hatched in FIG. 19A so that the shapes of components are identified, no component is hatched in FIGS. 19B to 19E for the sake of convenience.

Figure 19A:
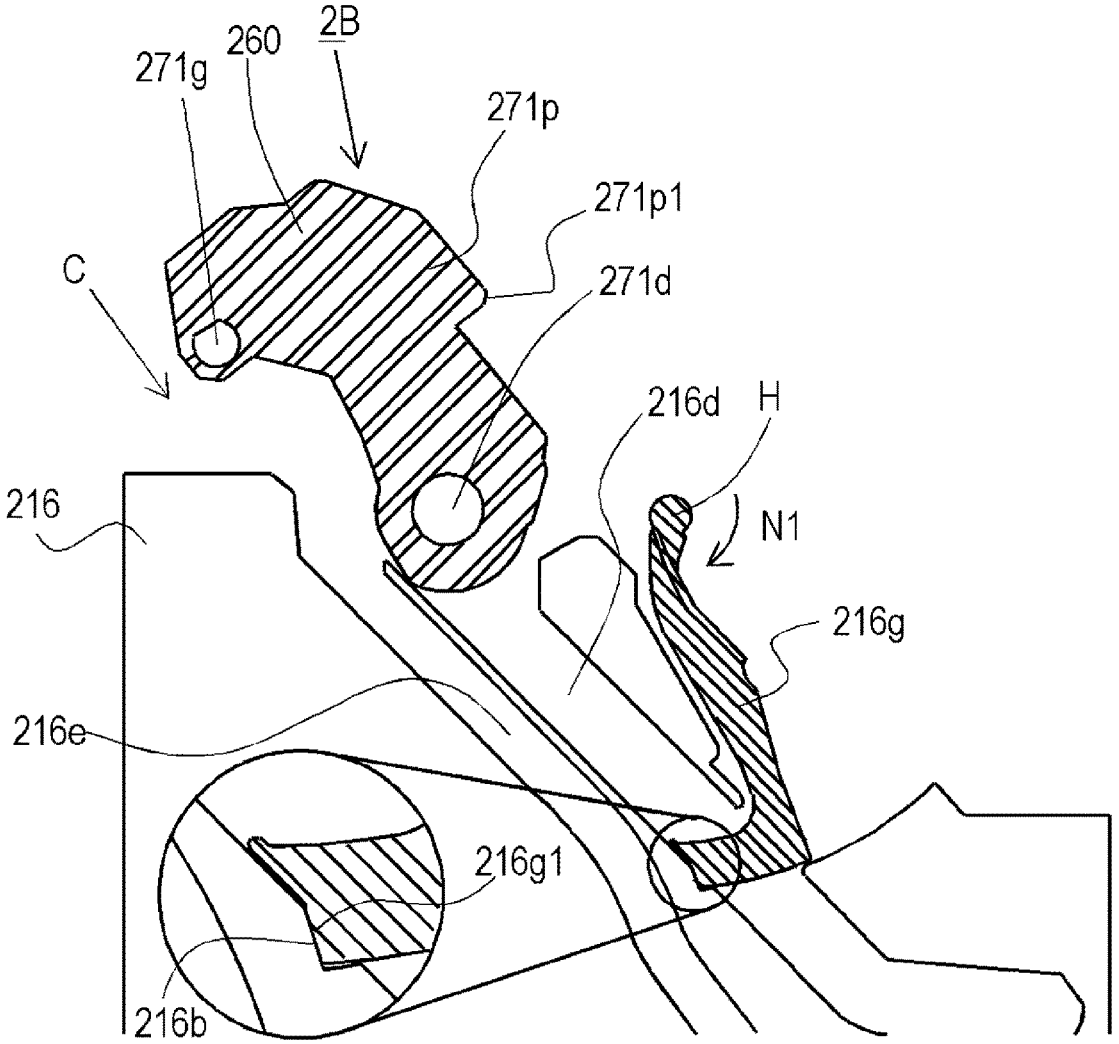
FIG. 19A is a diagram for describing a first attachment error prevention mechanism during insertion of a cartridge according to Embodiment 2.
Figure 19B:
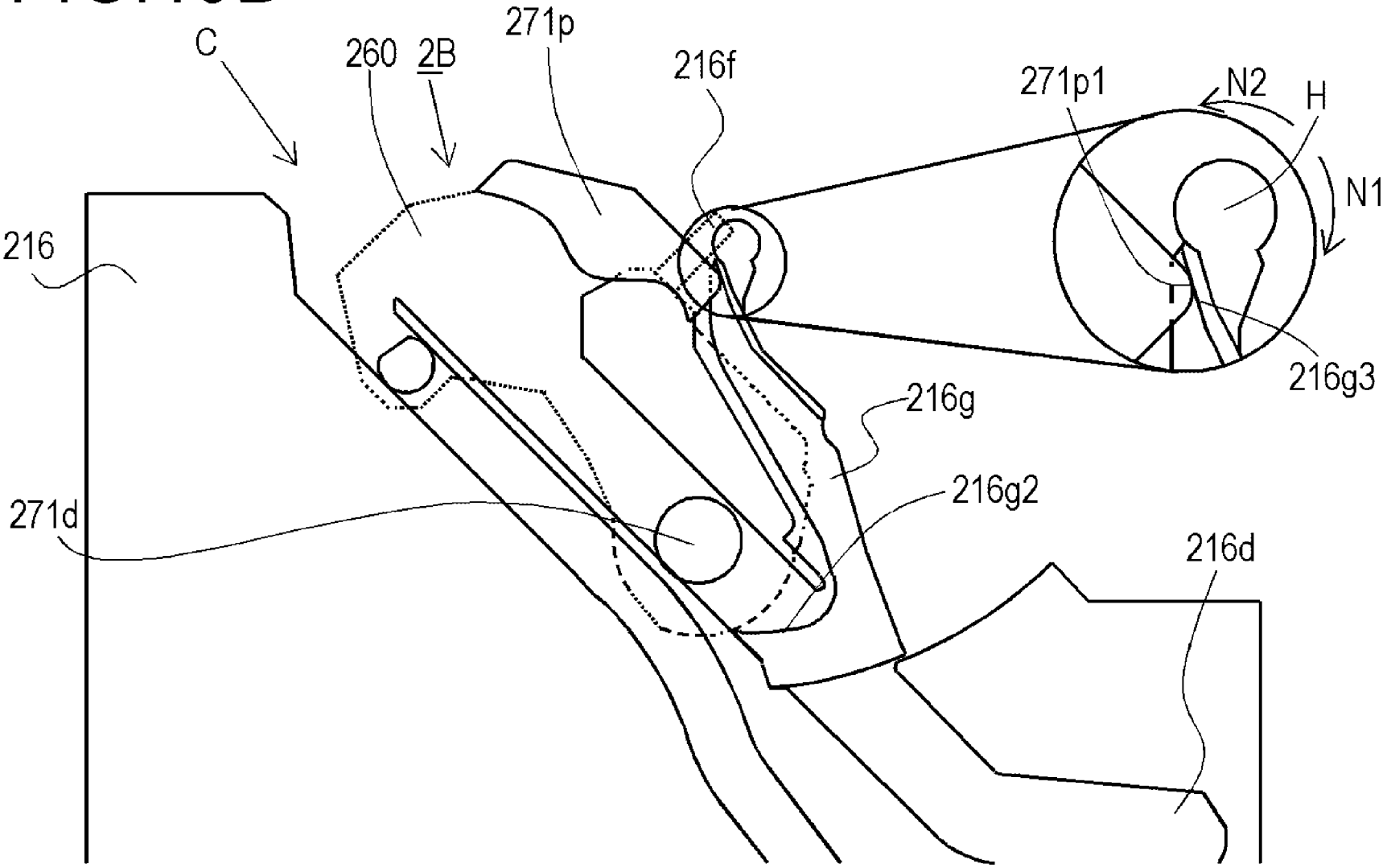
FIG. 19B is a diagram for describing a first attachment error prevention mechanism during insertion of a cartridge according to Embodiment 2.

As illustrated in FIG. 19B, when the cartridge 2B is inserted into the apparatus body 2A, the rib 271*p* passes through the notch 216*f* and enters the apparatus body 2A. Subsequently, when the cartridge 2B enters the apparatus body 2A, the first abutting portion 271*p*1 of the rib 271*p* abuts on the abutting surface 216*g*3 of the movable lever 216*g* before the positioning target portion 271*d* abuts on the lever regulating portion 216*g*2.

Figure 19C:
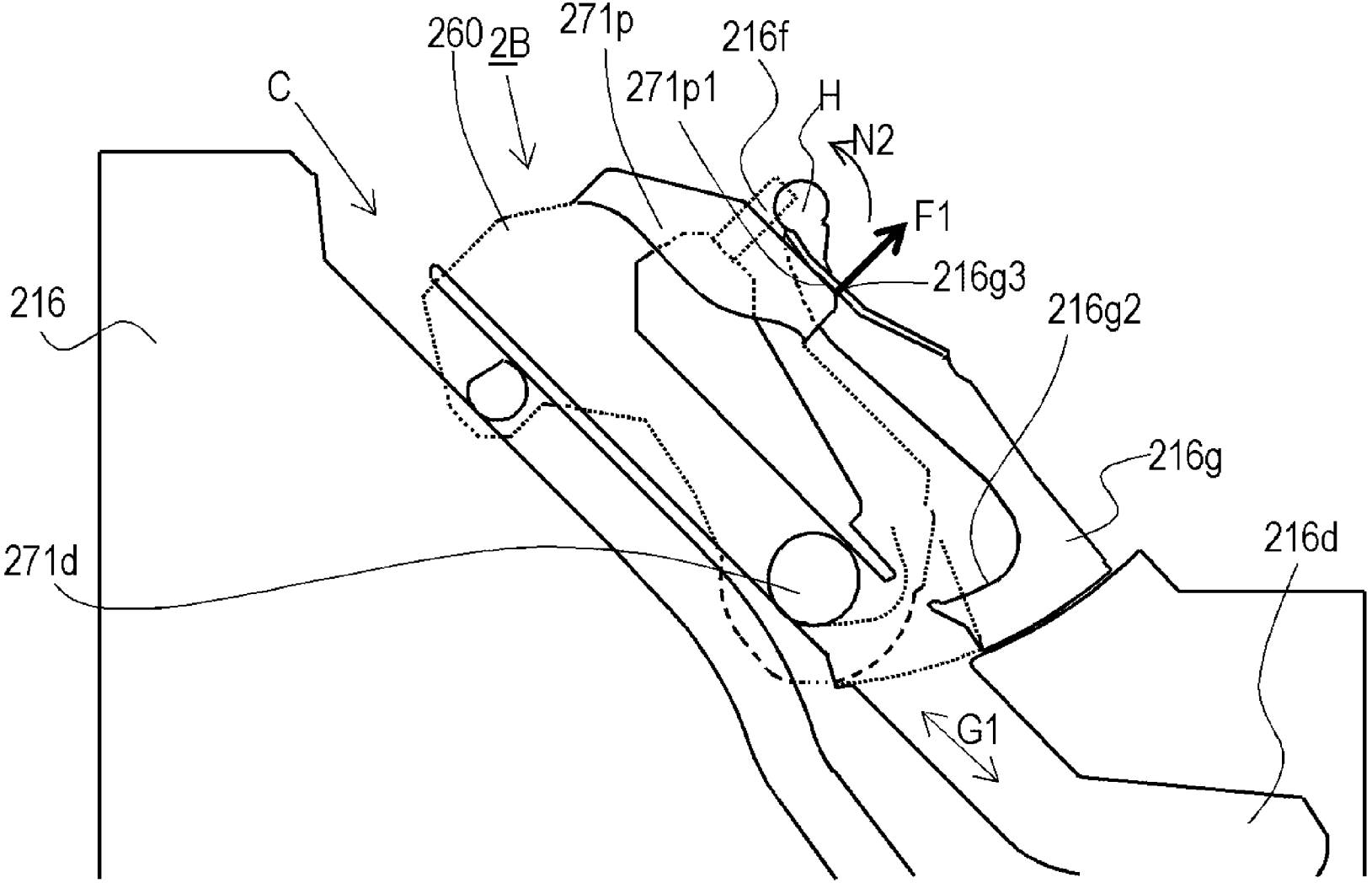
FIG. 19C is a diagram for describing a first attachment error prevention mechanism during insertion of a cartridge according to Embodiment 2.

When the cartridge 2B is inserted further in the direction C in this state, as illustrated in FIG. 19C, the first abutting portion 271*p*1 applies a force F1 originating from the attachment force (the operating force of a user) of the cartridge 2B to the abutting surface 216*g*3. With this force F1, the movable lever 216*g* is turned in the direction indicated by arrow N2 and the cartridge 2B can enter further into the apparatus body 2A. Moreover, in this case, with turning of the movable lever 216*g*, the lever regulating portion 216*g*2 also moves in the direction indicated by arrow N2 up to a first allowable position (a non-regulation position) at which the attachment path G1 (see FIG. 11B) of the positioning target portion 271*d* of the cartridge 2B is released.

Figure 19D:
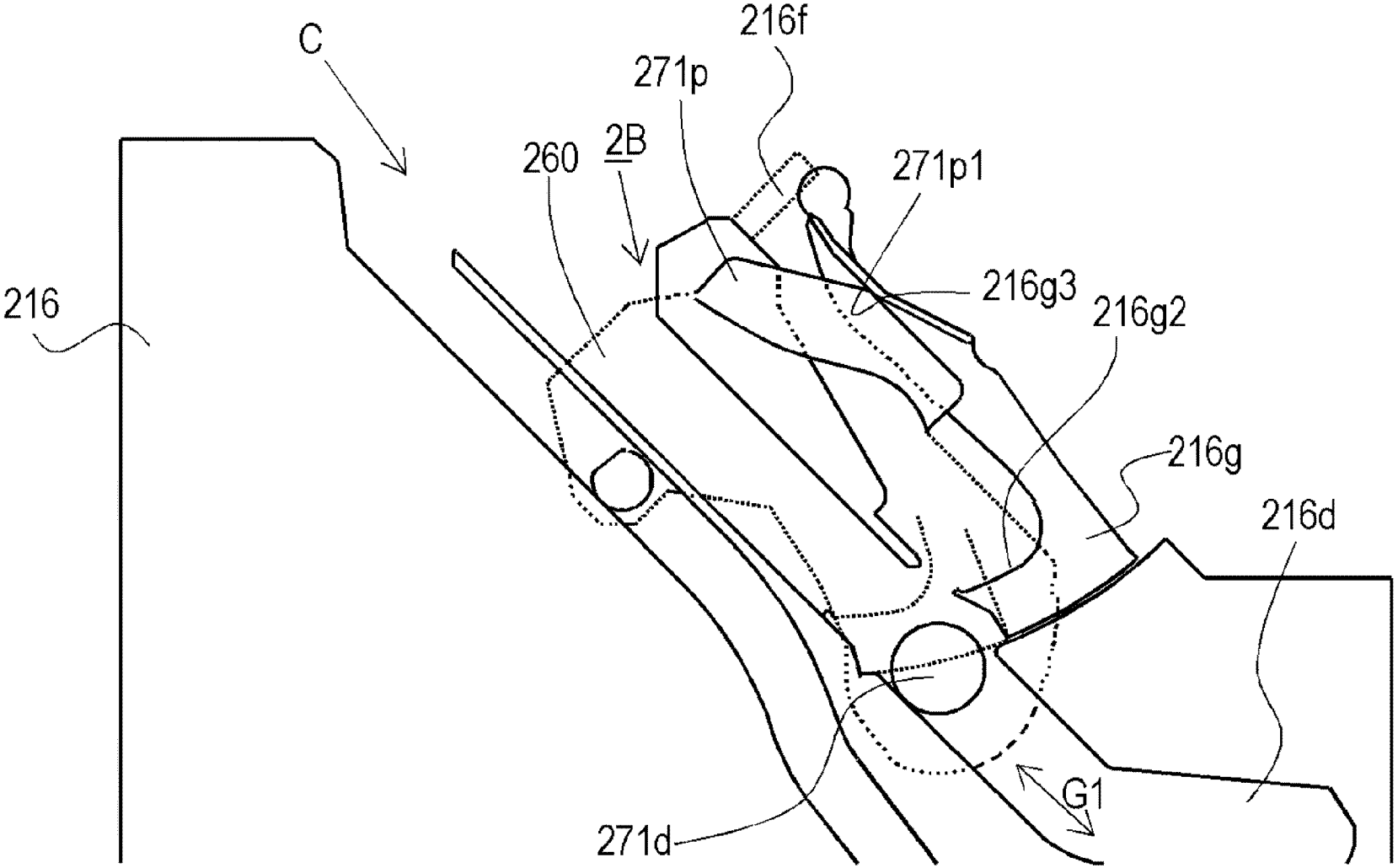
FIG. 19D is a diagram for describing a first attachment error prevention mechanism during insertion of a cartridge according to Embodiment 2.

Furthermore, when insertion of the cartridge 2B progresses, as illustrated in FIG. 19D, the positioning target portion 271*d* passes through the lever regulating portion 216*g*2 in a state in which the rib 271*p* and the abutting surface 216*g*3 are in contact with each other. When the rib 271*p* passes through the abutting surface 216*g*3, the cartridge 2B can be finally reached to an attachment completion position with respect to the apparatus body 2A, at which as described above, the positioning target portion 271*d* and the rotation-stopping target portion 271*g* illustrated in FIG. 17A abut on the positioning portion 216*a* and the rotation-stopping portion 216*c* of the apparatus body 2A, respectively.

Figure 19E:
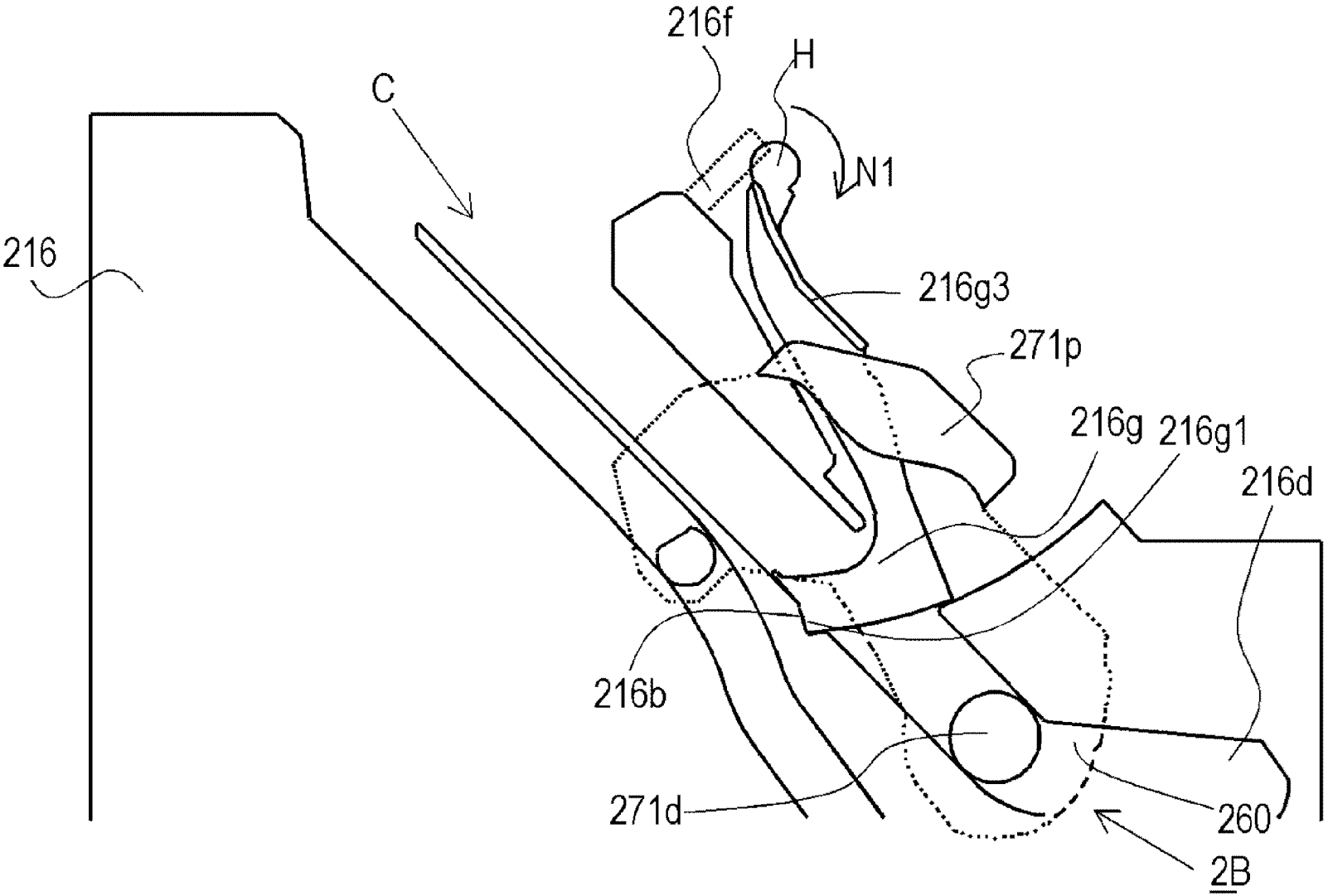
FIG. 19E is a diagram for describing a first attachment error prevention mechanism during insertion of a cartridge according to Embodiment 2.

In this case, since the rib 271*p* does not abut on the abutting surface 216*g*3, as illustrated in FIG. 19E, the movable lever 216*g* is moved again to the first regulation position by a biasing force.

In this manner, when the cartridge 2B that is allowed to be attached to the apparatus body 2A is inserted, the rib 271*p* passes through the notch 216*f*1 to turn the movable lever 216*g*. In this way, the cartridge 2B can enter the apparatus body 2A while preventing the positioning target portion 271*d* from abutting on the lever regulating portion 216*g*2.

Process of Preventing Attachment Error of Cartridge D1 (First Unallowed Case)

A process in which the first attachment error prevention mechanism prevents an attachment error of a cartridge D1 (a first unallowed cartridge) to the apparatus body 2A will be described with reference to FIGS. 18A to 18C. As illustrated in FIG. 18C, the cartridge D1 has a rib 271*q* (as an unallowed identification target portion) at a different position in the longitudinal direction Y from the rib 271*p* of the cartridge 2B. When the cartridge D1 is to be inserted, since the position in the longitudinal direction of the rib 271*q* is different from that of the notch 216*f*1 of the non-driving-side identification rail 216*f*, the cartridge D1 cannot pass through the non-driving-side identification rail 216*f*. In this way, attachment of the cartridge D1 can be regulated.

That is, the notch 216*f*1 of the non-driving-side identification rail 216*f* has an inlet shape corresponding to an outer shape of the rib 271*p* of the cartridge 2B when seen in the attachment direction to the apparatus body 2A of the cartridge. A regulating wall abutting on the rib 271*q* of the cartridge D2 is formed around the inlet. First identification of whether the cartridge to be attached to the apparatus body 2A is allowed one or not is realized by the non-driving-side identification rail 216*f* as the first identifying portion and the ribs 271*p* and 271*q* as the first identification target portion provided in the cartridge 2B or D1.

Process of Preventing Attachment Error of Cartridge D2 (Second Unallowed Case)

Figure 20:
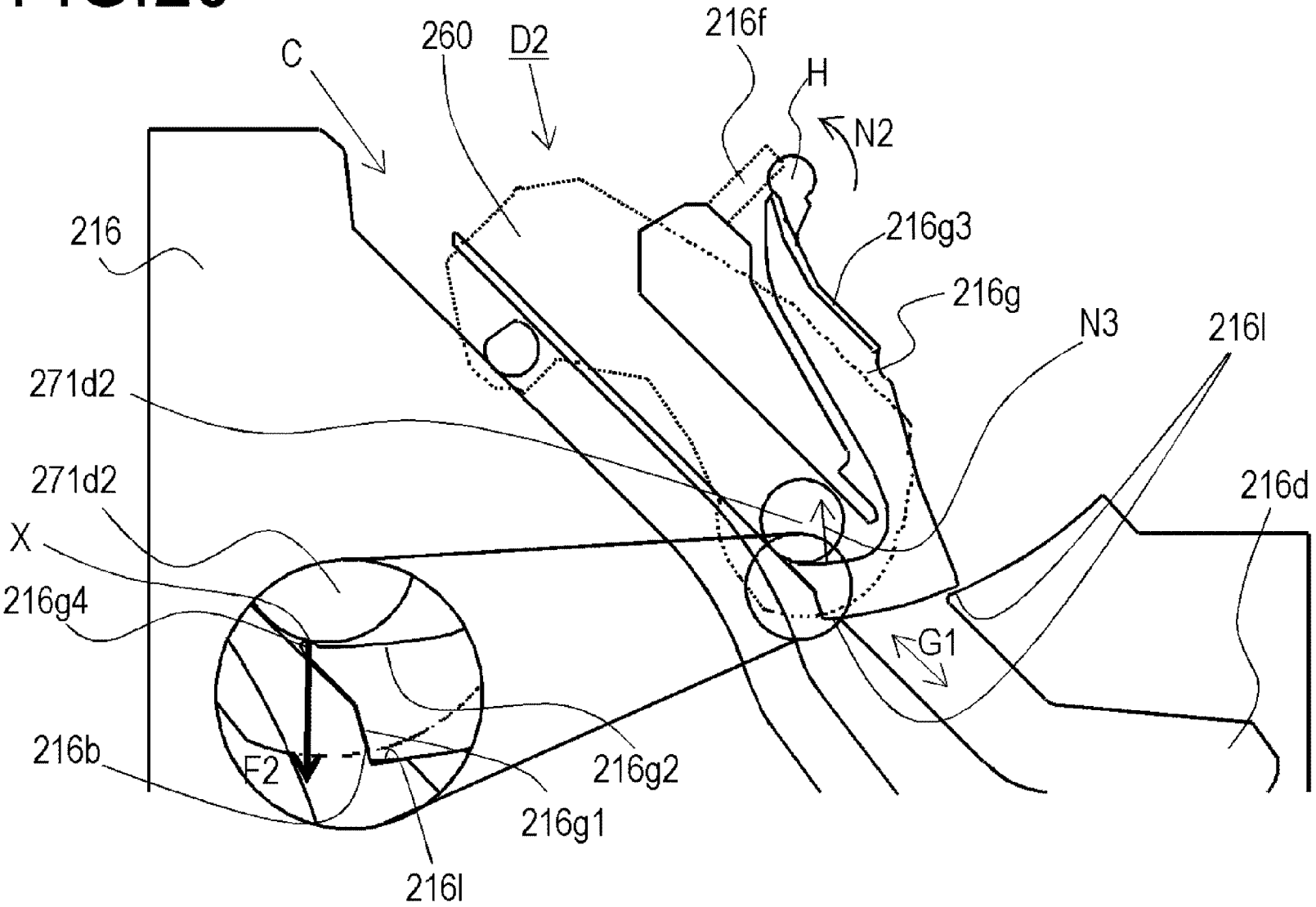
FIG. 20 is a diagram for describing a first attachment error prevention mechanism during insertion of a cartridge according to Embodiment 2.

A process of preventing an attachment error of still another cartridge D2 (a second unallowed cartridge) will be described with reference to FIG. 20. FIG. 20 is a lateral cross-sectional view illustrating a state in which the cartridge D2 is attached to the apparatus body 2A. Similarly to FIGS. 19A to 19E, only the non-driving-side guide 216 and the cleaning unit 260 are illustrated.

As illustrated in FIG. 20, the cartridge D2 does not have the rib 271*p* of the cartridge 2B. Due to this, the cartridge D2 can proceed in the attachment direction C while preventing the cleaning frame body 271 from interfering with the non-driving-side identification rail 216*f*. However, if the cartridge D2 is inserted in this state, the cartridge D2 proceeds while the cleaning frame body 271 does not abut on the abutting surface 216*g*3. By doing so, in a state in which the movable lever 216*g* is at the first regulation position, the positioning target portion 271*d*2 as a third identification target portion of the cartridge D2 comes into contact with the lever regulating portion 216*g*2. In this way, a force F2 originating from the attachment force of the cartridge D2 is applied to the lever regulating portion 216*g*2 from the positioning target portion 271*d*2.

Since the lever regulating portion 216*g*2 faces in the direction indicated by arrow N3, the force F2 acts in such a way as to turn the movable lever 216*g* in the direction indicated by arrow N1. By doing so, the movable lever 216*g* cannot move further and the attachment path G1 remains in a blocked state. In this way, it is possible to regulate attachment of the cartridge D2.

That is, third identification of whether the cartridge to be attached to the apparatus body 2A is allowed one or not is realized by the lever regulating portion 216*g*2 of the movable lever 216*g* as the third identifying portion and the positioning target portion 271*d*2 of the cartridge D2 as the third identification target portion.

More specifically, a projection 216*g*4 is provided at a distal end in the direction indicated by arrow N1 of the lever regulating portion 216*g*2, and the lever regulating portion 216*g*2 comes into contact with mainly the positioning target portion 271*d*2 of the cartridge D2 of the projection 216*g*4. The projection 216*g*4 is configured to abut on the positioning target portion 271*d*2 so that a force acting in the direction of resisting the biasing force acting on the movable lever 216*g* is not generated from the force F2 received from the positioning target portion 271*d*2 (so that the force F2 does not include such a component force). At least the force F2 that the projection 216*g*4 receives from the positioning target portion 271*d*2 may act in the direction orthogonal to the movable direction (the directions indicated by arrows N1 and N2) of the lever regulating portion 216*g*2 of the movable lever 216*g*. Preferably, the projection 216*g*4 may be pressed from the positioning target portion 271*d*2 at such an angle that a force acting in a direction (a direction opposite to the direction toward the non-regulation position) along the turning direction of the movable lever 216*g* due to the biasing force is generated.

Here, a regulating surface 216*l* as a supporting portion that supports the movable lever 216*g* is provided in the non-driving-side guide 216 on a side (the downstream side in the insertion direction (the direction indicated by arrow C)) of the movable lever 216*g* opposite the lever regulating portion 216*g*2 pressed from the positioning target portion 271*d*2. In this way, for example, even when the cartridge D2 is forcibly inserted, the movable lever 216*g* receives the force F2 from the positioning target portion 271*d*, and the movable lever 216*g* is deformed, deformation of the movable lever 216*g* in the direction of the force F2 can be regulated by the regulating surface 216*l*. Due to this, it is possible to prevent deformation and destruction of the movable lever 216*g* and to regulate insertion (arrival at an attachment completion position) of an unallowed cartridge reliably.

As described above, using the first attachment error prevention mechanism provided on one end side (a non-driving side) of a cartridge, it is possible to allow attachment of an allowed cartridge and regulate attachment of an unallowed cartridge (a first or second unallowed cartridge).

Removal of Cartridge

Figure 21:
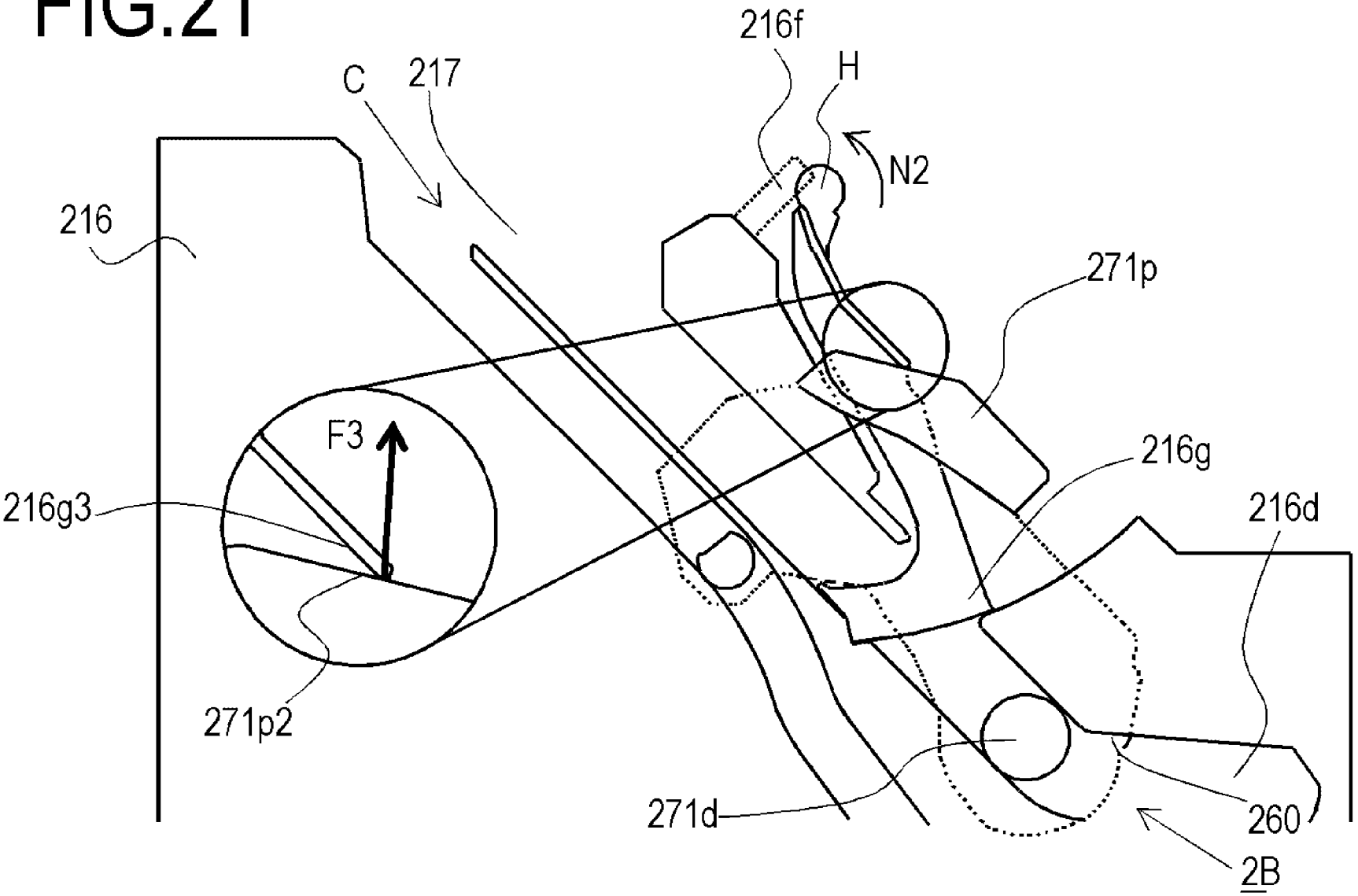
FIG. 21 is a diagram for describing an operation of an attachment error prevention mechanism during removal of a cartridge according to Embodiment 2.

An operation when the cartridge 2B is removed will be described with reference to FIG. 21.

As described above, the movable lever 216*g* is at the first regulation position when the cartridge 2B is in an attachment completion state.

A second abutting portion 271*p*2 is provided on the upstream side in the insertion direction (the direction indicated by arrow C) of the rib 271*p* of the cartridge 2B. When the cartridge 2B is moved in a direction opposite to the direction indicated by arrow C, the second abutting portion 271*p*2 comes into contact with the abutting surface 216*g*3 before the positioning target portion 271*d* comes into contact with the movable lever 216*g*. A force F3 is applied to the movable lever 216*g* with the second abutting portion 271*p*2 disposed therebetween by a removal force of the cartridge 2B. In this way, the movable lever 216*g* rotates about the shaft center H in the direction indicated by arrow N2 and moves from the first regulation position to the first allowable position. A subsequent removal opening is reverse to the above-described attachment operation of the cartridge 2B, and the description thereof will be omitted.

Second Attachment Error Prevention Mechanism for Cartridge

Figure 22A:
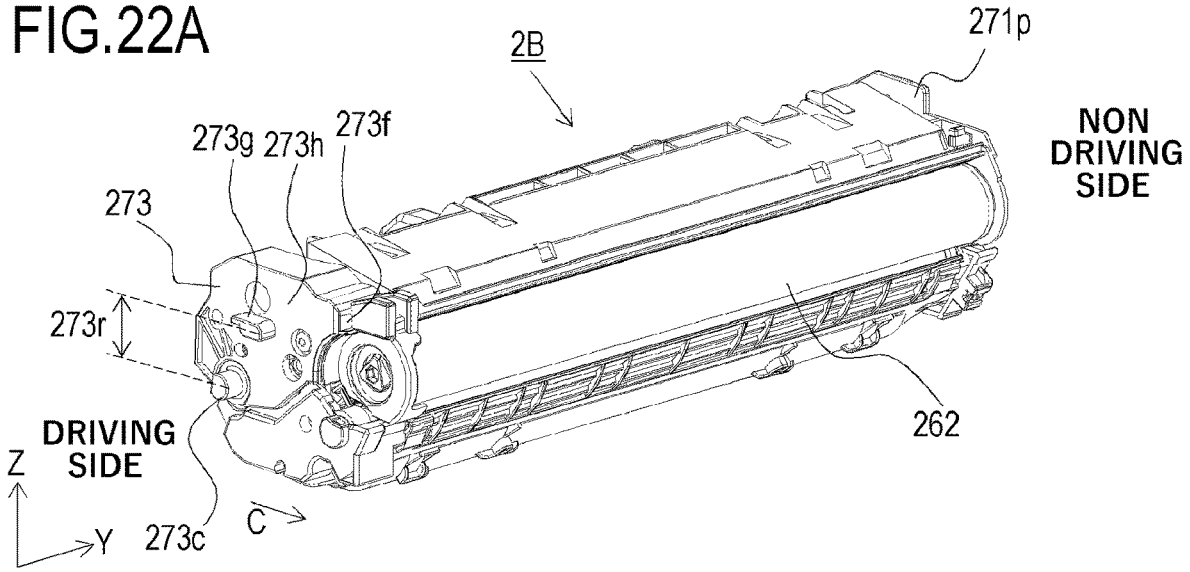
FIGS. 22A and 22B are diagrams for describing a second attachment error prevention mechanism according to Embodiment 2.
Figure 22B:
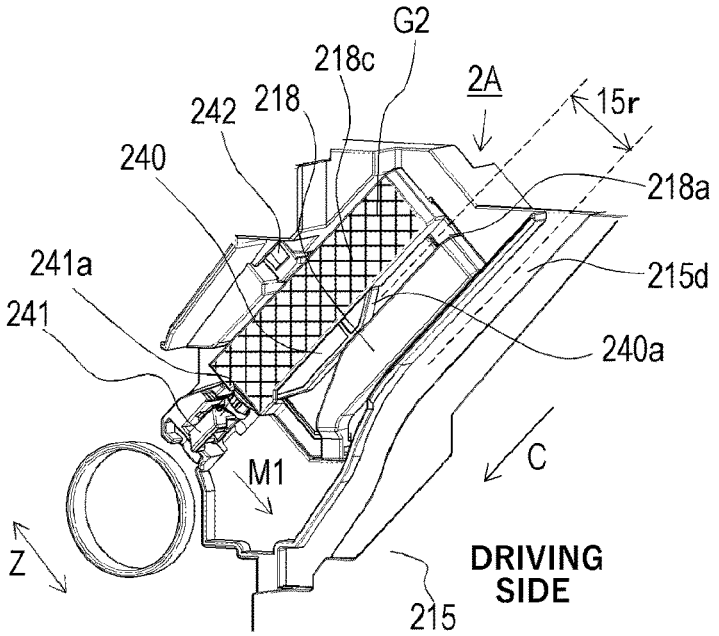
Figure 23A:
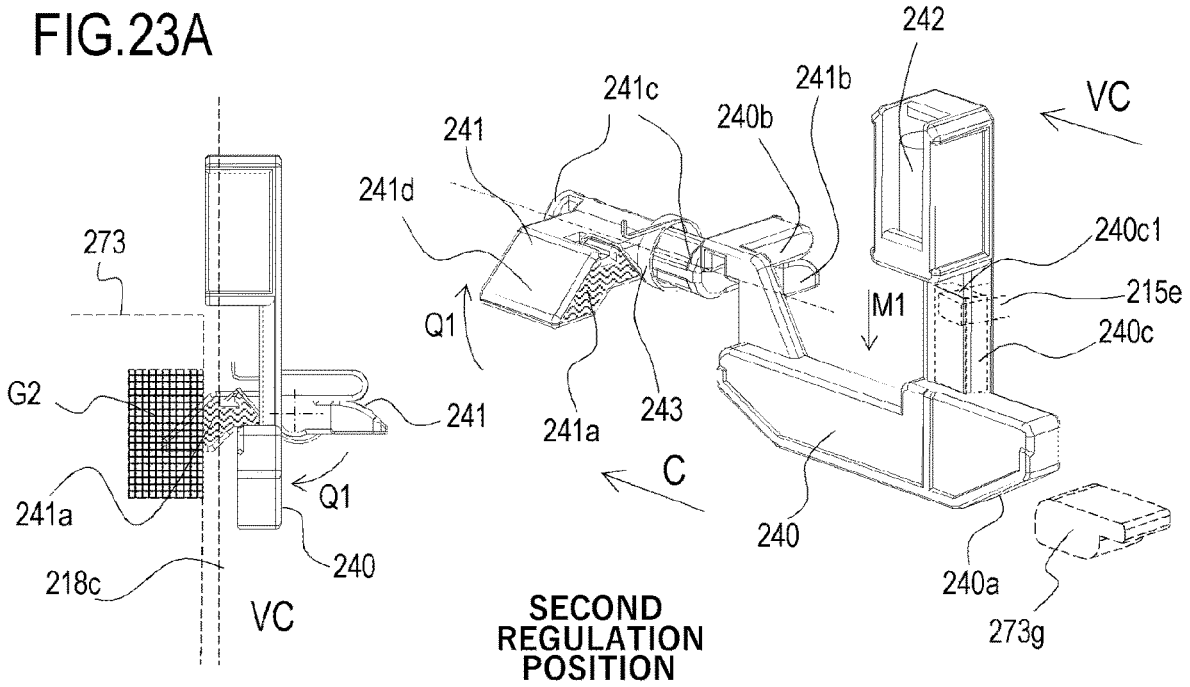
FIGS. 23A and 23B are diagrams for describing a second attachment error prevention mechanism according to Embodiment 2.
Figure 23B:
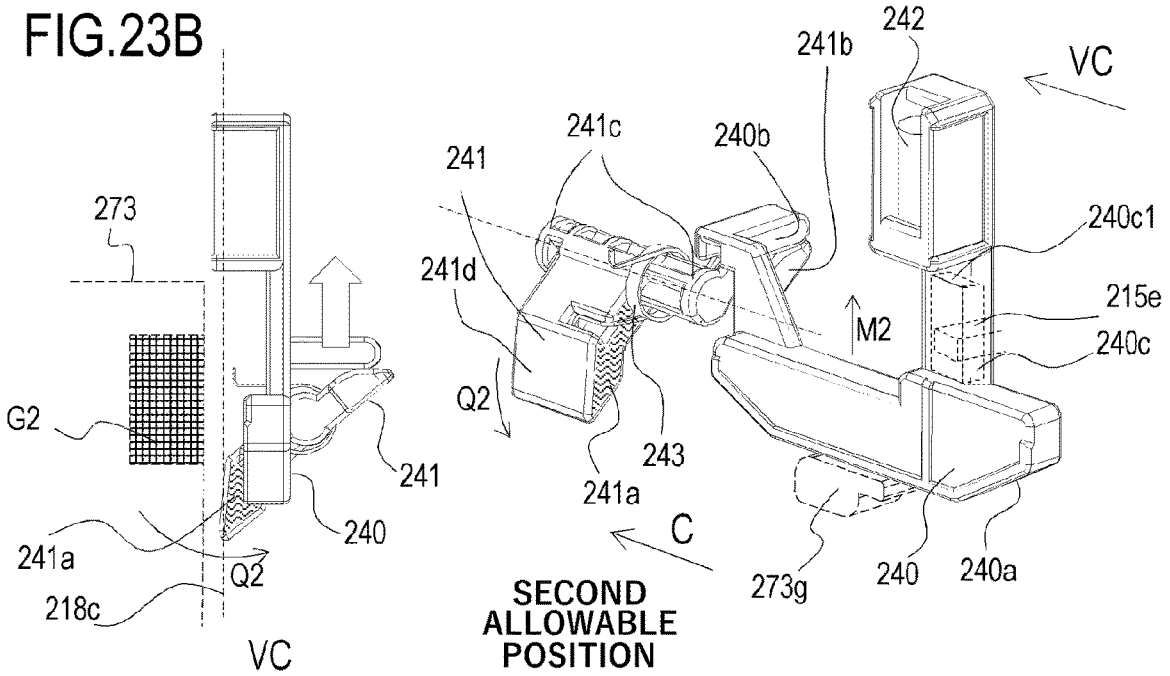

A second cartridge attachment error prevention mechanism provided on the driving side of the apparatus body 2A will be described with reference to FIGS. 22A to 23B. FIG. 22A is an explanatory diagram of the second attachment error prevention mechanism of the cartridge 2B and FIG. 22B is an explanatory diagram of the second attachment error prevention mechanism of the apparatus body 2A. FIGS. 23A and 23B are explanatory diagrams of the second attachment error prevention mechanism of the apparatus body 2A, in which some mechanisms are taken out.

As illustrated in FIG. 22A, on the driving side in the longitudinal direction Y of the cartridge 2B, an abutting target portion 273*f* as a fourth identification target portion is provided in addition to the identification target boss 273*g* (the second identification target portion) and the rotation-stopping target portion 273*c*. The abutting target portion 273*f* is a portion provided integrally with a downstream-side end in the attachment direction C of the end surface 273*h* of the drum bearing 273 and has a surface vertical to the attachment direction C. The abutting target portion 273*f* passes through a place near a driving-side inner surface 218*c* illustrated in FIG. 22B similarly to the driving-side end surface 273*h* during attachment of the cartridge 2B. Here, as illustrated in FIG. 22A, a distance in the up-down direction Z between the identification target boss 273*g* and the rotation-stopping target portion 273*c* is defined as a distance 73*r*, and a path through which the abutting target portion 273*f* passes is defined as an attachment trajectory G2 (a fourth guide portion) (see FIG. 22B).

On the other hand, as illustrated in FIG. 22B, a movable slider 240 and a movable cam 241 as a second movable member are provided on the driving side of the apparatus body 2A in addition to the driving-side guide 215 and the second guide rail 218 (the second identifying portion). As described above, the driving-side guide portion 215*d* is provided in the driving-side guide 215, and the second guide portion 218*a* is provided in the second guide rail 218. An interval between these guide portions in the up-down direction Z is defined as a distance 15*r*.

The movable slider 240 is supported by the second guide rail 218 and is provided so as to be movable in the up-down direction Z of the cartridge 2B. The movable slider 240 is biased in a direction indicated by arrow M1 by a slider spring 242 which is a compression spring so as to block the second guide portion 218*a*. Moreover, the movable slider 240 has an abutting surface 240*a* on the upstream side in the attachment direction C of the cartridge 2B so as to intersect the attachment direction C and the direction indicated by arrow M1 and face the upstream side in the attachment direction C. Furthermore, as illustrated in FIGS. 23A and 23B, the movable slider 240 has a connecting portion 240*b* that operates the movable cam 241 on the downstream side in the attachment direction C of the cartridge 2B.

The movable cam 241 is supported by the second guide rail 218 (see FIG. 22A) on a side closer to the downstream side than the movable slider 240 in the attachment direction C of the cartridge 2B. As illustrated in FIGS. 23A and 23B, the movable cam 241 includes a cam regulating portion 241*a* as a second movable portion (a fourth identifying portion), a supporting target portion 241*c* supported by the second guide rail 218 (see FIG. 22A), and a connecting target portion 241*b* that receives an operating force from the movable slider 240. The movable cam 241 is supported so as to be able to turn about the supporting target portion 241*c* in a direction parallel to the attachment direction C and is movable between the second regulation position (FIG. 23A) and the second allowable position (FIG. 23B). Here, when the movable cam 241 is at the second regulation position, as illustrated in FIG. 23A, the cam regulating portion 241*a* protrudes further from the driving-side inner surface 218*c* to block the attachment path G2 of the abutting target portion 273*f*. In contrast, as illustrated in FIG. 23B, when the movable cam 241 is at the second allowable position (the non-regulation position), the cam regulating portion 241*a* does not protrude further from the driving-side inner surface 218*c* to release the attachment path G2 of the abutting target portion 273*f*. Furthermore, the movable cam 241 is biased by a cam spring 243 which is a torsion coil spring in the direction indicated by arrow Q2 (that is, so as to be at the second allowable position).

As illustrated in FIG. 23A, in a natural state in which an external force is not applied, the movable slider 240 moves in the direction indicated by arrow M1 by the biasing force of a slider spring 242. By doing so, the connecting portion 240*b* presses the connecting target portion 241*b* in the direction indicated by arrow M1, whereby the movable cam 241 turns in the direction indicated by arrow Q1 while resisting against the biasing force of the cam spring 243. The movement in the direction M1 of the movable slider 240 is regulated when a boss 215*e* provided in the driving-side guide 215 fits into a guide 240*c* provided in the movable slider 240 to abut on a guide upper surface 240*c*1. The connecting portion 240*b* and the connecting target portion 241*b* are interlocked with each other whereby the positions of the movable cam 241 and the cam regulating portion 241*a* are determined (the second regulation position).

In contrast, as illustrated in FIG. 23B, when the movable slider 240 is moved in a direction (the direction indicated by arrow M2) opposite to the direction indicated by arrow M1 by an external force, the connecting portion 240*b* is separated from the connecting target portion 241*b* of the movable cam 241. By doing so, the movable cam 241 turns in the direction (the direction indicated by arrow Q2) opposite to the direction indicated by arrow Q1 by the biasing force of the cam spring 243 until the connecting target portion 241*b* abuts on the connecting portion 240*b*.

Furthermore, when the movable cam 241 turns in the direction indicated by arrow Q2 by an external force, the movable slider 240 moves in the direction indicated by arrow M2 while resisting the biasing force of the slider spring 242. In this way, even when the direction of operation and the master-slave relation are reversed, these components are interlocked with each other similarly.

Although a spring (biasing means) is provided in both the movable slider 240 and the movable cam 241, the biasing means may be provided in either one of them and the movable slider 240 and the movable cam 241 may be connected by a link mechanism.

Process in Which Cartridge 2B is Attached to Apparatus Body 2A

A process in which the cartridge 2B is attached to the apparatus body 2A will be described with reference to FIGS. 24A to 25B. FIGS. 24A to 25B are cross-sectional views for describing the process of attachment of the cartridge 2B and are views along arrow VC. The driving-side guide 215 and the drum bearing 273 are illustrated in a simplified manner. Moreover, the arrow view VC is a view illustrating the state of the movable slider 240 and the movable cam 241 on a side closer to the downstream side than the upstream side in the attachment direction C of the cartridge 2B in the cross-sectional view.

First, as illustrated in FIG. 24A, the distance 73*r* of the cartridge 2B is the same as the distance 15*r* of the apparatus body A. Due to this, when the cartridge 2B is attached to the apparatus body 2A, the cartridge 2B enters in the attachment direction C while the identification target boss 273*g* is guided to the second guide portion 218*a* and the rotation-stopping target portion 273*c* is guided to the driving-side guide portion 215*d*.

By doing so, as illustrated in FIG. 24B, the identification target boss 273*g* abuts on the abutting surface 240*a* of the slider 240. When the cartridge 2B is moved in the attachment direction C in this state, the identification target boss 273*g* applies a force F4 originating from the attachment force of the cartridge 2B to the abutting surface 240*a*.

Figure 25A:
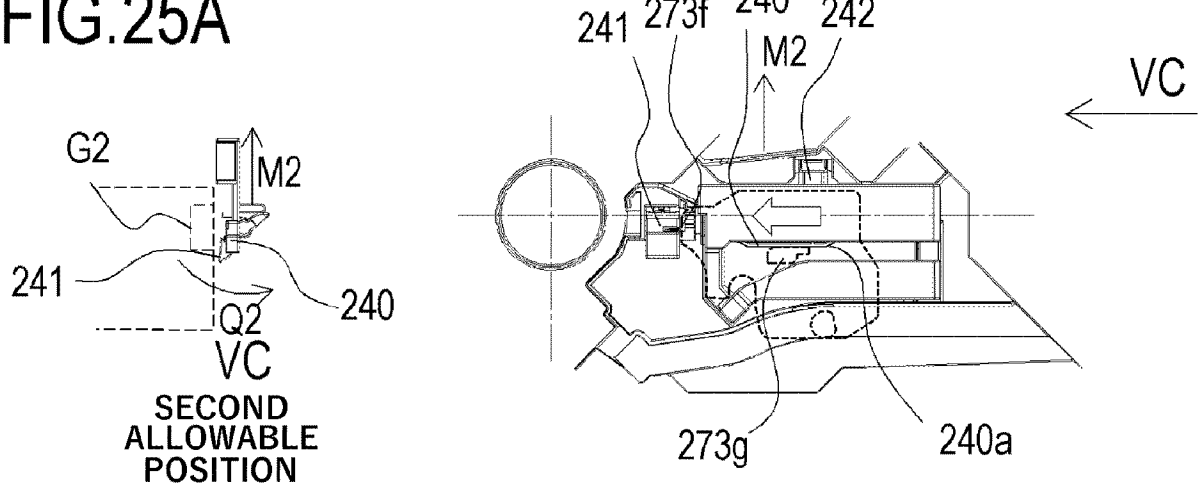
FIGS. 25A and 25B are diagrams for describing a second attachment error prevention mechanism during insertion of a cartridge according to Embodiment 2.

With this force F4, as illustrated in FIG. 25A, the movable slider 240 moves in the direction indicated by arrow M2 while resisting the biasing force of the slider spring 242 and the cartridge 2B can enter further into the apparatus body 2A. In this case, the movable cam 241 turns in the direction indicated by arrow Q2 with movement of the movable slider 240 and moves up to the second allowable position at which the attachment path G2 of the abutting target portion 273*f* of the cartridge 2B is released.

Figure 25B:
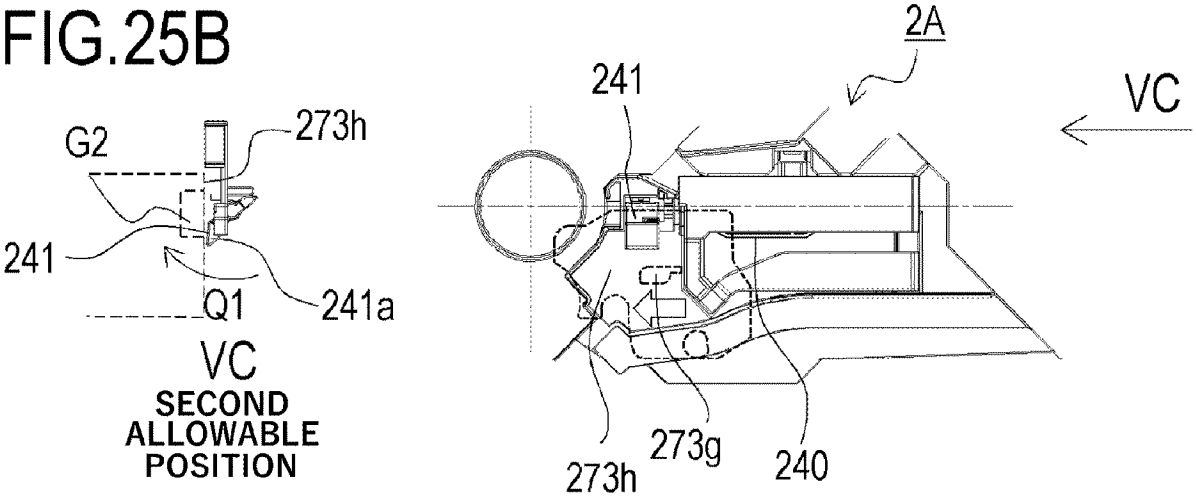

When the cartridge 2B is inserted further, as illustrated in FIG. 25B, the identification target boss 273*g* passes through the movable slider 240 in a state in which the movable slider 240 is moved in the direction indicated by arrow M2. In this case, since contact between the movable slider 240 and the identification target boss 273*g* disappears, the movable cam 241 starts turning in the direction indicated by arrow Q1 by the biasing force of the slider spring 242. The capacitance abutting portion 241*d* abuts on the driving-side end surface 273*h* of the drum bearing 273 whereby turning of the movable cam 241 stops.

When the cartridge 2B is inserted further, the cartridge 2B reaches an attachment completion position illustrated in FIG. 27B as described above with respect to the apparatus body 2A. That is, the upper positioning target portion 273*d*, the lower positioning target portion 273*f*, and the rotation-stopping target portion 273*c* of the cartridge 2B abut on the upper positioning portion 215*a*, the lower positioning portion 215*b*, and the rotation-stopping portion 215*c* of the apparatus body 2A, respectively, whereby attachment is completed.

To summarize the above description, when the cartridge 2B that is allowed to be attached to the apparatus body 2A is inserted, the identification target boss 273*g* passes through the second guide portion 218*a*. When the cam regulating portion 241*a* (the movable cam 241) is moved to the second allowable position with the aid of the movable slider 240, the cartridge 2B can enter the apparatus body 2A while preventing the abutting target portion 273*f* from abutting on the cam regulating portion 241*a*.

Process of Preventing Attachment Error of Cartridge D3 (First Unallowed Case)

Figure 26A:
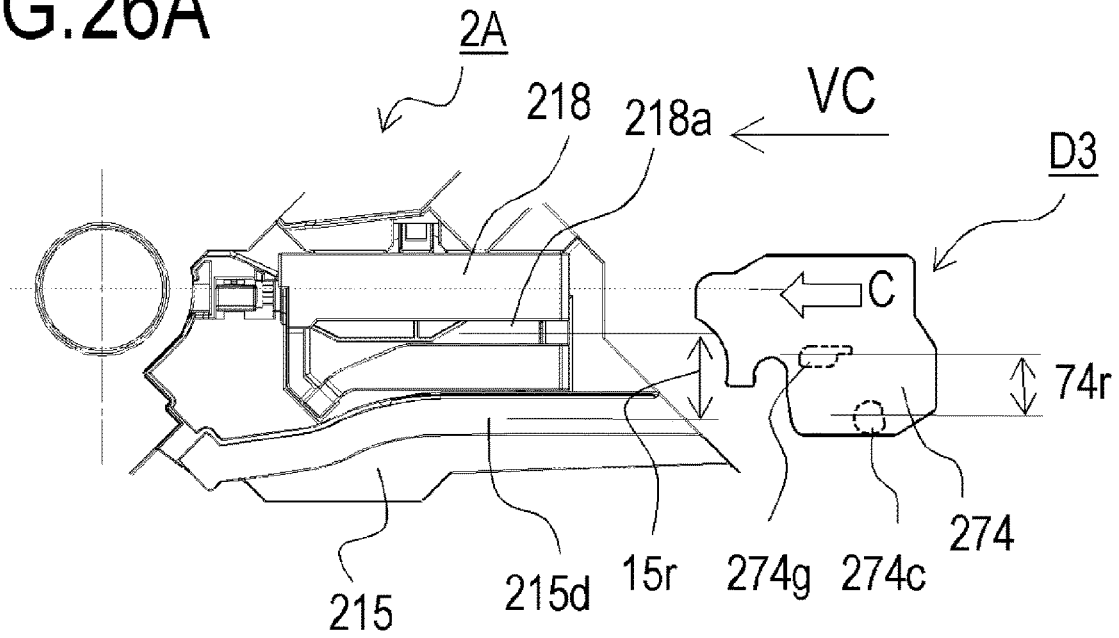
FIGS. 26A and 26B are diagrams for describing a second attachment error prevention mechanism during insertion of a cartridge according to Embodiment 2.
Figure 26B:
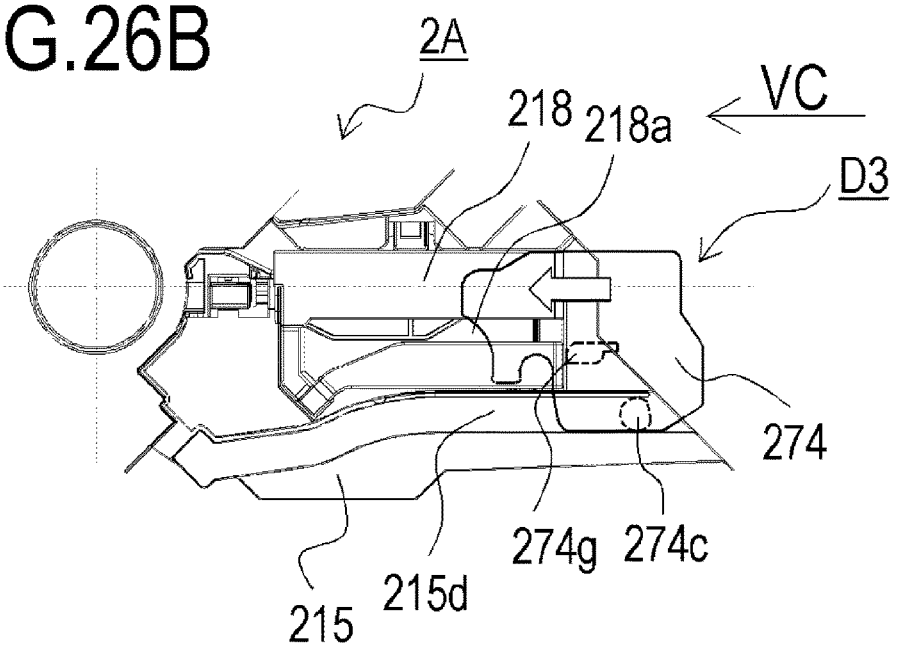

A process of preventing an attachment error of a cartridge D3 (a third unallowed cartridge) to the apparatus body 2A using the second driving-side attachment error prevention mechanism will be described with reference to FIGS. 26A and 26B. FIGS. 26A and 26B are cross-sectional views for describing the process of attachment of the cartridge D3, in which the driving-side guide 215 of the apparatus body 2A and the drum bearing 274 of the cartridge D3 are illustrated in a simplified manner.

As illustrated in FIG. 26A, the cartridge D3 is configured such that the distance 74*r* between an identification boss 274*g* and a rotation-stopping target portion 274*c* is narrow unlike the distance 73*r* of the cartridge 2B. When the cartridge D3 is inserted in the direction indicated by arrow C, the distance 74*r* is different from the distance 15*r* of the apparatus body. Therefore, as illustrated in FIG. 26B, the drum bearing 274 interferes with the driving-side guide 215 or the second guide rail 218 and the cartridge D3 cannot enter the attachment portion S. In this way, attachment of the cartridge D3 can be regulated.

That is, the second guide portion 218*a* of the second guide rail 218 has an inlet shape corresponding to the outer shape of the identification target boss 273*g* of the cartridge 2B when seen in the attachment direction of the cartridge to the apparatus body 2A. A regulating wall that abuts on the identification boss 274*g* of the cartridge D3 is formed around the inlet. Second identification of whether a cartridge that is to be attached to the apparatus body 2A is allowed one or not is realized by the second guide rail 218 as the second identifying portion, the identification target boss 273*g* and the identification target boss 274*g* as the second identification target portion provided in the cartridge 2B or D4.

Process of Preventing Attachment Error of Cartridge D4 (Second Unallowed Case)

A process of preventing an attachment error of still another cartridge D4 (a fourth unallowed cartridge) will be described with reference to FIGS. 27A and 27B. FIGS. 27A and 27B are cross-sectional views for describing the process of attachment of the cartridge D4 and are views along arrow VC. The driving-side guide 215 of the apparatus body 2A and the drum bearing 275 of the cartridge D4 are illustrated in a simplified manner. Moreover, the arrow view VC is a view illustrating the state of the movable slider 240 and the movable cam 241 on a side closer to the downstream side than the upstream side in the attachment direction C of the cartridge D4 in the cross-sectional view.

As illustrated in FIG. 27A, the cartridge D4 includes the drum bearing 275 (having the rotation-stopping target portion 275*c* only) that does not have the identification target boss 273*g* of the cartridge 2B. Due to this, when the cartridge D4 is inserted in the attachment direction C, as illustrated in FIG. 27B, the cartridge D4 can proceed in the attachment direction C while preventing the drum bearing 275 from interfering with the driving-side guide 215 and the second guide rail 218. However, when the cartridge D4 is inserted in this state, the cartridge D4 enters while preventing the drum bearing 275 from abutting on the abutting surface 240*a* of the movable slider 240. By doing so, in a state in which the cam regulating portion 241*a* is at the second regulation position, the abutting target portion 275*f* of the cartridge D4 comes into contact with the cam regulating portion 241*a*. In this way, a force F5 originating from the attachment force of the cartridge D4 is applied to the cam regulating portion 241*a* from the abutting target portion 275*f*. By doing so, the movable cam 241 is immovable from the second regulation position and the attachment path G2 remains in a blocked state. Since the force F5 acts in a direction orthogonal to the moving direction of the movable cam 241 and the movement of the movable cam 241 is regulated by the movable slider 240, the movable cam 241 does not move in a state of blocking the attachment path G2. In this way, it is possible to regulate attachment of the cartridge D4.

That is, fourth identification of whether a cartridge that is to be attached to the apparatus body 2A is allowed one or not is realized by the cam regulating portion 241*a* as the fourth identifying portion and the abutting target portion 273*f* of the cartridge D4 as the fourth identification target portion.

As described above, using the second attachment error prevention mechanism provided on the other end side (the driving side) of a cartridge, it is possible to allow attachment of an allowed cartridge and regulate attachment of an unallowed cartridge (a third or fourth unallowed cartridge).

In addition to the first attachment error prevention mechanism, only the cartridge 2B being allowed by both the first and second attachment error prevention mechanisms is allowed to be attached to the apparatus body 2A. In contrast, a cartridge (the cartridges D1 to D4) determined to be not allowed by either one of the first and second attachment error prevention mechanisms is regulated from being attached to the apparatus body 2A.

More specifically, the cartridges D1 to D4 are determined to correspond to either one of (i) the first unallowed case and (ii) the second unallowed case by either one of the attachment error prevention mechanisms, and attachment to the apparatus body 2A is regulated. The first unallowed case is a case in which attachment at a first attachment position on the uppermost side in the attachment path is regulated. The second unallowed case is a case in which, although a cartridge can pass through a first attachment position, attachment at a second attachment position closer to the upstream side than the attachment completion position is regulated, and the cartridge cannot reach the attachment completion position. Therefore, by performing identification individually at both ends in the longitudinal direction, it is possible to increase the number of allowed and unallowed identification patterns.

In the present embodiment, a non-driving-side identification pattern (a combination of the first identifying portion and the first identification target portion) is arranged such that it is identified whether the positions in the longitudinal direction Y of a cartridge match each other. Moreover, a driving-side identification pattern (a combination of the second identifying portion and the second identification target portion) is arranged such that it is identified whether the positions in the up-down direction Z of a cartridge match each other. However, the identification pattern is not limited to this configuration, but an arrangement direction of an identification pattern can be selected arbitrarily depending on an arrangement space of the attachment error prevention mechanism. As a result, a plurality of attachment error prevention mechanisms can be disposed in order to improve the space efficiency of the apparatus body 2A.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2018-246942, filed on Dec. 28, 2018, and No. 2018-246952, filed on Dec. 28, 2018, which are hereby incorporated by reference herein in their entirety.

What is claimed is:

1. A cartridge detachably attachable to an apparatus body, the apparatus body including a positioning portion configured to position the cartridge with respect to the apparatus body and a movable member configured to rotate from a first position to a second position, the first position being a position where a part of the movable member is configured to prevent the cartridge from being moved toward the positioning portion, the second position being a position where the part of the movable member is configured not to prevent the cartridge from being moved toward the positioning portion, the cartridge comprising:

a portion-to-be-positioned protruding in a first direction and configured to position the cartridge with respect to the apparatus body in a second direction orthogonal to the first direction by abutting on the positioning portion of the apparatus body; and a pressing portion configured to press the movable member to move the movable member from the first position to the second position while the cartridge is being moved in the second direction such that the portion-to-be-positioned passes by the part of the movable member to abut on the positioning portion.

2. The cartridge according to claim 1, wherein the portion-to-be-positioned and the pressing portion are provided on the same end side of the cartridge in the first direction.

3. The cartridge according to claim 1, further comprising a photosensitive drum, wherein, when viewed in the first direction, the portion-to-be-positioned is provided closer to the photosensitive drum than the pressing portion is to the photosensitive drum.

4. The cartridge according to claim 3, wherein, when viewed in the first direction, the portion-to-be-positioned is overlapped with the photosensitive drum.

5. The cartridge according to claim 1, wherein in a case where the portion-to-be-positioned and the positioning portion of the apparatus body are a first portion-to-be-positioned and a first positioning portion, respectively, the cartridge further includes a second portion-to-be-positioned configured to abut on a second positioning portion of the apparatus body to position the cartridge with respect to the apparatus body in the second direction, the second portion-to-be-positioned protruding in the first direction, and wherein, when viewed in the first direction, a position of an end of the pressing portion is provided between a position of the first portion-to-be-positioned and a position of the second portion-to-be-positioned in a direction from the first portion-to-be-positioned to the second portion-to-be-positioned.

6. The cartridge according to claim 1, wherein the pressing portion is a rib, with a thickness of the rib in the first direction being thinner than a thickness of the rib in the second direction.

7. The cartridge according to claim 6, wherein, when viewed in the first direction, the portion-to-be-positioned has cylindrical shape.

8. The cartridge according to claim 1, wherein the portion-to-be-positioned is configured to be guided toward the positioning portion of the apparatus body by a guiding portion of the apparatus body while the cartridge is being moved in the second direction.

9. The cartridge according to claim 5, wherein the first portion-to-be-positioned is configured to be guided toward the first positioning portion of the apparatus body by a first guiding portion of the apparatus body while the cartridge is being moved in the second direction, and wherein the second portion-to-be-positioned is configured to be guided toward the second positioning portion of the apparatus body by a second guiding portion of the apparatus body while the cartridge is being moved in the second direction.

* * * * *